US007506762B2

(12) United States Patent
Nelson et al.

(10) Patent No.: US 7,506,762 B2
(45) Date of Patent: Mar. 24, 2009

(54) DISPENSING PACKAGE

(75) Inventors: Donavon Nelson, Lake Elmo, MN (US); Thomas J. Dombroski, Newport Coast, CA (US); William Weernink, Savage, MN (US); Craig D. Bakken, Littleton, CO (US)

(73) Assignee: The Tapemark Company, West St. Paul, MN (US)

( * ) Notice: Subject to any disclaimer, the term of this patent is extended or adjusted under 35 U.S.C. 154(b) by 226 days.

(21) Appl. No.: 11/380,533

(22) Filed: Apr. 27, 2006

(65) Prior Publication Data

US 2006/0283727 A1 Dec. 21, 2006

Related U.S. Application Data

(63) Continuation-in-part of application No. 11/004,573, filed on Dec. 2, 2004, now abandoned.

(60) Provisional application No. 60/526,690, filed on Dec. 2, 2003, provisional application No. 60/725,083, filed on Oct. 7, 2005.

(51) Int. Cl.
*B65D 73/00* (2006.01)

(52) U.S. Cl. ..... 206/484.1; 206/229; 401/132

(58) Field of Classification Search ..... 401/132, 401/133, 196; 206/484.1, 229
See application file for complete search history.

(56) References Cited

U.S. PATENT DOCUMENTS

| | | | | |
|---|---|---|---|---|
| 3,315,801 | A | 4/1967 | Lowry | |
| 3,521,805 | A | 7/1970 | Ward | |
| 3,635,376 | A | 1/1972 | Hellstrom | |
| 3,741,384 | A | 6/1973 | Cloud | |
| 3,986,640 | A | 10/1976 | Redmond | |
| 4,140,409 | A | 2/1979 | DeVries | |
| 4,236,652 | A | 12/1980 | Beguhn | |
| 4,430,013 | A | 2/1984 | Kaufman | |
| 4,493,574 | A * | 1/1985 | Redmond et al. | 401/132 |
| 4,611,715 | A | 9/1986 | Redmond | |
| 4,648,506 | A | 3/1987 | Campbell | |
| 4,724,982 | A | 2/1988 | Redmond | |
| 4,819,406 | A | 4/1989 | Redmond | |

(Continued)

FOREIGN PATENT DOCUMENTS

| | | |
|---|---|---|
| AU | 144108 | 10/1948 |

(Continued)

*Primary Examiner*—Jacob K Ackun, Jr.
(74) *Attorney, Agent, or Firm*—Pauly, DeVries Smith & Deffner, L.L.C.

(57) ABSTRACT

Disclosed is a dispensing package that has a plastic backing for maintaining the package in a substantially flat orientation. The plastic backing is adapted to have a label placed on its surface. A score through the label, which extends into the plastic backing, causes the package to open upon flexure. At least one additional score on the opposite side provides at least one metered opening in the package, where the number of scores and metered openings depends on the contents being dispensed. An additional seal can be placed over the score to prevent accidental opening or provide resealing of the package. Promotional pieces can be used as the additional seal. Absorbent material can be placed adjacent or over the score to provide controlled dispensing and application of the contents. The ends of the plastic backing can be configured as an applicator and/or a handle.

72 Claims, 52 Drawing Sheets

U.S. PATENT DOCUMENTS

| | | | | |
|---|---|---|---|---|
| 4,871,091 | A | | 10/1989 | Preziosi |
| 5,090,832 | A | * | 2/1992 | Rivera et al. ..... 401/132 |
| 5,241,150 | A | | 8/1993 | Garvey et al. |
| 5,316,400 | A | | 5/1994 | Hoyt et al. |
| 5,368,199 | A | | 11/1994 | Haas et al. |
| 5,395,031 | A | | 3/1995 | Redmond |
| 5,494,192 | A | | 2/1996 | Redmond |
| 6,007,264 | A | | 12/1999 | Koptis |
| 6,041,930 | A | | 3/2000 | Cockburn |
| 6,085,942 | A | | 7/2000 | Redmond |
| 6,945,391 | B2 | | 9/2005 | Moodie |

FOREIGN PATENT DOCUMENTS

| | | | |
|---|---|---|---|
| DE | 2751078 | A1 | 11/1977 |
| DE | 004203430 | A1 | 8/1993 |
| EP | 1 227 047 | A1 | 7/2002 |
| WO | WO 92/20595 | | 11/1992 |
| WO | PCT/AU00/01052 | | 3/2001 |

* cited by examiner

100

100

DISPENSING PACKAGE

CROSS REFERENCE TO RELATED APPLICATIONS

This application is a continuation-in-part of U.S. patent application Ser. No. 11/004,573 filed Dec. 2, 2004, now abandoned, which claims priority to U.S. Provisional Patent Application 60/526,690 filed Dec. 2, 2003, the entireties of which are hereby incorporated by reference. This application also claims the benefit of U.S. Provisional Patent Application 60/725,083, filed Oct. 7, 2005.

BACKGROUND OF THE INVENTION a. Field of the Invention

The present invention generally pertains to packaging and more specifically pertains to dispensing packages.

b. Description of the Background

Various techniques have been used in the past for providing packaging of various types of materials. Prior devices, however, have generally been unable to provide packages that are capable of dispensing liquids, gels, creams, pastes and other types of fluid and semi-fluid materials in a controlled fashion using a low cost, easy to use package. In addition, many packages require the use of two hands to open a package. Further, many packages require application of fine dexterity or the use of fingernails to peel off coverings to access the contents of the package. Opening these types of packages may require additional time, and may require skills not possessed by certain segments of the population, such as young children, elderly individuals, handicapped persons, etc.

Exemplary packaging dispensers that can be opened with one hand are shown and described in DeVries U.S. Pat. No. 4,140,409; Kaufman U.S. Pat. No. 4,430,013; and Koptis U.S. Pat. No. 6,007,264 all incorporated herein by reference in their entireties. The '409 patent discloses a disposable liquid applicator including a pre-scored container such that a liquid within the applicator is dispensed into an absorbent material positioned on the exterior of the applicator at a point where the applicator snaps open when two opposing ends are bent away from the pre-scored portion. The '409 patent discloses two opposing large raised portions that contain the liquid and are interconnected by a pair of narrow raised channels. The applicator is then pre-scored along the portion of the package having the narrow raised channels. By using two narrow channels to join the opposing large raised portions, the volume of the liquid contained in the applicator is substantially contained in the large raised portions. Because of this, these applicators have irregular shapes with varying vertical thicknesses causing packaging and shipping problems. In addition, these applicators create problems for users because they are bulky to store and transport and the large raised portions are vulnerable to puncture whereby the liquid can leak out of the applicator. Thus, there exists a need for a dispensing package that provides controlled dispensing and application of a substance in the package while providing uniform dimensions for ease and safety in packaging, transporting and using the package without the risk of puncturing the package such that the contents leaks.

The '013 patent discloses an applicator package with a foam applicator attached to a backing member having at least one reservoir formed of a flat sheet material for containing a material to be applied. The flat sheet material has a slit or weakened portion under the foam applicator so that, when the distal ends of the package are forced toward one another, the package ruptures along the slit or weakened portion thereby dispensing the material into the foam applicator. In addition to this embodiment, the '013 patent discloses several embodiments of the package designed for controlled dispensing and application of the material, including foam contained within the reservoir, a "Band Aid" style opening, scrubbing bristles attached to the exterior of the package, and neck-down receptacles (similar to the design of the '409 patent). Despite the modifications proposed in the '013 patent, there still exists a need for a dispensing package that provides controlled dispensing and application of a wide variety of substances with varying viscosities while providing durability and uniformity in shape and size of the packages.

The '264 patent to Koptis discloses a pouch-like container for dispensing ingredients via built-in outwardly pivoting flaps. In order to dispense the material within the container, the user must break apart the flaps. The pouch-like container is created and remains in a folded position. The '264 patent discloses filling the container with a needle filler, as is known in the art. Problems associated with needle fillers include delivering imprecise volumes of material within the container, creating an additional puncture point in the container and being limited to materials with certain viscosities. Additionally, these containers suffer from a very high moisture vapor transmission (MVT) rate thereby allowing product to evaporate and dry out. Accordingly, there is a need for an efficient and cost-effective method of creating and filling dispensing packages with a variety of materials having varying viscosities, where the package size can be easily varied and the risk of moisture vapor transmission reduced.

For these reasons, a simple and easy to use, low cost package is needed that allows the user to open a package with one hand and dispense the contents of the package in a controlled manner.

BRIEF SUMMARY OF THE INVENTION

The present invention overcomes the disadvantages and limitations of the prior art by providing a low cost, simple and easy to use package that allows the user to dispense the contents of the package in a controlled manner. It is an object of the present invention to provide a dispensing package with uniform vertical thickness. It is a second object of the present invention to provide a dispensing package adaptable to contain materials with varying viscosities. It is a third object of the present invention to provide a method for creating and filling a dispensing package with a variety of materials, in a variety of sizes and with reduced MVT.

The present invention may therefore comprise a package for carrying and dispensing contents through at least one metered opening comprising: a plastic backing having a first elastic limit and a shear modulus sufficient to maintain the package in a substantially flat configuration; a label attached to a first side of the plastic backing; a first score formed through the label and extending at least partially into the first side of the plastic backing; a coating formed on a second side of the plastic backing having a second elastic limit that is greater than the first elastic limit; a pouch formed on the second side of the plastic backing that is adapted to carry the contents of the package; and at least one second score extending from an interior portion of the pouch and at least partially into the second side of the plastic backing, the at least one second score substantially aligned with the first score on the plastic backing so that flexure of the plastic backing by a first amount is sufficient to cause the plastic backing to exceed the first elastic limit and break along the first score while flexure to a folded position is insufficient to cause the coating to exceed the second elastic limit.

The present invention may further comprise a method of making a dispensing package for dispensing contents through at least one metered opening comprising: providing a plastic backing having a first sheer modulus sufficient to maintain the package in a substantially flat configuration and having a first elastic limit, the plastic backing having a coating formed on a second side of the plastic backing, the coating having a second elastic limit that is greater than the first elastic limit; placing a label on a first side of the plastic backing; placing a first score in the label and the plastic backing that penetrates the label and the plastic backing; placing at least a second score in the coating and the second side of the plastic backing; placing a pouch on the second side of the plastic backing over the coating, the pouch adapted to carry the contents.

BRIEF DESCRIPTION OF THE DRAWINGS

In the drawings,

FIG. 4G is a side view illustrating controlled dispensing of fluid from an alternative embodiment of the present invention.

FIG. 5D is a cutaway side view of the dispensing package of FIG. 3A.

DETAILED DESCRIPTION OF THE INVENTION

Figure 1:
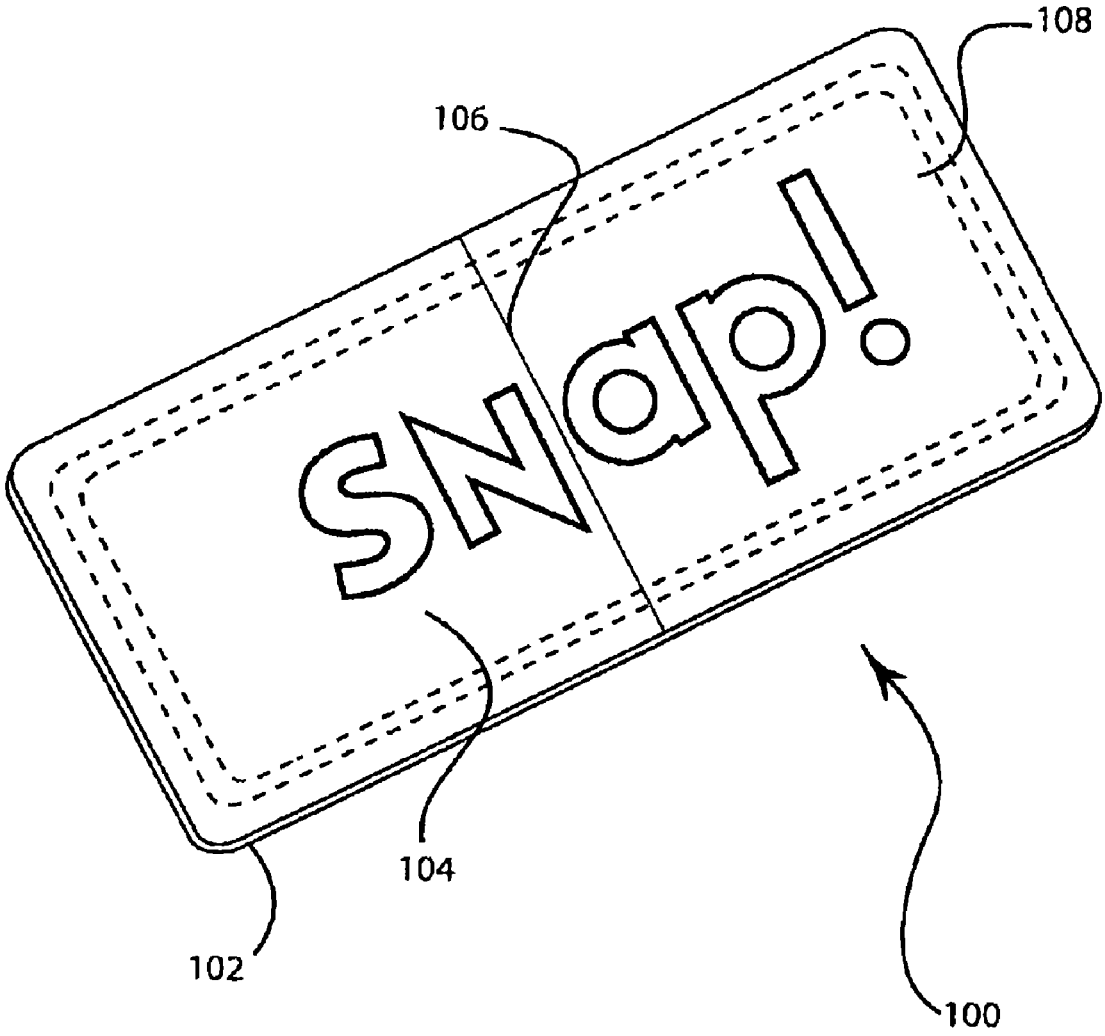
FIG. 1 is a top perspective view of one embodiment of the dispensing package of the present invention.

FIG. 1 is a perspective view of one embodiment of a dispensing package 100 in accordance with the present invention. Dispensing package 100 may take on any shape whatsoever such as square, round, rectilinear, triangular, etc. Dispensing package 100 has a plastic backing 102 made of thin plastic materials such as polystyrene, polyethylene, polypropylene or other polymeric or plastic type of material. Plastic backing 102 has a sufficient thickness and stiffness to hold dispensing package 100 in a substantially flat configuration. Located on the top surface of dispensing package 100 is a label 104. Label 104 can comprise any desired type of label including clear plastic labels, printed labels, etc. Label 104 can be attached to plastic backing 102 using a pressure sensitive adhesive, a heat curing adhesive or any other desired type of adhesive. Those in the art will appreciate that pressure sensitive layer 102 and label 104 may be eliminated entirely and printing can be done directly on plastic backing 102. According to FIG. 1, a score 106 is made through label 104 and into plastic backing 102. Upon flexure of dispensing package 100, plastic backing 102 breaks along score 106. A pouch 108 on the under side of dispensing package 100 contains a fluid material such as a liquid or gel that is dispensed through the broken plastic backing 102.

Figure 1A:
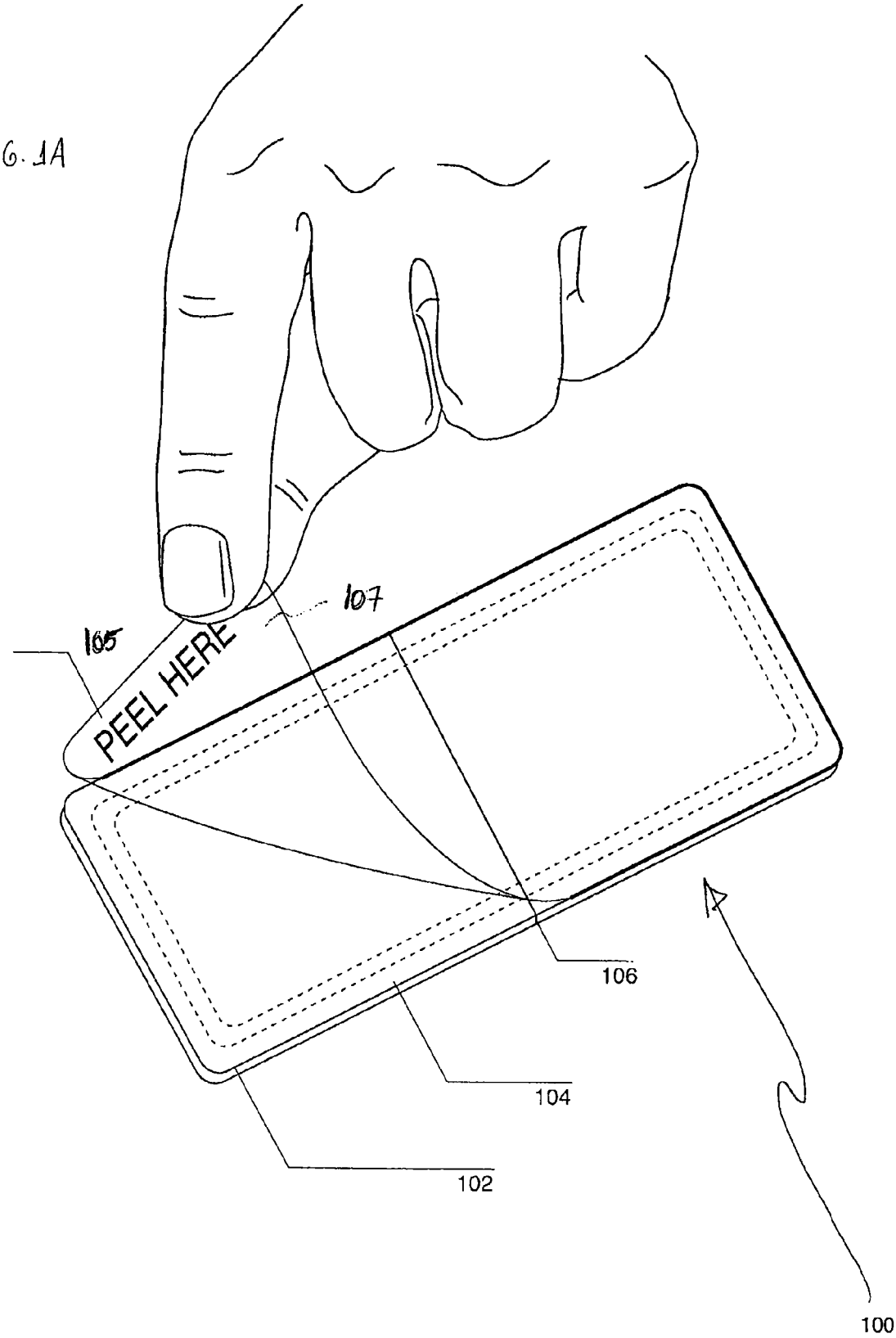
FIG. 1A is a top perspective view of an alternative embodiment of the dispensing package depicted in FIG. 1.

Referring now to FIG. 1A, there is shown an alternate embodiment in accordance with the present invention. Dispensing package 100 of this embodiment includes plastic backing 102, label 104 and score 106. This embodiment additionally includes removable film 105 located on the top surface of label 104. Film 105 may comprise any desired type of film 105 including polyethylene, Barex® (BP Chemicals, Inc., Naperville, Ill., USA), foils, nylon, other co-extruded films, and the like. Film 105 may be attached to label 104 using pressure sensitive adhesives, heat curing adhesives or any other desired type of adhesives. Adhesive may be omitted from a portion of one end or one corner of film 105 in order to provide a peel tab 107 whereby a user can grasp film 105 and peel it off label 104. In this embodiment score 106 is made only through label 104 and into plastic backing 102 while film 105 remains unscored as for example when it is desired to have a protective covering if the dispensing package 100 is going to travel in luggage or handbags. Alternatively, it may provide for a child-resistant seal. Still further, unscored film 105 may create additional billboard space if printing is done directly on film 105. Upon removal of film 105 and flexure of dispensing package 100, plastic backing 102 breaks along score 106 so that the contents of pouch 108 on the under side of dispensing package 100 is dispensed through the broken plastic backing 102. In an alternative embodiment, film 105 can also be scored.

As disclosed in more detail below, a metering hole is formed by a second score that extends through the interior portion of the package into plastic backing 102 so that the contents of dispensing package 100 is dispersed only over a portion of score 106.

Figure 2:
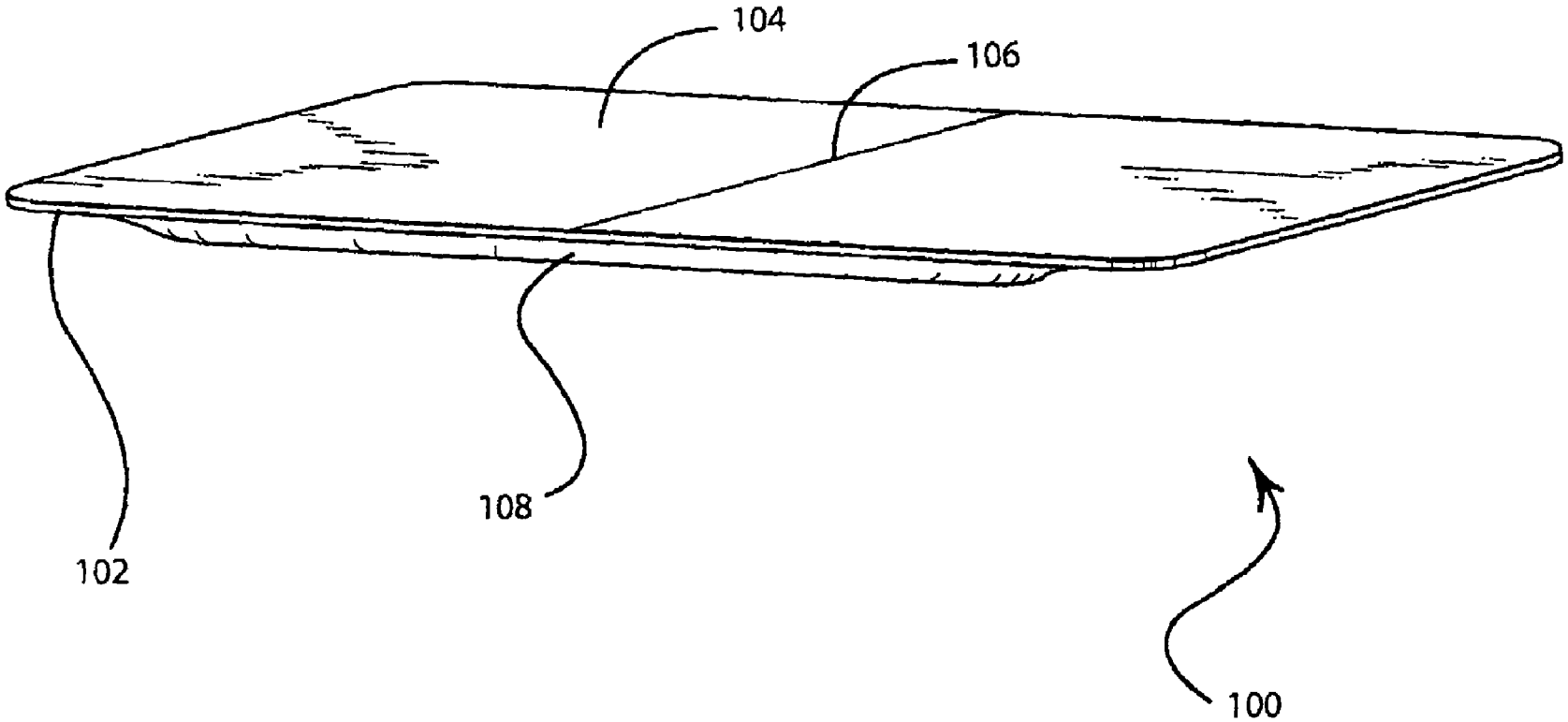
FIG. 2 is a side perspective view of the dispensing package of FIG. 1.

FIG. 2 is a side perspective view of dispensing package 100 of FIG. 1. As shown in FIG. 2, plastic backing 102 has a thickness that provides sufficient structural integrity to hold dispensing package 100 in a substantially flat configuration. Label 104 is placed on the outer (upper) surface of plastic backing 102. Score 106 is formed through label 104 and into plastic backing 102. As can also be seen in FIG. 2, a pouch 108 is attached to the underside of plastic backing 102 and contains the contents of the package, which normally includes a liquid, lotion, gel, paste or other such materials but can also include pharmaceuticals or medicines in pill form.

Figure 3:
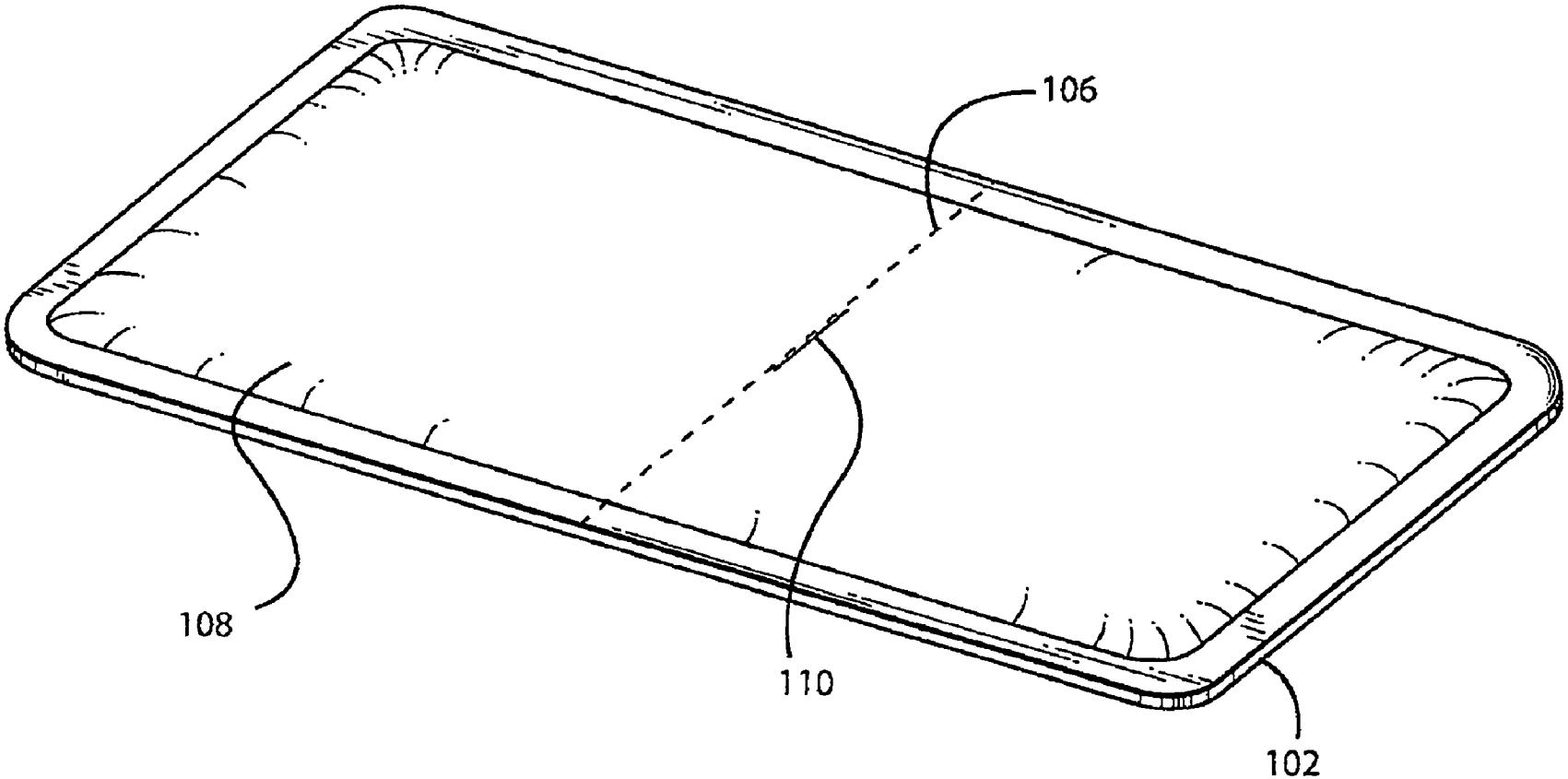
FIG. 3 is a bottom perspective view of the device of FIG. 1.

FIG. 3 is a perspective view of the underside of dispensing package 100. As shown in FIG. 3, plastic backing 102 has a score 106 that extends the entire width of plastic backing 102 as indicated above. An additional score, or metered slit 110 is formed underneath pouch 108 on the interior portion of dispensing package 100, which is the backside (or underside) of plastic backing 102. Score 110 is a short score and, as disclosed above, provides a metering hole for dispensing the contents of dispensing package 100, as explained in more detail below.

Figure 3A:
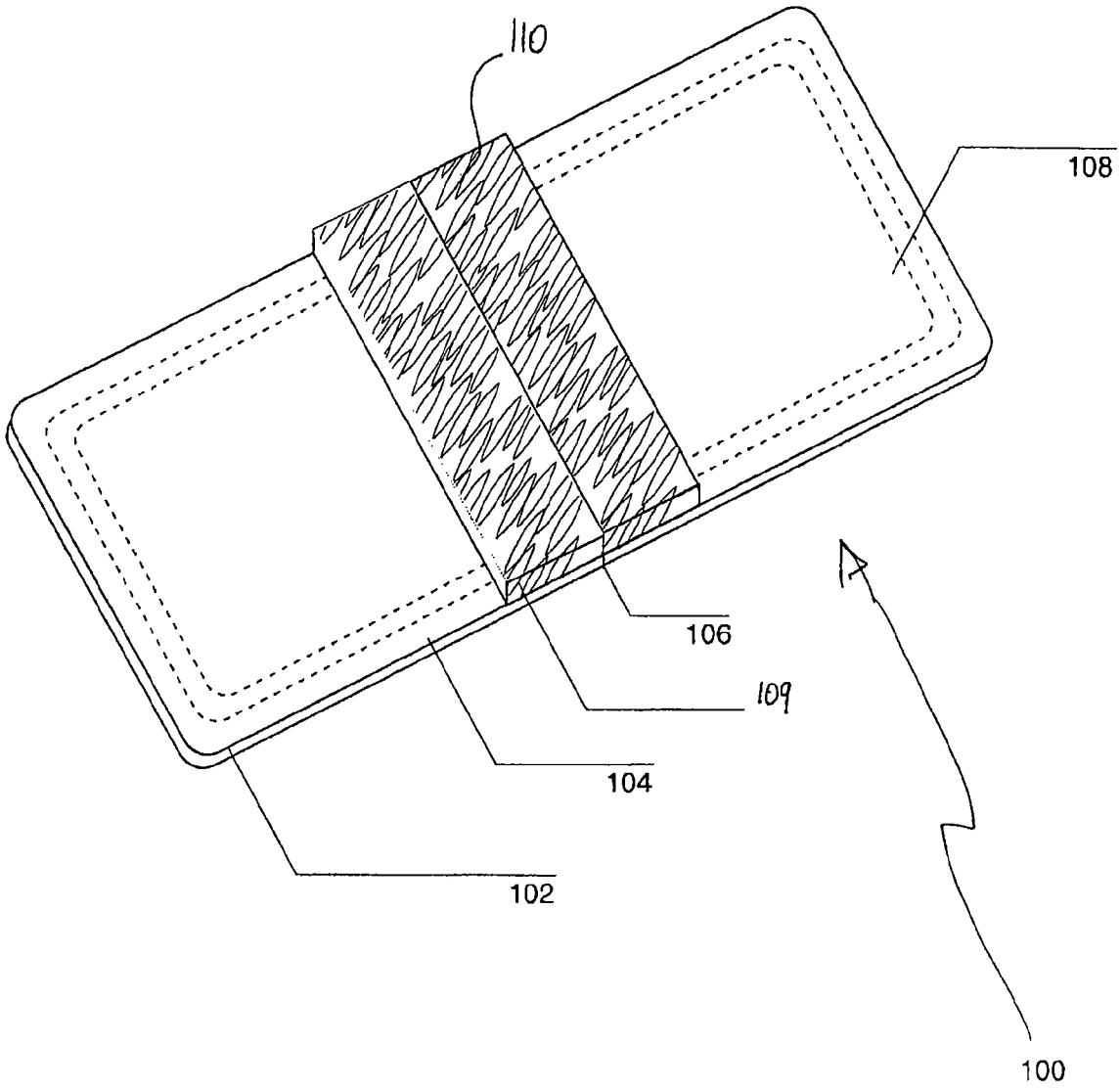
FIG. 3A is a bottom perspective view of an alternate embodiment of the dispensing package of FIG. 1.

FIG. 3A is a perspective view of an alternate embodiment of the present invention. As depicted, the underside of dispensing package 100 includes a first piece of material 109 positioned laterally along one side of score 106 and a second piece of material 111 positioned laterally along the other side of score 106. Alternately, material 109, 1 11 can be attached as one piece and then scored when plastic backing 102 and label 104 are scored. Material 109 may comprise any type of material including an absorbent material such as a sponge, cloth, flock, foam or non-absorbent, depending on its intended use, such as sand paper, a hard plastic, or the like.

Figure 3B:
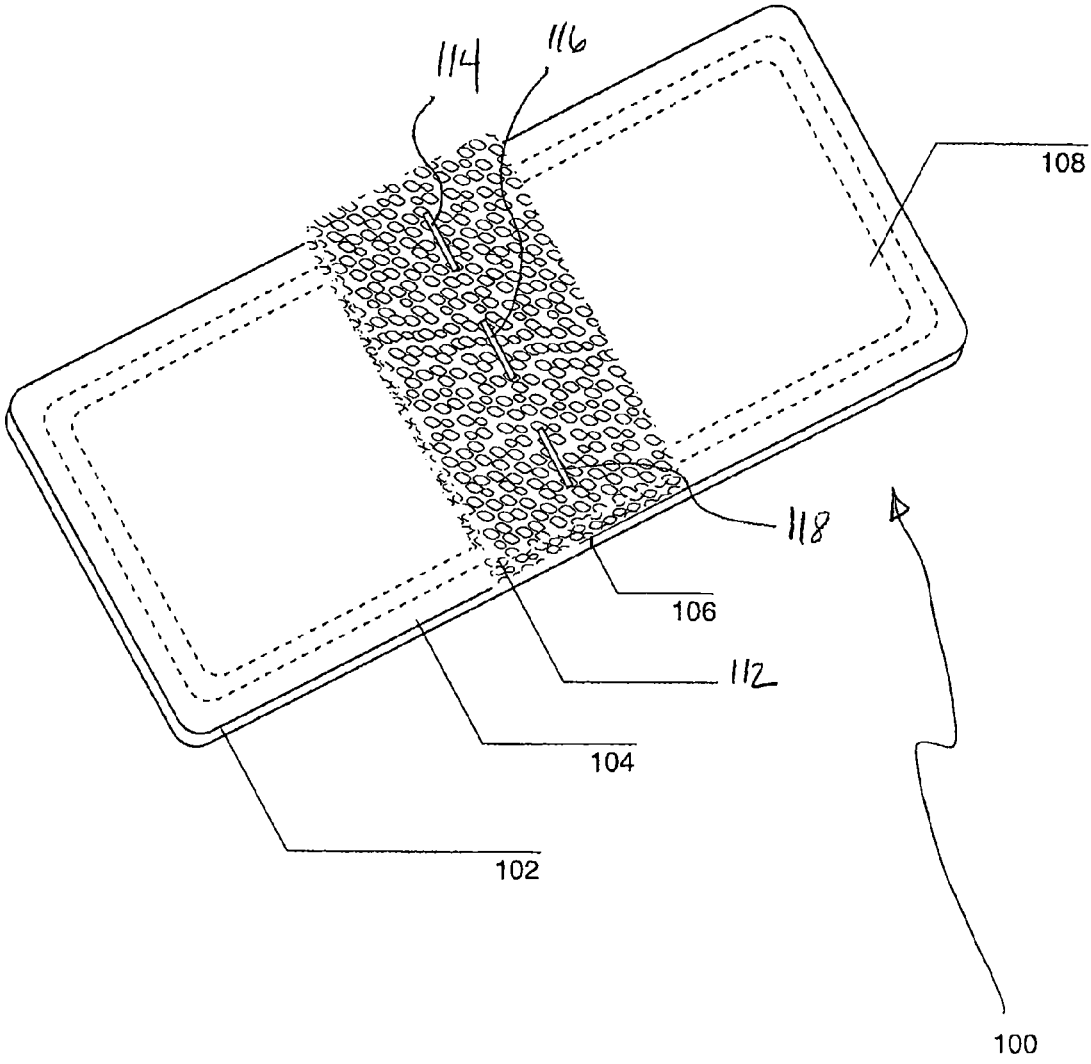
FIG. 3B is a bottom perspective view of an alternate embodiment of the dispensing package depicted in FIG. 1.

FIG. 3B is a perspective view of an alternate embodiment in accordance with the present invention. According to this embodiment, the underside of dispensing package 100 includes a continuous piece of material 112, such as foam, flock, or sponge that is positioned over score 106 and metered openings 114, 116, 118 made in the linear low density polyethylene to provide controlled application of the contents of dispensing package 100. Although three metered openings are depicted, those skilled in the art can appreciate that there can be any number of metered openings in a variety of different configurations to provide controlled application of the contents of dispensing package 100 onto material 112.

Figure 4A:
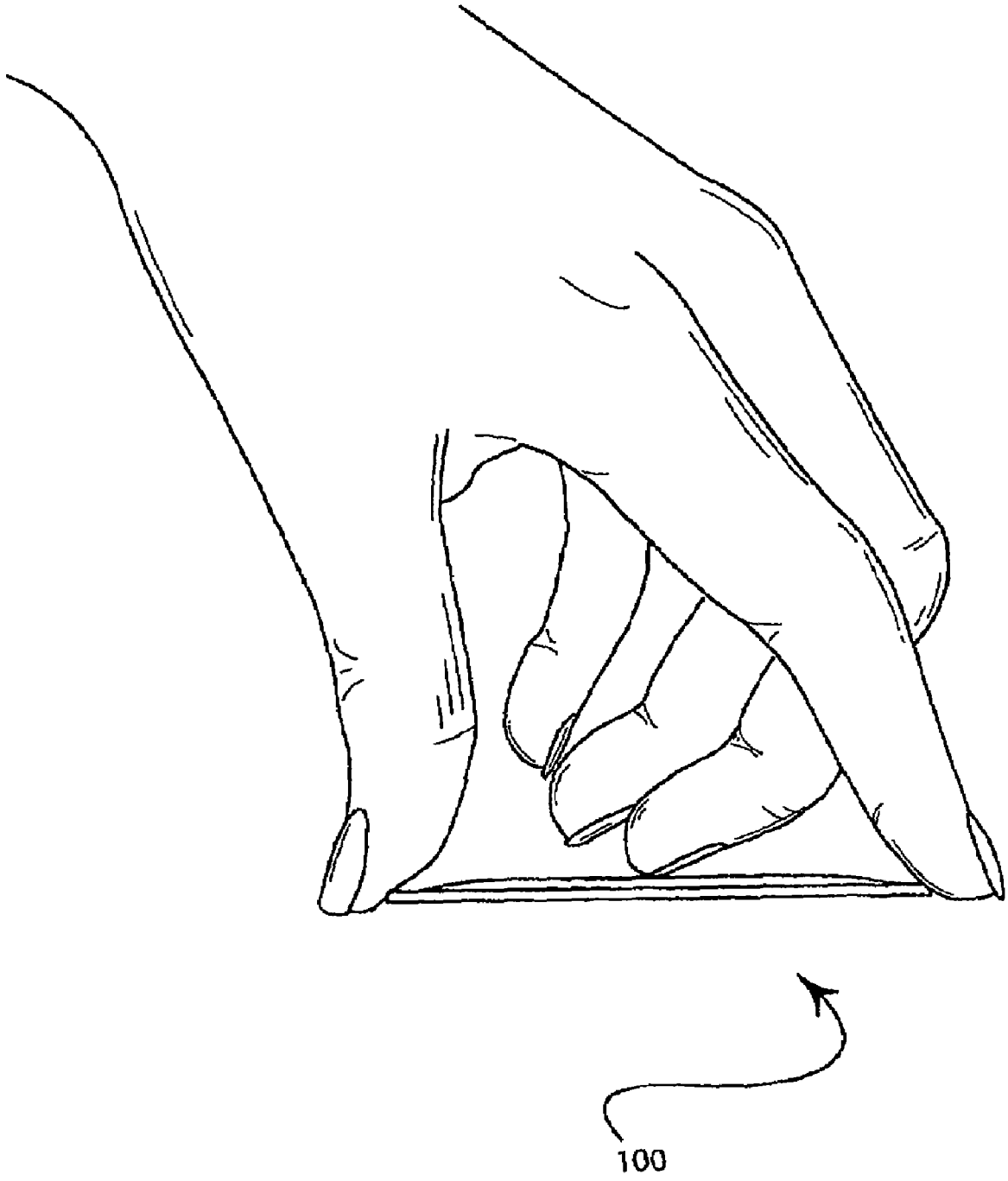
FIG. 4A is a side view illustrating the manner in which the dispensing package can be grasped for opening.
Figure 4B:
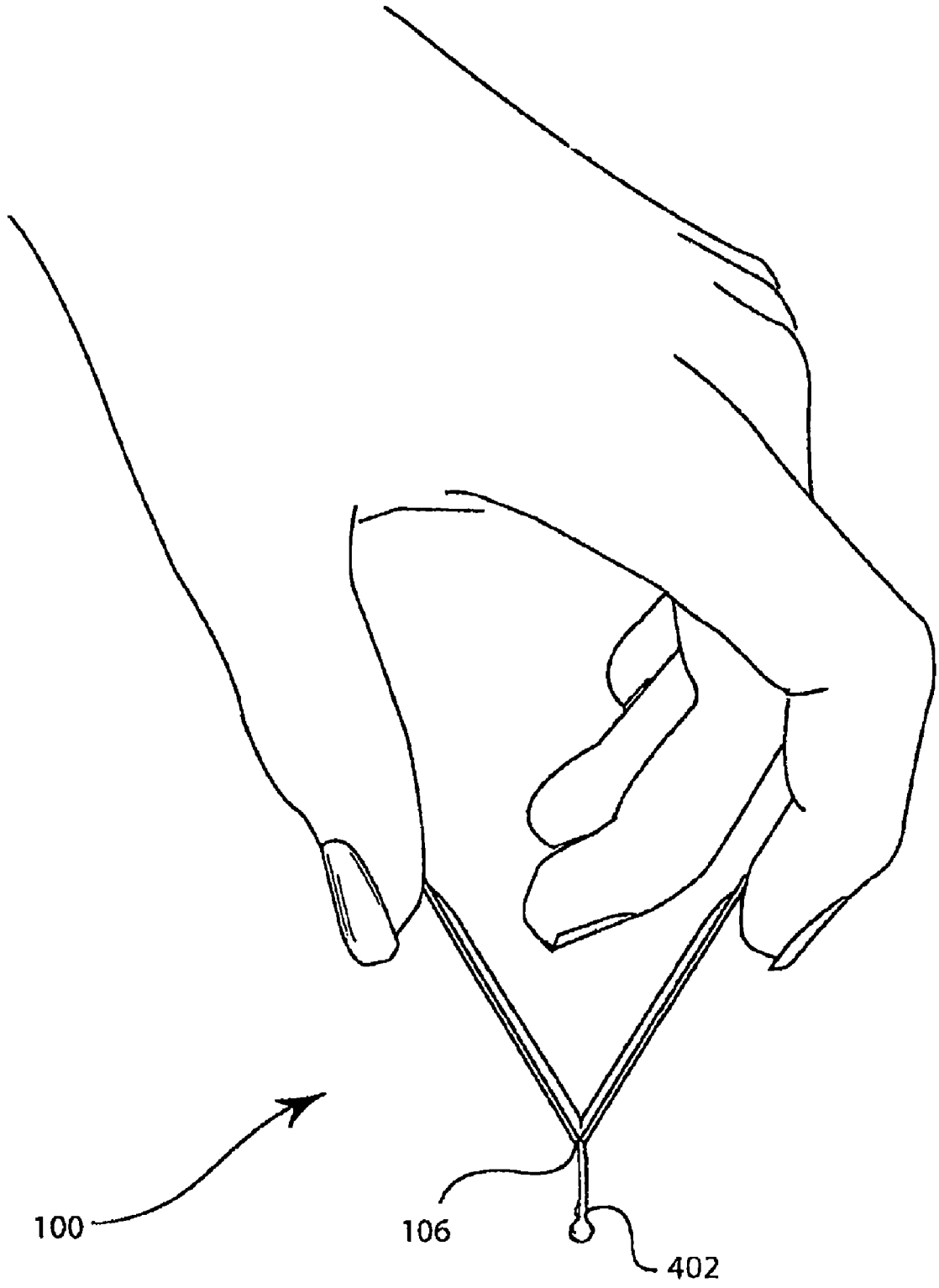
FIG. 4B is a side view illustrating the manner in which the dispensing package is flexed for opening.

FIG. 4A is a side view illustrating the manner in which dispensing package 100 may be grasped by a user. As shown in FIG. 4A, the ends of dispensing package 100 are grasped between the thumb and middle finger of the user. The index finger can then be used to push on the pouch side of dispensing package 100. As shown in FIG. 4B, dispensing package 100 flexes and breaks along score 106 to dispense contents 402.

Figure 4C:
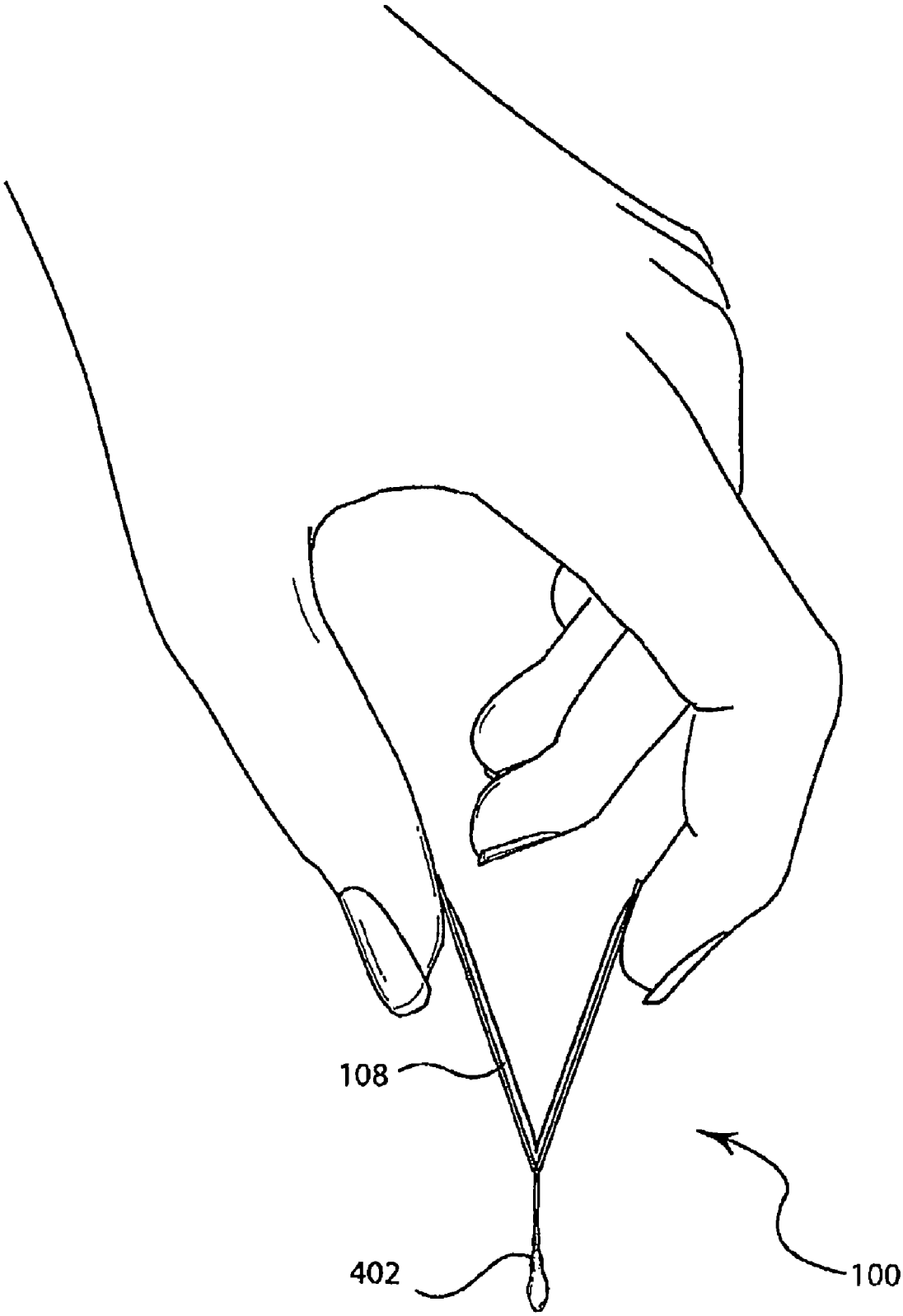
FIG. 4C is a side view illustrating additional flexure of the dispensing package and the further dispensing of fluid.

As shown in FIG. 4C, continued folding of dispensing package 100 causes pouch 108 to further compress and squeeze more of contents 402 from dispensing package 100. In this matter, the amount and flow rate of the dispensing of contents 402 can be controlled by the user.

Figure 4D:
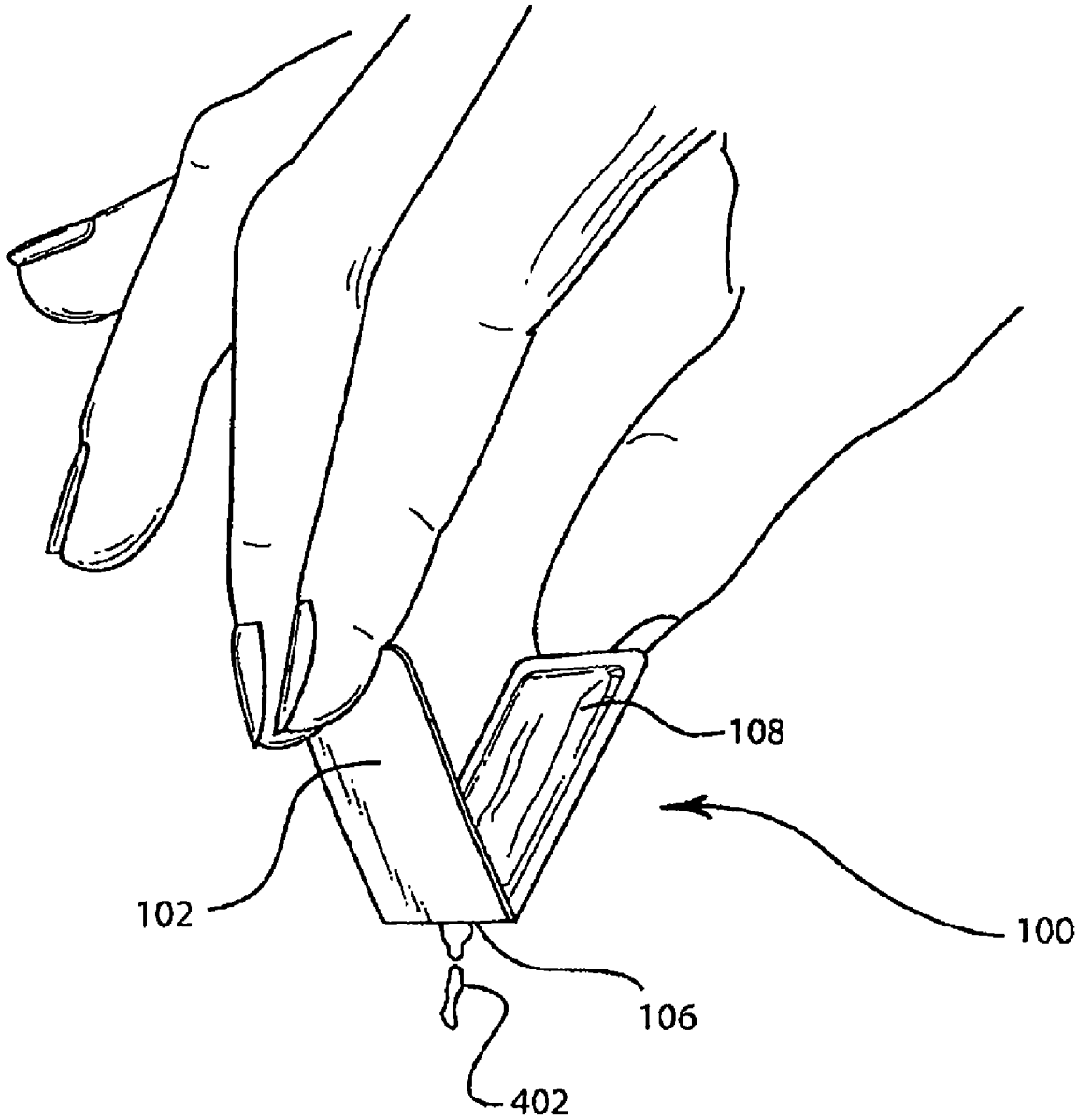
FIG. 4D is a perspective view of one embodiment of the invention illustrating the rapid dispensing of fluid.

FIG. 4D is another perspective view illustrating the manner in which dispensing package 100 is opened. FIG. 4D illustrates the embodiment of FIG. 1 in which score 106 extends across the entire width of plastic backing 102. As shown in FIG. 4D, pouch 108 dispenses contents 402 along the center portion of score 106.

Figure 4E:
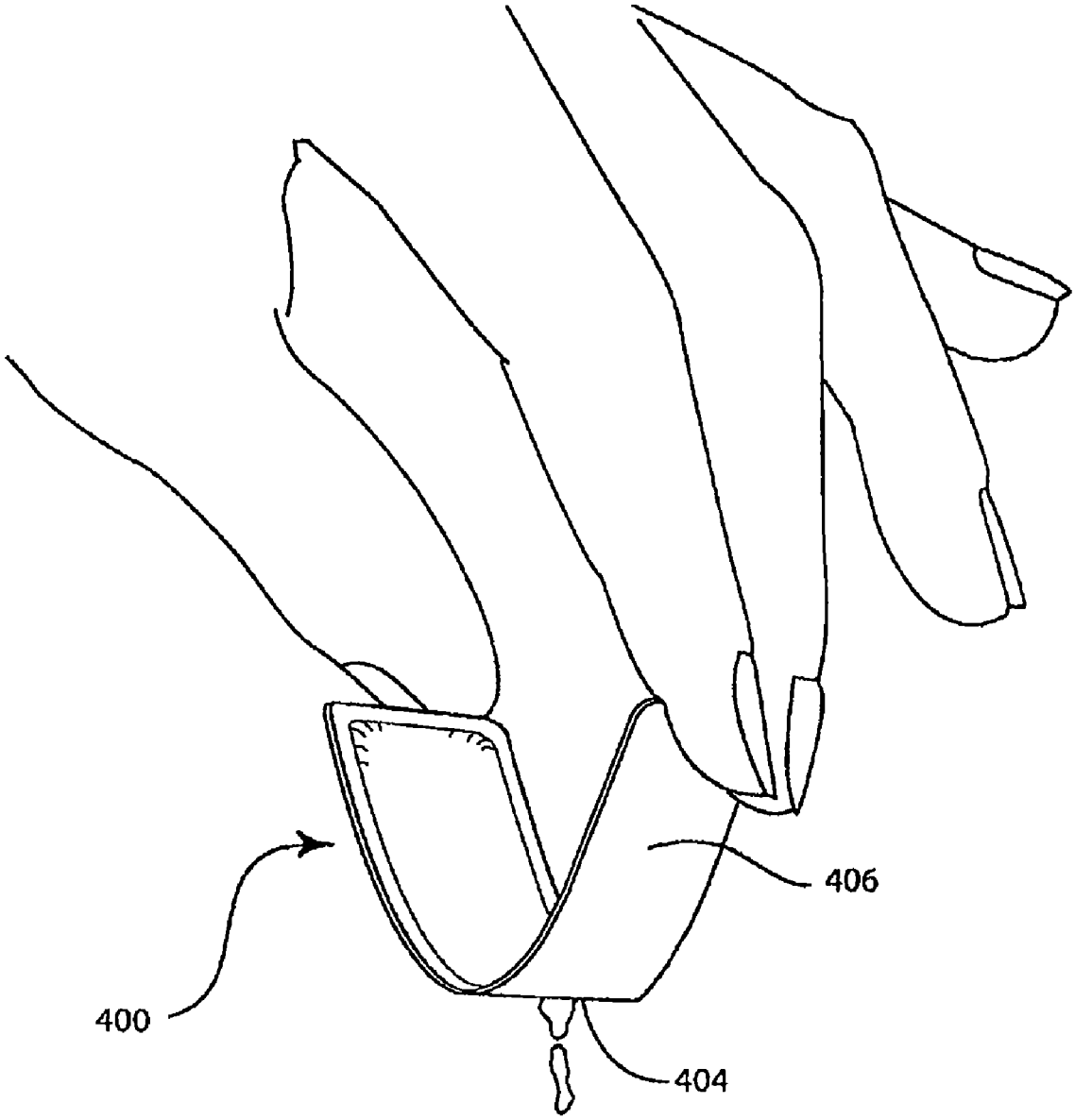
FIG. 4E is a perspective view illustrating controlled dispensing of fluid from an alternative embodiment of the present invention.

FIG. 4E is a perspective view of an alternate embodiment of a dispensing package 400. As shown in FIG. 4E, a partial slit 404 is formed in plastic backing 406. This provides a more robust dispensing package 400 since plastic backing 406 does not break along the entire width of dispensing package 100. Hence, dispensing package 400 is more difficult to "snap" and rather bends in a U shape fashion. The user can better control the speed and volume for dispensing of the contents and it prevents accidental dispensing when package 400 is stored in luggage, purses, wallets, etc. Alternatively, the more robust dispensing package 400 is ideal for shipping because unwanted leakage is minimized.

Figure 4F:
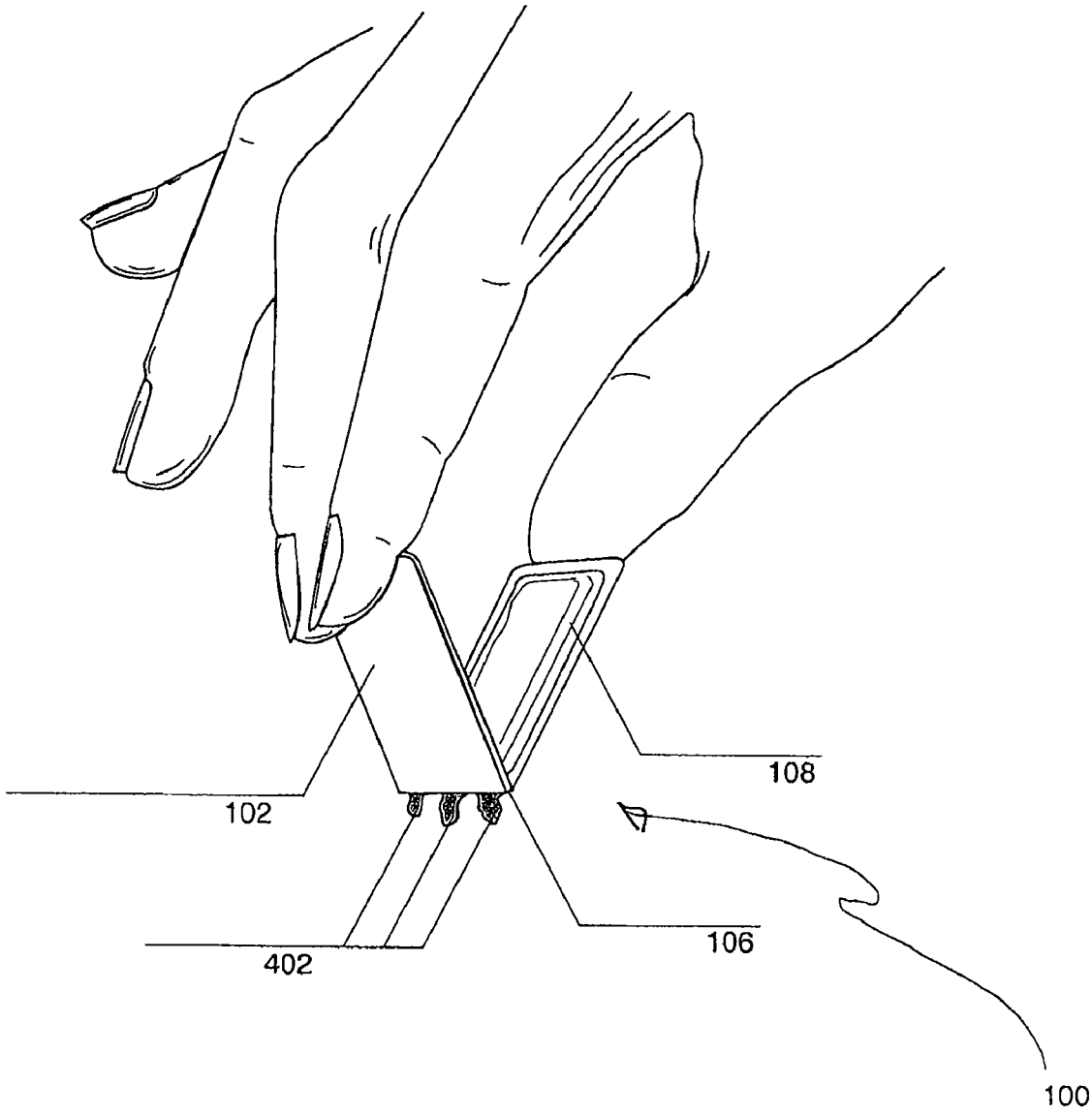
FIG. 4F is a perspective view illustrating controlled dispensing of fluid from an alternative embodiment of the present invention.
Figure 46:
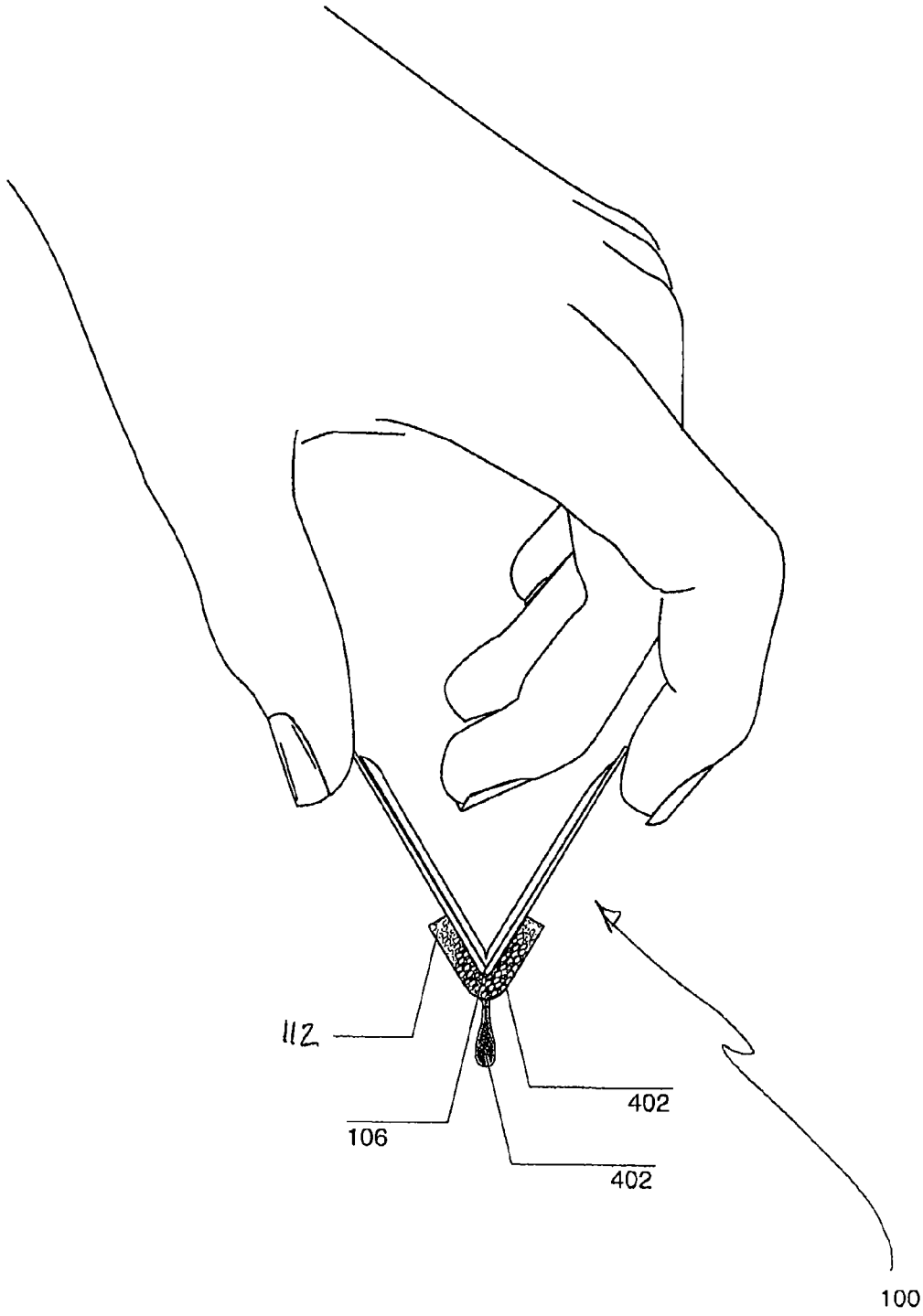

FIG. 4F is perspective view illustrating the manner in which an alternate embodiment of dispensing package 100 is opened. In this embodiment, metered openings 106 extend across the plastic backing 102. More than one metered opening is desirable depending on the contents of the pouch and the application. With contents such as lotions and gels several metered openings ensure that the contents are not expressed from the package in one blob through a center opening. A layer of pouch 108 adjacent plastic backing 102 is partially scored across the width of pouch 108. FIG. 4F depicts three scores in pouch 108 such that contents 402 is dispensed via three openings. Those skilled in the art can appreciate that pouch 108 can be scored more or less than three times and the scores can be provided in various configurations depending on the contents of dispensing package 100 in order to provide controlled dispensing and application of contents 402.

FIG. 4G is another perspective view illustrating the manner in which dispensing package 100 is opened. FIG. 4G illustrates the embodiment of FIG. 3B in which score 106 extends across the entire width of plastic backing 102 and continuous piece of absorbent material 112 is positioned over score 106. As shown in FIG. 4G, pouch 108 dispenses contents 402 along the center portion of score 106 and into absorbent material 112. Holding the two ends of plastic backing 102, a user can apply contents 402 of dispensing package 100 in a controlled manner as shown in FIG. 4I. For example, applications for this embodiment include but are not limited to applying a paint sample to a wall, applying a sterilizer to a surface, applying a lotion or cosmetic, cleaning a surface, and the like.

Figure 4H:
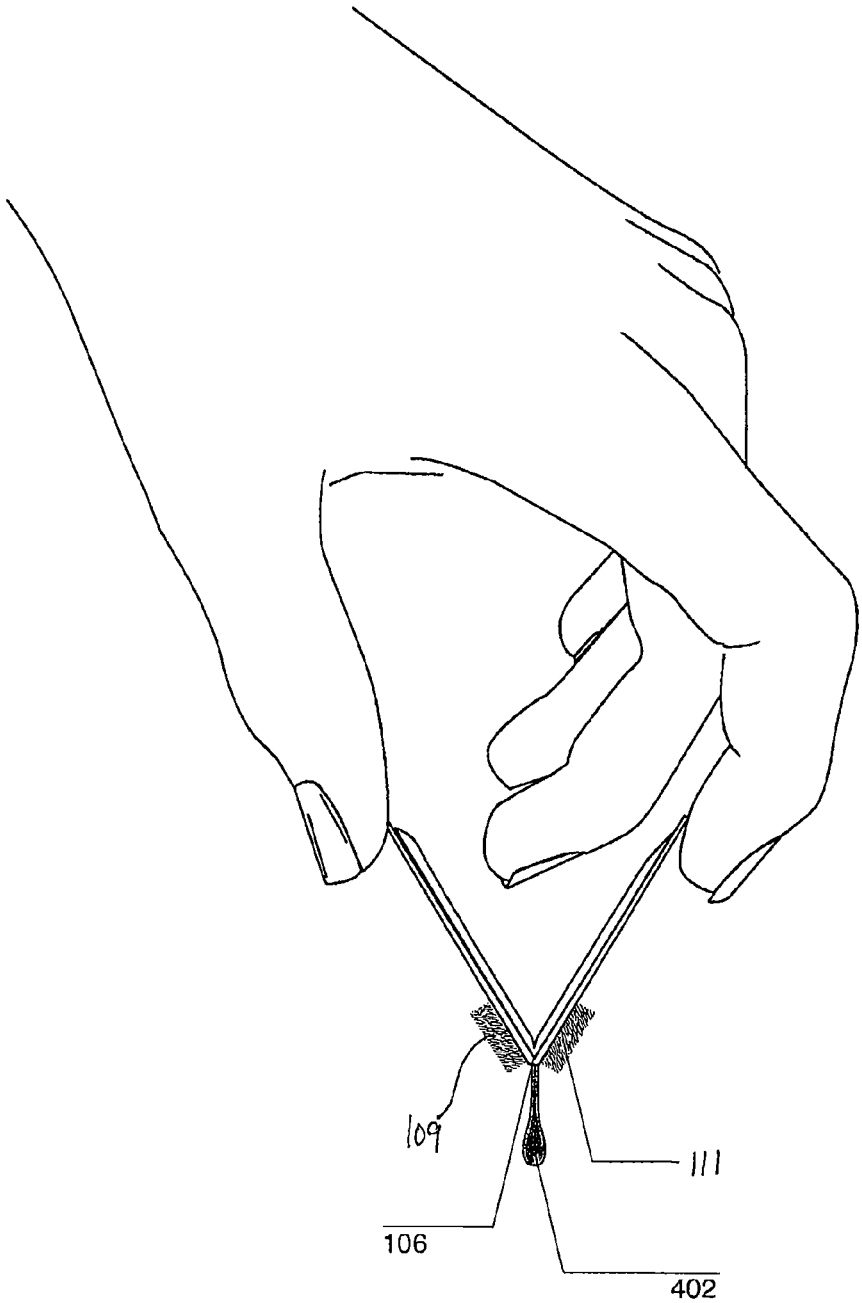
FIG. 4H is a side view illustrating controlled dispensing of fluid from an alternative embodiment of the present invention.
Figure 4I:
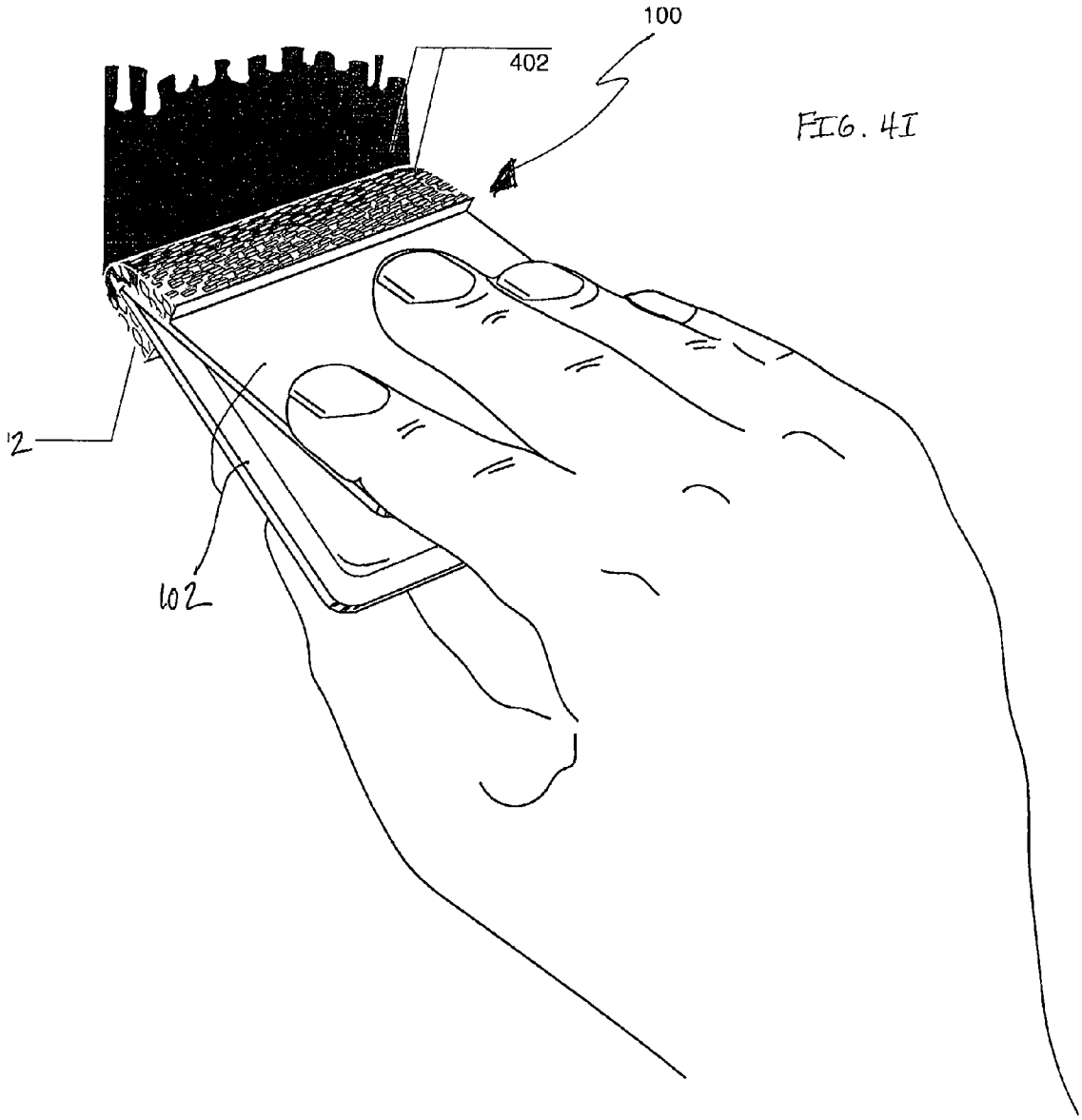
FIG. 4I is a perspective view illustrating controlled dispensing and application of fluid from the dispensing package of FIG. 4G.
Figure 4J:
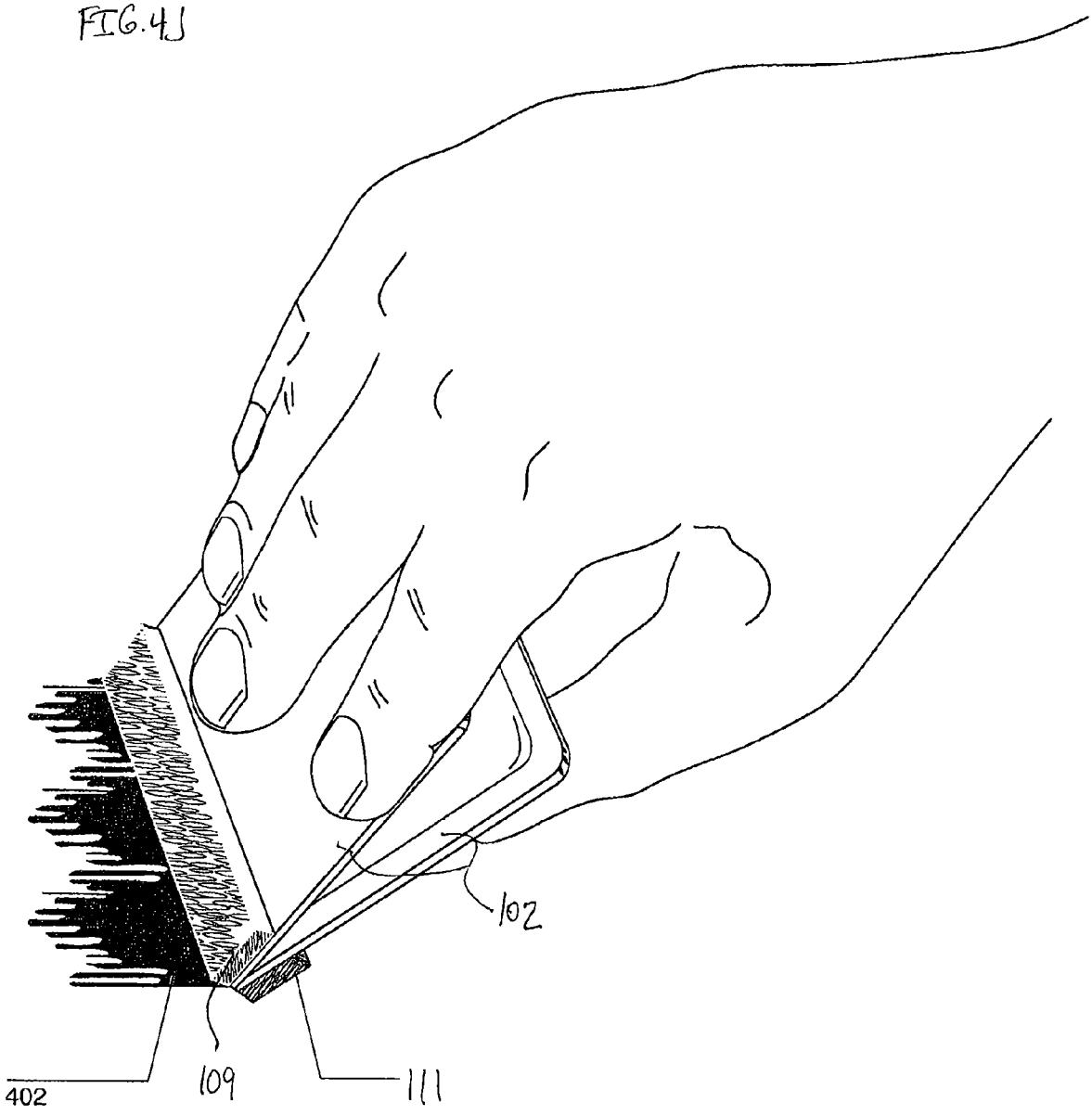
FIG. 4J is a perspective view illustrating controlled dispensing and application of fluid from the dispensing package of FIG. 4H.

FIG. 4H is a perspective view illustrating the manner in which an alternate embodiment of dispensing package 100 is opened. FIG. 4H illustrates the embodiment of FIG. 3A in which score 106 extends across the entire width of plastic backing 102 and two pieces of absorbent material 109, 111 are laterally positioned along the two sides of score 106. As shown in FIG. 4H, pouch 108 dispenses contents 402 along the center portion of score 106. Two pieces of absorbent material 109, 111 can then be used to apply contents 402 in a controlled manner. Holding the two ends of plastic backing 102, a user can then apply contents 402 in a controlled manner as shown in FIG. 4J. For example, applications for this embodiment include, but are not limited to, applying a paint sample to a wall, applying a sterilizer to a surface, applying a lotion or cosmetic, cleaning a surface, and the like.

Figure 4K:
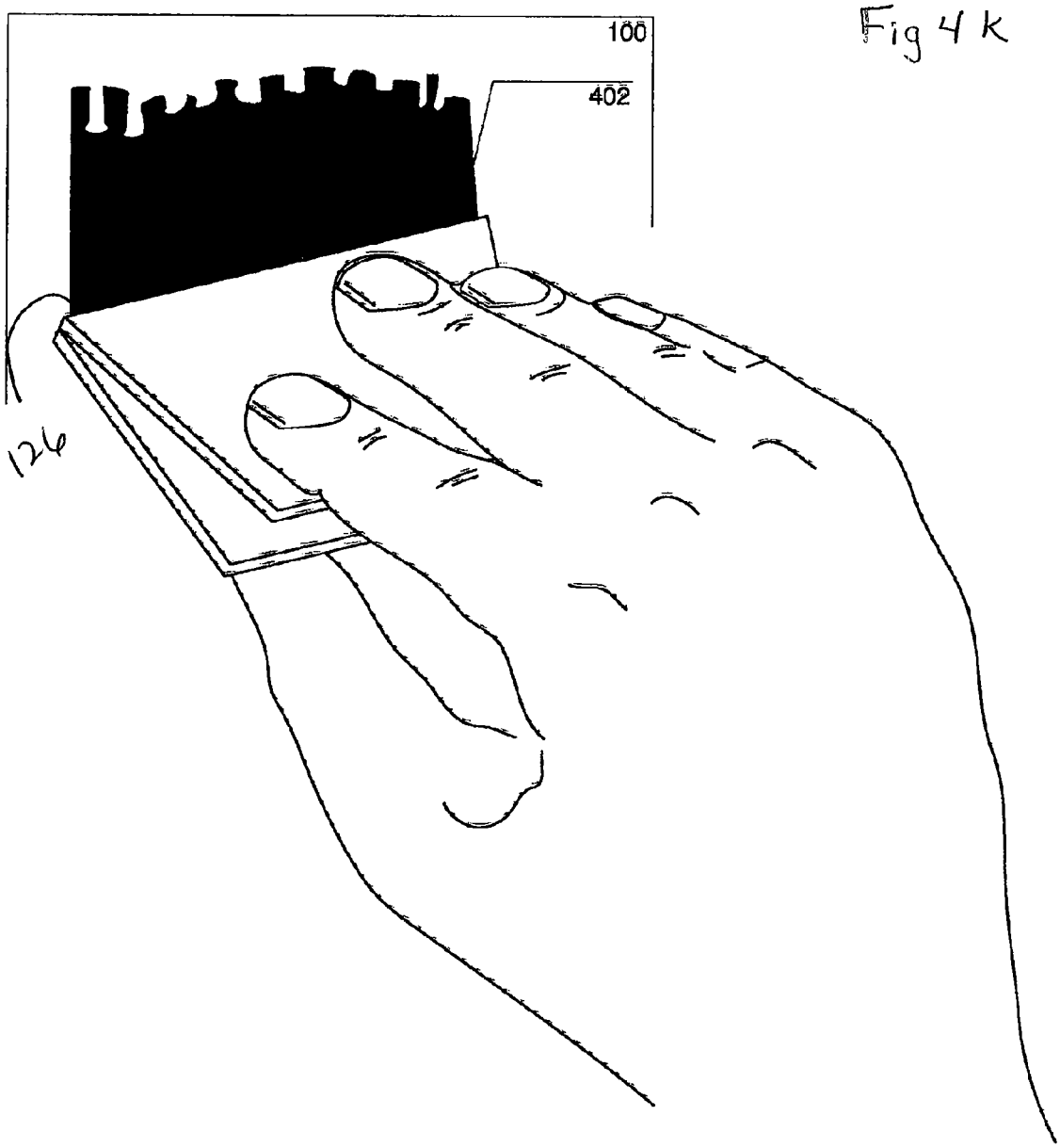
FIG. 4K is a perspective view illustrating controlled dispensing and application of fluid from an alternate embodiment of the invention.

FIG. 4K is a perspective view illustrating the manner in which an alternate embodiment of dispensing package 100 is opened and used. This embodiment is particularly advantageous when dispensing contents 402 with high viscosities, for example spackling, toothpaste, peanut butter, and the like. When contents 402 are dispensed, edge 106 is used as the applicator to spread contents on a wall.

Figure 5A:
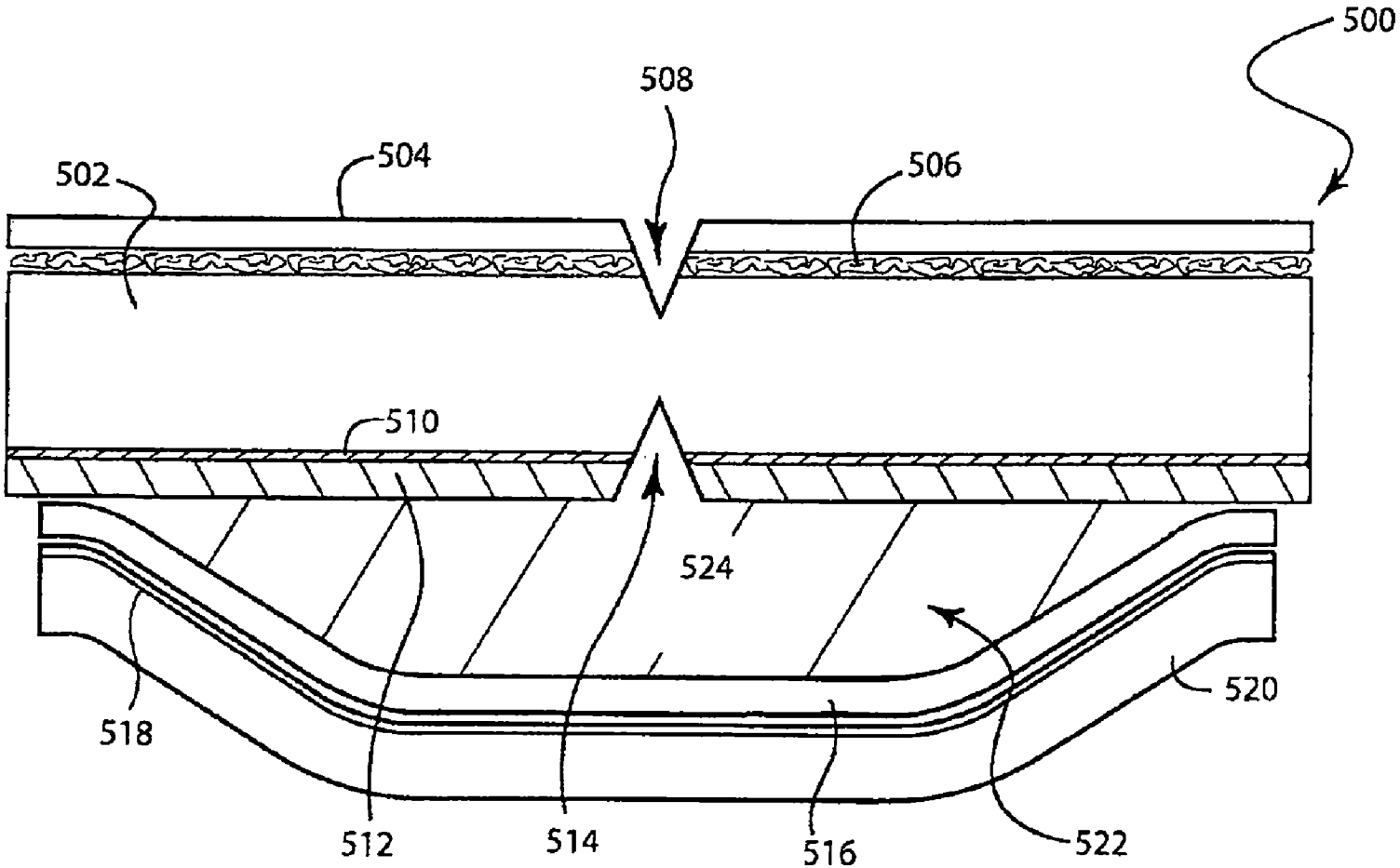
FIG. 5A is a cutaway side view of an alternate embodiment of the invention.

FIG. 5A is a cutaway view of one embodiment of a dispensing package 500. As shown in FIG. 5A, dispensing package 500 includes a plastic backing 502. Plastic backing 502 may be made of polystyrene or other plastic materials including various polymers. Plastic backing 502 provides structural rigidity for dispensing package 500. As such, it has a shear modulus that is sufficient to hold dispensing package 500 in a substantially flat orientation. In one embodiment, plastic backing 502 has a thickness of about 16 mm. Placed on the top (exterior) portion of plastic backing 502 is a label 504. Label is attached to plastic backing 502 with an adhesive layer 506. Adhesive layer 506 may be a pressure sensitive adhesive or any desired type of adhesive. Label 504 can be any desired type of label and can provide advertising and other information relating to contents 524 of dispensing package 500. A score 508 is made through label 504, adhesive 506 and extends into plastic backing 502. In one embodiment, label 504 is about 2.3 mm in depth and adhesive 506 is about 1.5 mm in depth. Score 508 extends about 4 mm into plastic backing 502 so that the total depth of score 508 is about 7.8 mm. Of course, these dimensions are exemplary only, and plastic backing 502, label 504, adhesive 506 and score 508 can be modified depending on customer preference, material being dispensed and the use application of dispensing package 500. On the bottom side (interior side) of plastic backing 502 are two co-extruded layers. The first co-extruded layer is a barrier layer 510 that has a high elastic limit (i.e., is very flexible). Barrier layer 510 may be an EVOH (ethanol vinyl alcohol) layer that can have a depth of about 0.5 mm. The outer co-extruded layer is a sealant layer 512 that is applied over barrier layer 510. Sealant layer 512 also provides structural features and has a very high elastic limit in the same manner as barrier layer 510. The elastic limit of barrier layer 510 and sealant layer 512 is substantially higher than the elastic limit of plastic backing 502. In this fashion, barrier layer 510 and sealant layer 512 do not break when plastic backing 502 is broken as a result of flexure of dispensing package 500. Sealant layer 512 may comprise a linear low density polyethylene (LLDPE) coating that can be about 2.5 mm thick. Sealant layer 512 functions as both a structural layer and a containment film for containing contents 524. Sealant layer 512 can also act as a FDA layer that prevents contamination of contents 524 from the surrounding materials. A metered slit 514 is formed in the bottom (interior) side of plastic backing 502. Metered slit 514 may extend, in one embodiment, about 4 mils into plastic backing 502. Hence, the total depth of metered slit 514 is about 7 mils. By scoring both sides of plastic backing 502, plastic backing 502 will break along the aligned portions of metered slits 508, 514. In addition, plastic backing 502, as well as label 504 and adhesive 506, will break along the length of score 508. However, barrier layer 510 and sealant layer 512 have a substantially higher elastic limit so that barrier layer 510 and sealant layer 512 remain intact in the portions that are not metered, even though plastic backing 502 is broken by score 508. In this fashion, metered slit 514 can function as a metering hole for controlling the location and size of the opening in which contents 524 of dispensing package 500 are dispensed.

FIG. 5A also depicts an inner sealant layer 516 that may also comprise a linear low density polyethylene having a thickness of about 2.5 mm. Inner sealant layer 516, in a manner similar to sealant layer 512, functions as both a structural layer and a containment film for contents 524. Inner sealant layer 516 is heat sealed to sealant layer 512 at the sides and ends of the pouch 522. Disposed over inner sealant layer 516 is an outer pouch layer 520 that may comprise a PET material of about 3.0 mm. Outer pouch layer 520 has a barrier layer 518 that may comprise an EVOH layer of about 0.5 mm. Barrier layer 518 provides additional structural integrity to pouch 522. Both barrier layer 518 and inner sealant layer 516 may be a co-extruded layer on outer pouch layer 520. Again, the entire structure of outer pouch layer 520, barrier layer 518, and inner sealant layer 516 is heat sealed to sealant layer 512 to create pouch 522 in the manner hereinafter described. Those skilled in the art will appreciate, however, that any method of sealing could be used including adhesive means, ultrasonic means, and other such methods.

Figure 5B:
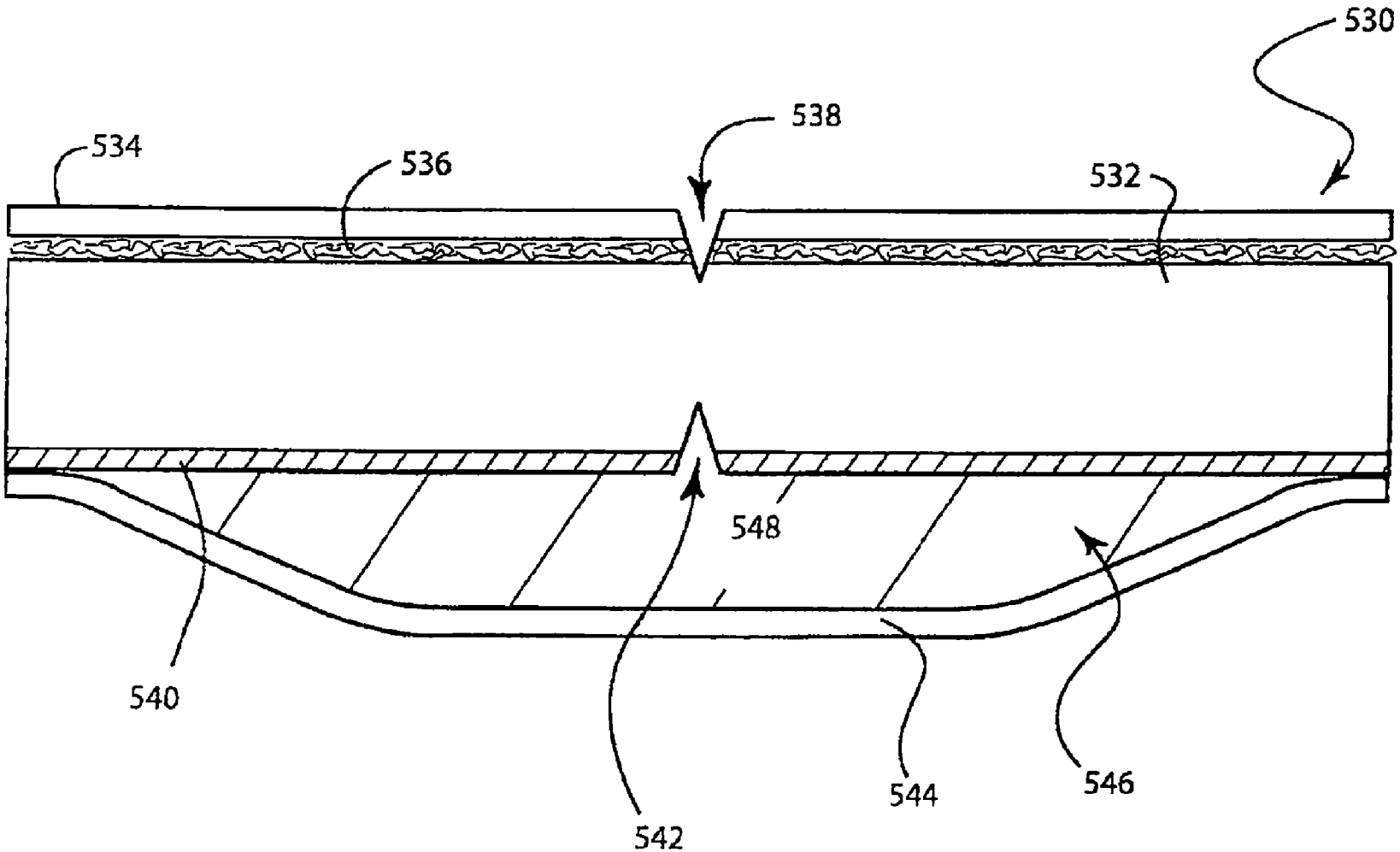
FIG. 5B is a cutaway side view of an alternate embodiment of the invention.

FIG. 5B is a cutaway view of an alternate embodiment of a dispensing package 530 in accordance with the present invention. As shown in FIG. 5B, dispensing package 530 has a plastic backing 532 similar to the plastic backing disclosed with respect to the description of FIG. 5A. In addition, a label 534 is applied to the outer surface of plastic backing 532 with an adhesive 536, in manner similar to the description with respect to FIG. 5A. A score 538 is formed through label 534, adhesive 536 and extends into plastic backing 532 a predetermined distance. For example, score 538 can extend into plastic backing 532 by about 4 mm, in accordance with one embodiment of the invention. Of course, score 538 can extend any distance desired into plastic backing 532, so long as a fracture is caused in plastic backing 532 as a result of flexure of dispensing package 530. In other words, score 538 must be sufficiently deep to create a fracture in plastic backing 532 along the length of score 538, which is dependent upon the depth of score 538, the elastic modulus of plastic backing 532 and the elastic limit of plastic backing 532.

As also shown in FIG. 5B, the backside (interior side) of plastic backing 532 includes a sealant layer 540. Sealant layer 540 has a much higher elastic limit (is more flexible) than plastic backing 532 and provides structural support for dispensing package 530 along the areas in which score 538 fractures plastic backing 532, and score 542 is not present. In other words, sealant layer 540 holds dispensing package 530 together even if score 538 extends across the entire width of dispensing package 530. Further, sealant layer 540 causes metered slit 542 to function as a metering hole for dispensing contents of 548 of dispensing package 530 since sealant layer 540 does not break and only provides an opening along the length of metered slit 542. Sealant layer 540 can also function as a containment layer for containing contents 548 and preventing contamination of contents 548 as a result of leaching of plasticizers or other undesirable agents from plastic backing 532. Sealant layer 540 may also function as a containment layer for containing contents 548 without leakage or dispersal of contents 548. Sealant layer 540 can comprise any desired material including adhesives, polymers or other materials capable of performing the specified functions. Pouch layer 544 also provides a structural and containment layer that forms pouch 546 for containing contents 548. Pouch layer 544 may be heat sealed to sealant/structural layer 540. Pouch layer 544 may include an extruded structural layer, but in general, comprises a flexible material that is capable of containing contents 548 without being easily penetrated or ruptured and without contaminating contents 548.

Figure 5C:
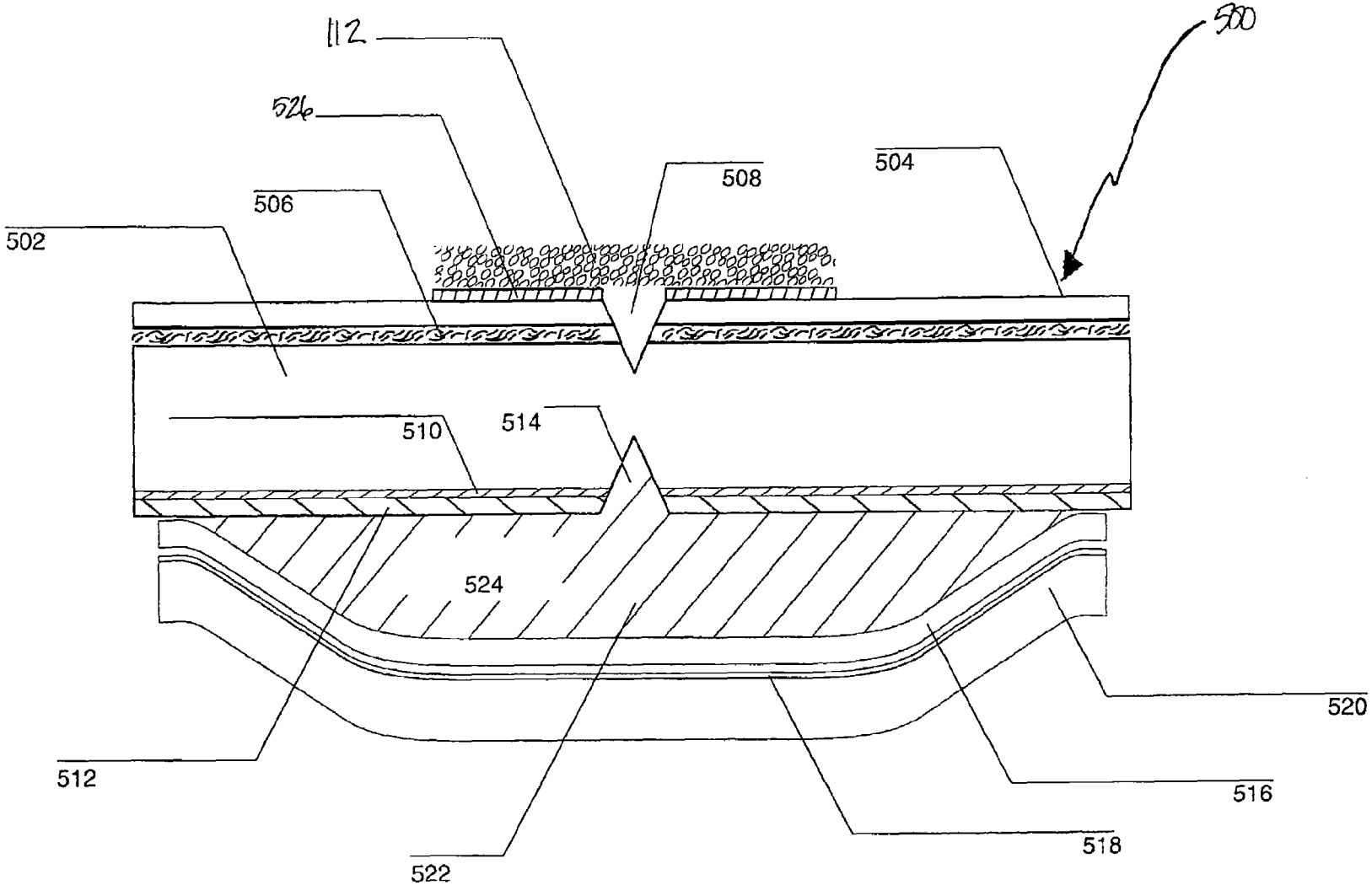
FIG. 5C is a cutaway side view of the dispensing package of FIG. 3B.
Figure 9D:
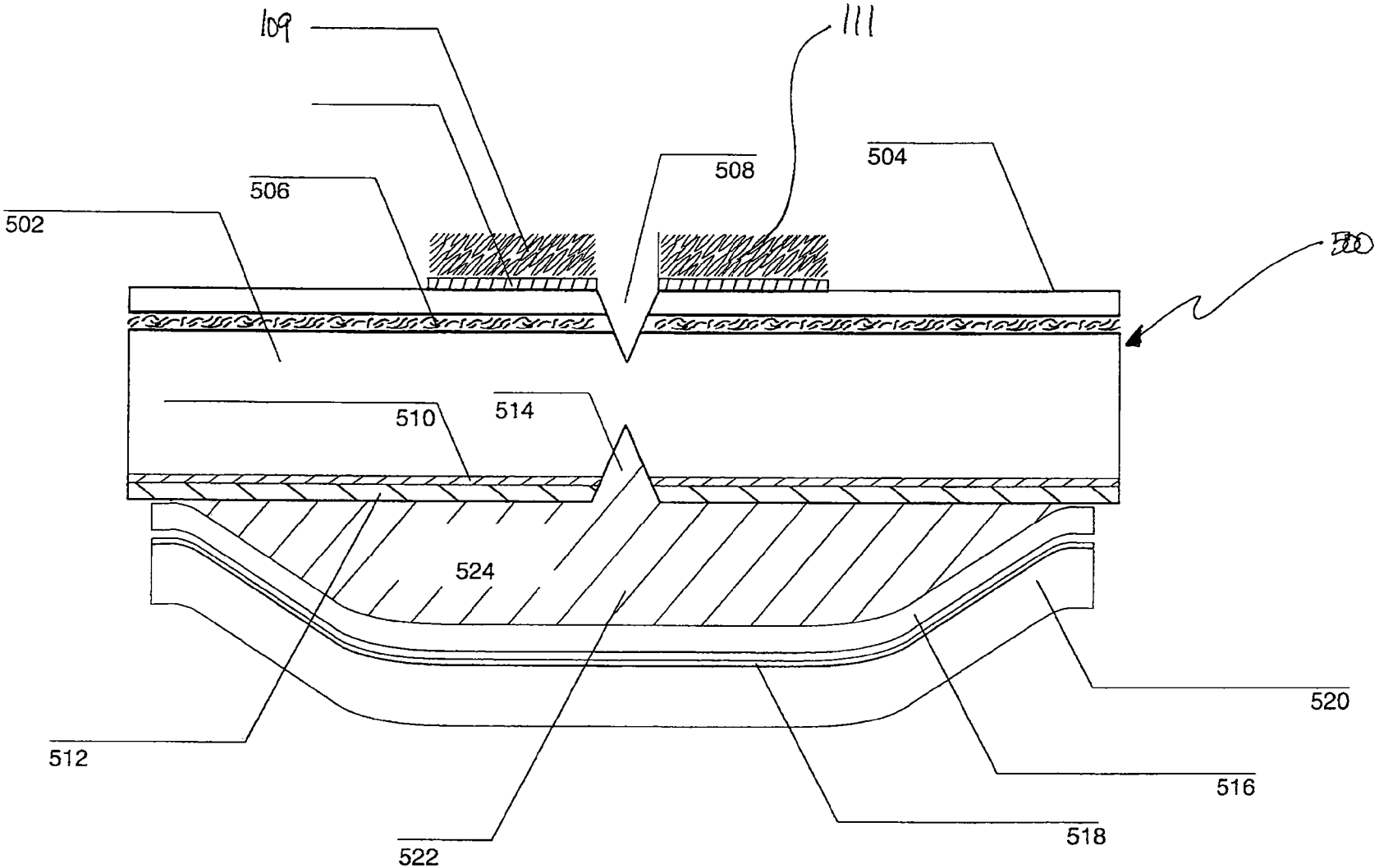
FIG. 9 is a close-up perspective view of the embodiment of FIG. 8.

FIG. 5C is a cutaway view of an alternate embodiment of dispensing package 500. As shown in FIG. 5C, dispensing package 500 is similar to the dispensing package disclosed with respect to the description of FIG. 5A. In addition, FIG. 5C depicts continuous piece of absorbent or non-absorbent material 112 placed over score 508 with an adhesive 526 as disclosed in FIGS. 3B, 4G and 4I. If absorbent, material 112 can be made of foam, sponge, flock, and the like. It will be appreciated that non-absorbent materials may also be used such as sandpaper and scrubber depending on the end use. Material 112 is sized, placed and optionally scored based on contents 524 in dispensing package 500 in order to provide controlled dispensing and application of contents 524.

FIG. 5D is a cutaway view of an alternate embodiment of dispensing package 500. As shown in FIG. 5D, dispensing package 500 is similar to the dispensing package disclosed with respect to the description of FIG. 5A. FIG. 5D also depicts first and second pieces of absorbent or non-absorbent material 109 and 111 placed on each side of score 508 as disclosed in FIGS. 3A, 4H and 4J. First and second pieces of absorbent or non-absorbent material 109, 111 are sized and positioned based on contents 524 in dispensing package 500 in order to provide controlled dispensing and application of contents 524.

Figure 5E:
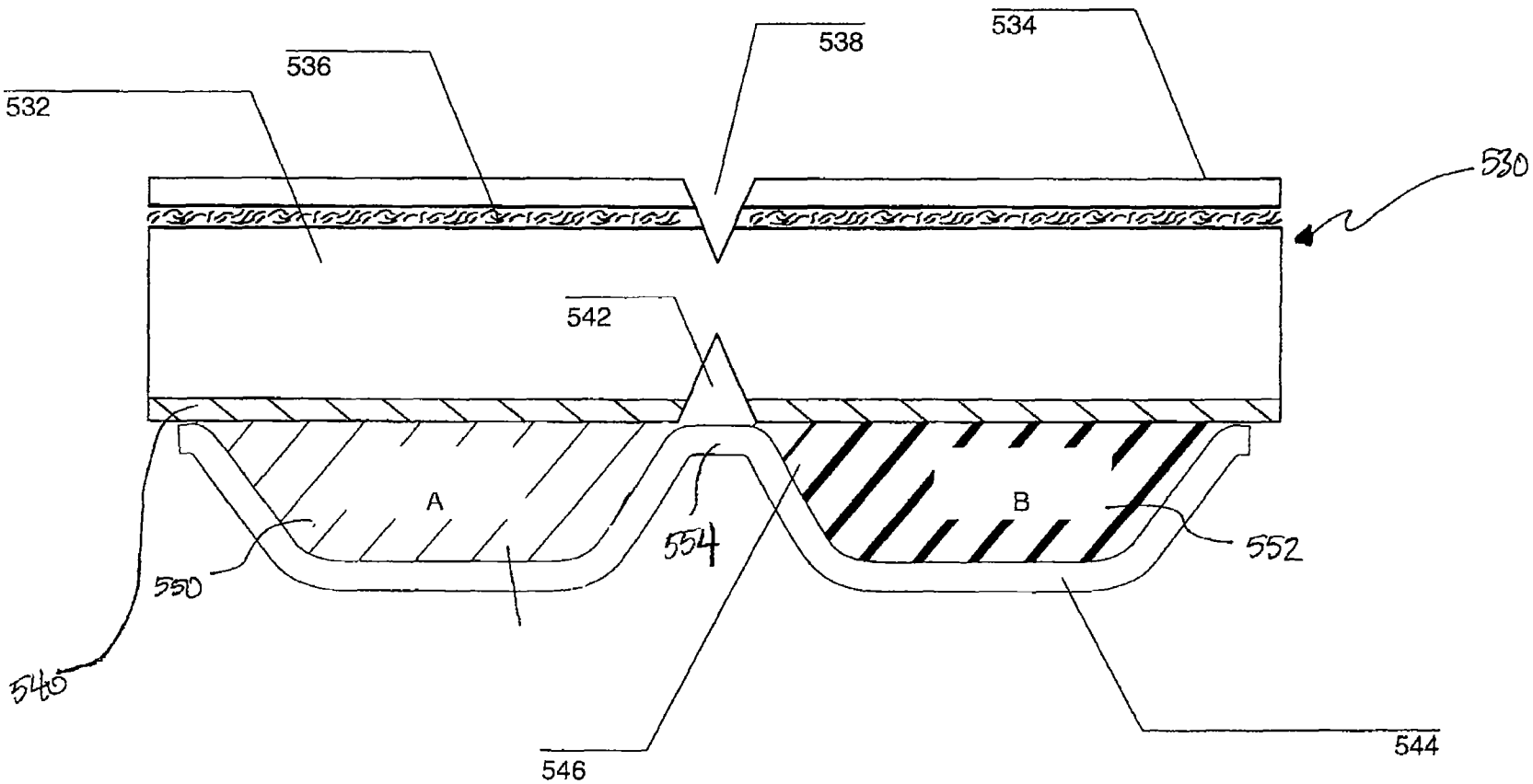
FIG. 5E is a cutaway side view of an alternate embodiment of the invention.

FIG. 5E is a cutaway perspective of an alternate embodiment of dispensing package 530. As shown in FIG. 5E, dispensing package 530 is similar to the dispensing package disclosed in FIG. 5B. FIG. 5E shows dispensing package 530 configured to dispense two materials, a first contents 550 and a second contents 552. This embodiment is advantageous for dispensing two materials simultaneously where the materials exhibit favorable characteristics when mixed as they are dispensed. Examples of such materials include, but are not limited to, food products, epoxies, resins, foaming elastomers, cleaning solutions, and the like. FIG. 5E depicts pouch layer 544 having two pouches 546, 547 with a separating portion 554 therebetween. Separating portion 554 is provided to maintain contents 550, 552 in separate pouches 546, 547. Separating portion 554 is aligned with metered slit 542 such that when the two ends of plastic backing 532 are forced toward one another, metered slit 542 will cause both pouches 546, 547 to rupture thereby allowing contents 550, 552 to be mixed and dispensed. Those skilled in the art will appreciate that dispensing package 530 in accordance with the present invention may have more than two pouches that are sized and positioned depending on the contents being dispensed. In addition, there may be more than one metered slit that is either aligned with or staggered from the pouches depending on the contents being dispensed.

Figure 5F:
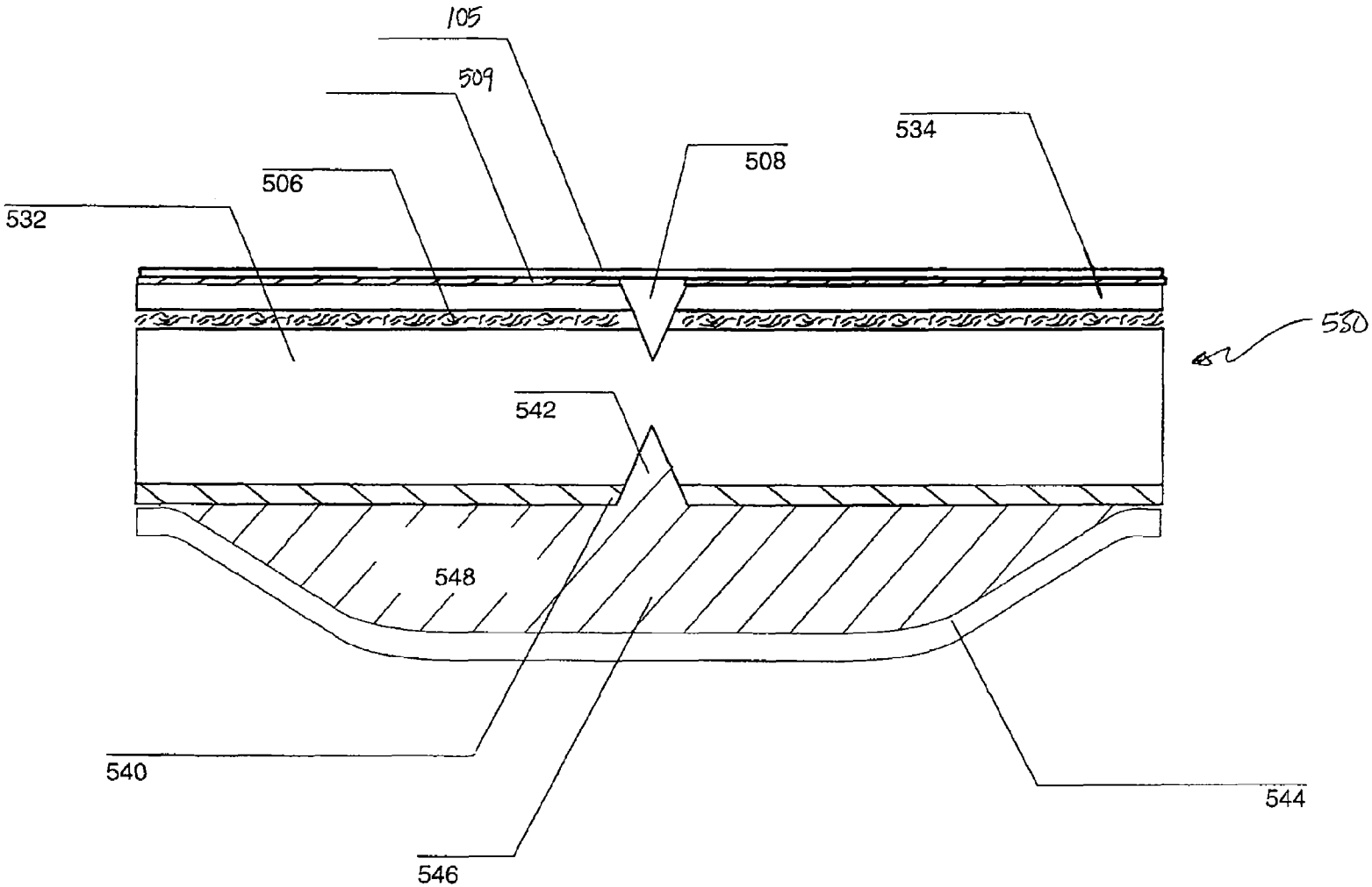
FIG. 5F is a cutaway side view of an alternate embodiment of the invention.

FIG. 5F is a cutaway perspective of an alternate embodiment in accordance with the present invention. Dispensing package 530 shown in FIG. 5F is similar to the dispensing package disclosed in FIG. 5B with the addition of film 105 as depicted in FIG. 1A. Film 105 is attached to the top of label 534 with an adhesive 509. Adhesive 509 is selected from the group including pressure sensitive adhesives, heat curing adhesives or any other desired type of adhesives. This type of packaging would be ideal when child-resistant packing is desired, or when evidence or tampering is desired, to provide additional print or billboard space or as a safety feature so that the contents will not predispense when stored in wallets, purses, luggage, etc.

Figure 6:
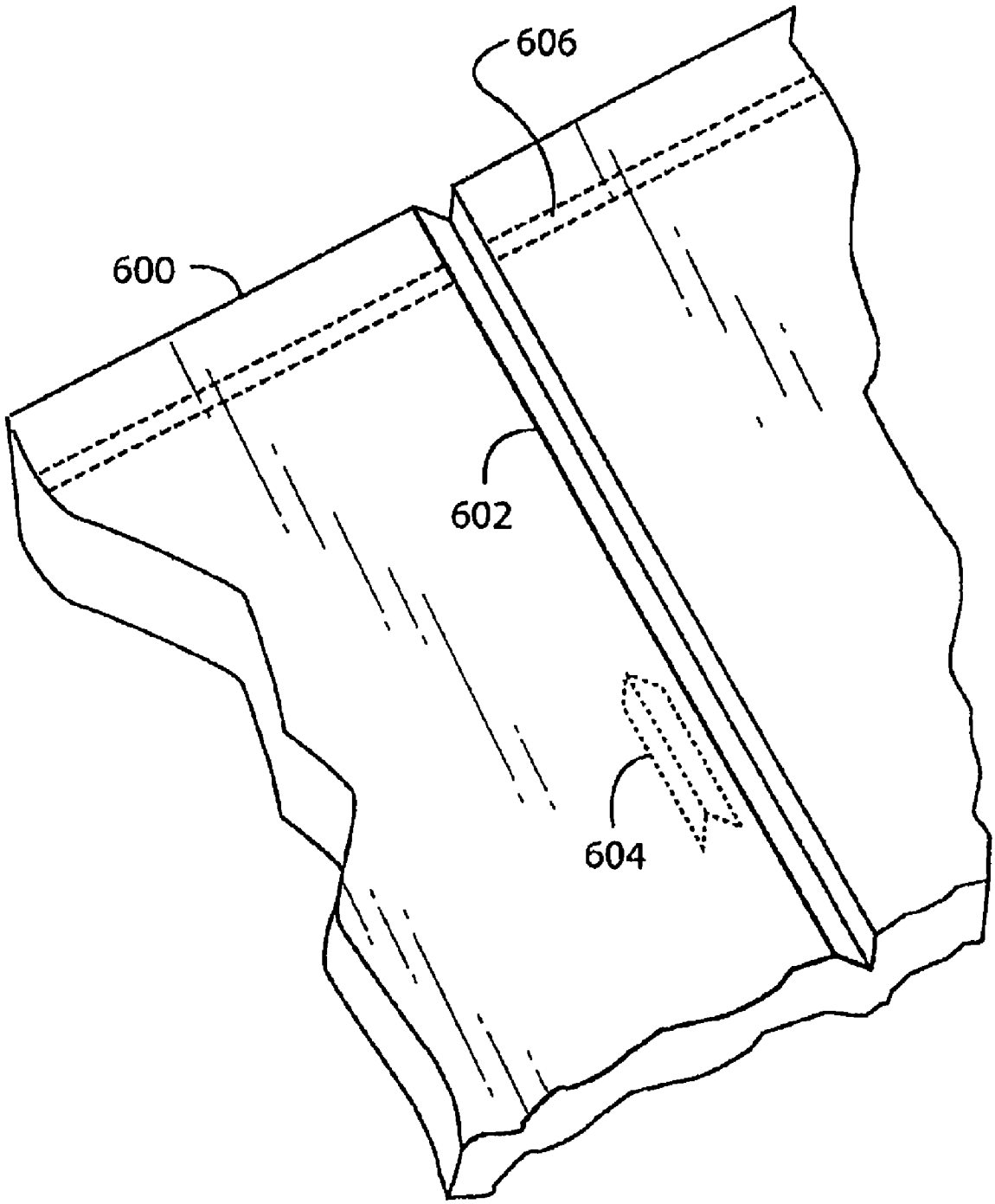
FIG. 6 is a close-up perspective view of an alternate embodiment of the invention.

FIG. 6 is a partial perspective view of one embodiment in accordance with the present invention. As shown in FIG. 6, a plastic backing 600 has a score 602 that extends across the width of the package. Metered slit 604 is formed on the opposite side of plastic backing 600 and is vertically aligned with score 602, as illustrated in FIGS. 5A and 5B. As can be seen from FIG. 6, metered slit 604 has a substantially shorter length than score 602, which extends across the entire width of the package illustrated in FIG. 6. As also shown in FIG. 6, pouch 606 is heat sealed to the underside of plastic backing 600. Metered slit 604 provides for controlled flow of the contents through a smaller opening than score 602.

Figure 7:
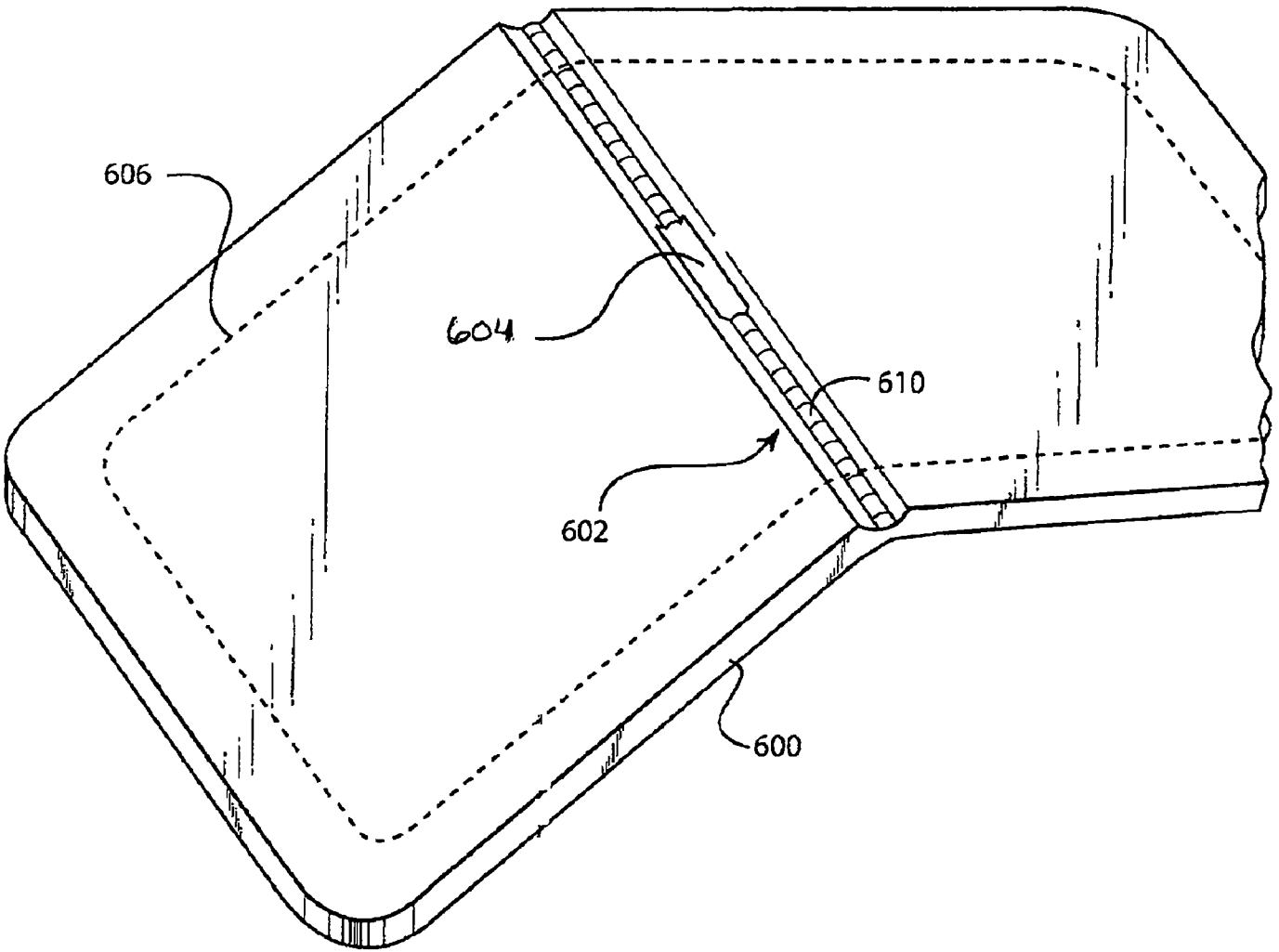
FIG. 7 is a perspective view of the embodiment of FIG. 6 showing an opened dispensing package.

FIG. 7 is a perspective view of the embodiment of FIG. 6 which has been flexed to an open position. As shown in FIG. 7, plastic backing 600 has been flexed so that score 602 causes plastic backing 600 to break along the length of score 602. Metered slit 604 is aligned with score 602 and allows the contents to dispense when plastic backing 600 is broken along score 602. Barrier layer 610, which includes metered slit 604, has a much higher elastic limit than plastic backing 600, the sides of which remain intact when plastic backing 600 is broken along score 602, i.e. with the exception of metered slit 604. In this manner, the contents of the package which are contained in pouch 606 are only dispensed through metered slit 608 which is formed through barrier layer 610. Hence, score 602 can be formed across the entire width of the dispensing package which allows plastic backing 600 to easily break and quickly dispense the contents, but at the same time only dispense the contents through a smaller metered slit 604 which is formed by score 604.

Figure 7A:
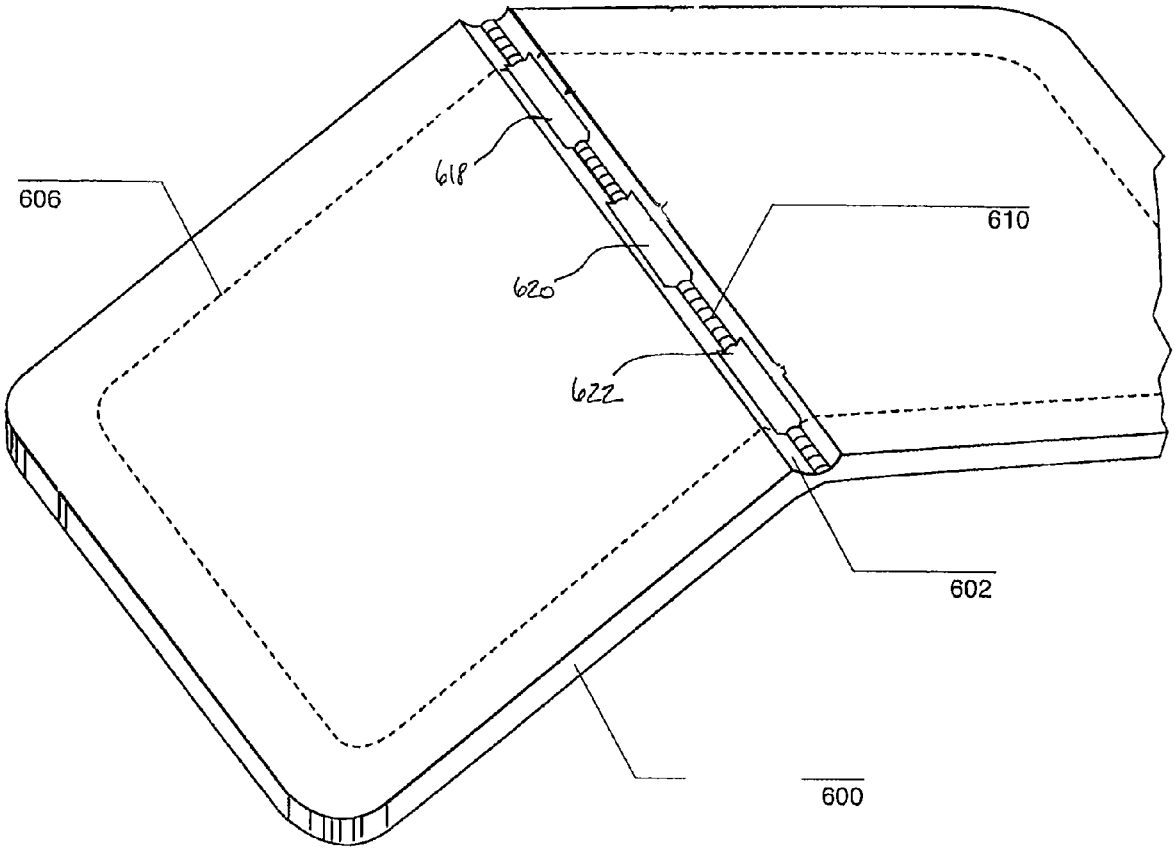
FIG. 7A is a perspective view of the embodiment of FIG. 4F showing an opened dispensing package.

FIG. 7A is a perspective view of the embodiment of FIG. 4F as the dispensing package is being flexed to an open position. As shown in FIG. 7A, plastic backing 600 has been flexed so that score 602 causes plastic backing 600 to break along the length of score 602. Metered slits 618, 620, 622 are aligned with score 602 and create metering holes for dispensing the contents when plastic backing 600 is broken along score 602. Barrier layer 610, which includes metered slit 604, has a much higher elastic limit than plastic backing 600, the sides of which remain intact when plastic backing 600 is broken along score 602, i.e. with the exception of metered slit 604. In this manner, the contents of the package which are contained in pouch 606 are only dispensed through metered slits 618, 620, 622 on the bottom side of plastic backing 600.

Figure 7B:
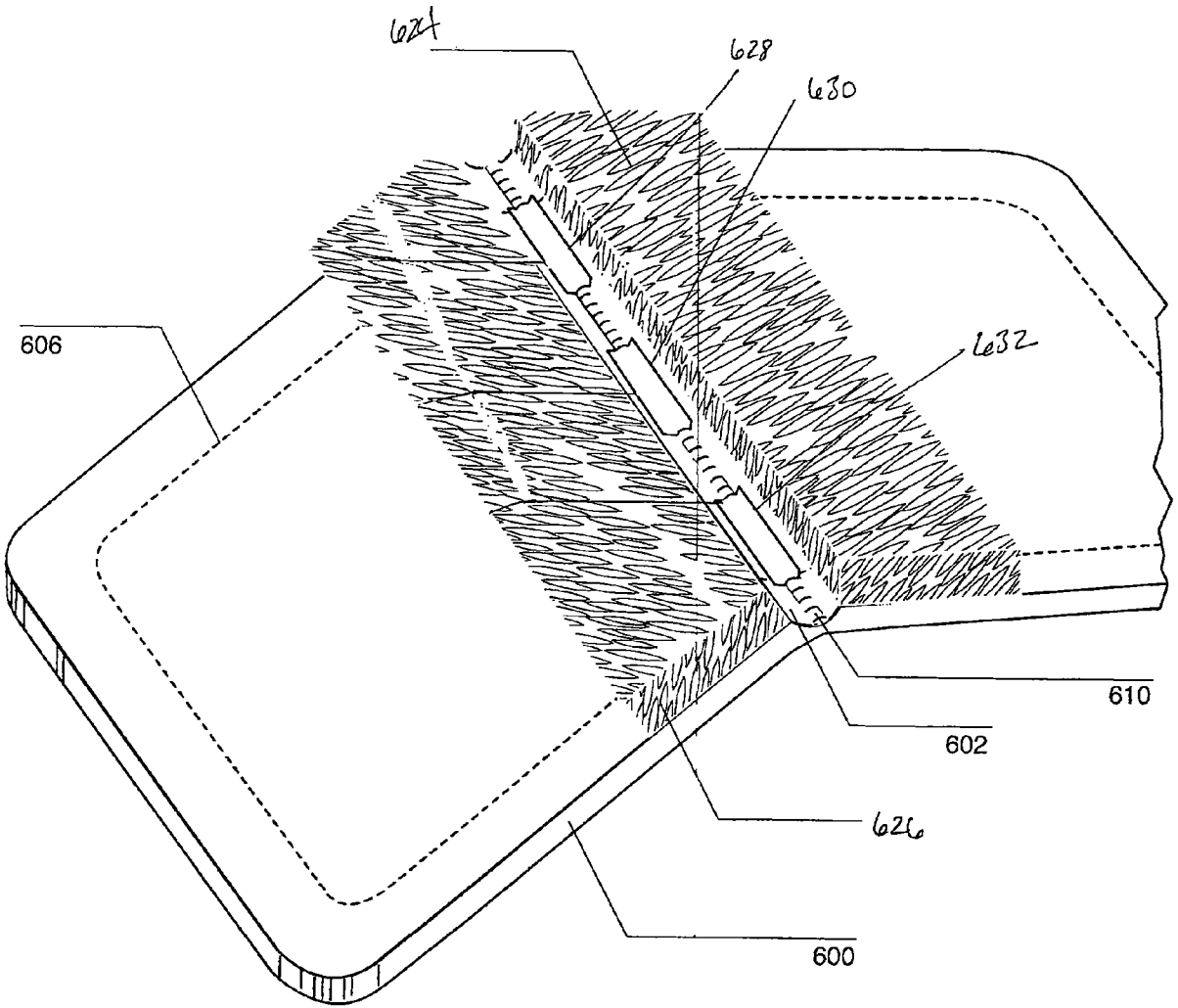
FIG. 7B is a perspective view of the embodiment of FIG. 4H showing an opened dispensing package.

FIG. 7B is a perspective view of the embodiment of FIG. 4H as the dispensing package is being flexed to an open position. As shown in FIG. 7B, plastic backing 600 has been flexed so that score 602 causes plastic backing 600 to break along the length of score 602. Metered slits 628, 630, 632 are aligned with score 602 and dispense the contents when plastic backing 600 is broken along score 602. Material 624, 626 is placed adjacent score 602 Barrier layer 610, which includes metered slit 604, has a much higher elastic limit than plastic backing 600, the sides of which remain intact when plastic backing 600 is broken along score 602, i.e. with the exception of metered slit 604. In this manner, the contents of the package which are contained in pouch 606 are only dispensed through metered slits 628, 630, 632 on the bottom side of plastic backing 600. Hence, score 602 can be formed across the entire width of the dispensing package which allows plastic backing 600 to easily break and quickly dispense the contents, but at the same time only dispense the contents through smaller metered slits 628, 630, 632. Additional control over dispensing the contents is provided by material 624, 626 placed adjacent score 602 such that the contents of the dispensing package can be applied with material 624, 626.

Figure 7C:
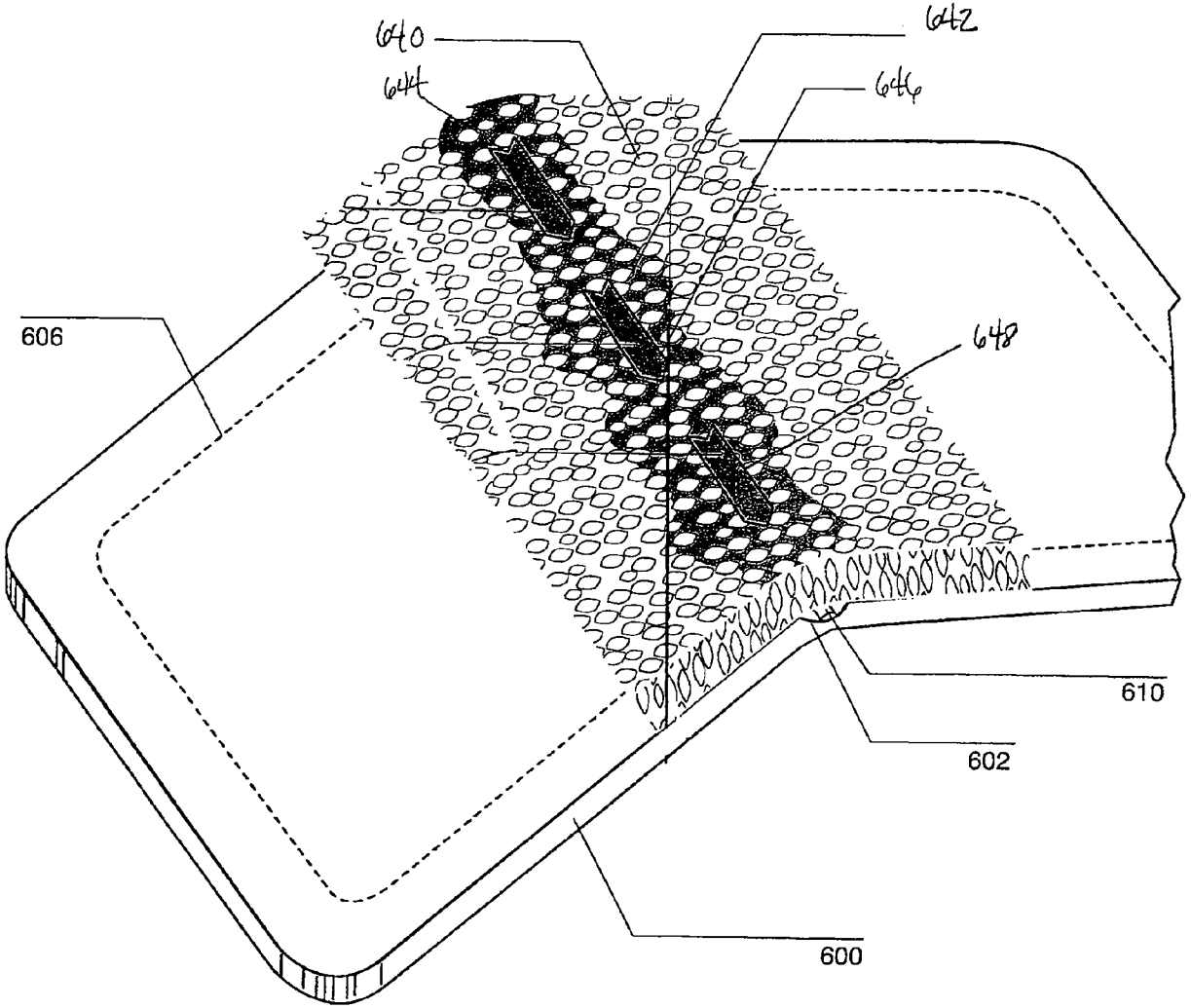
FIG. 7C is a perspective view of the embodiment of FIG. 4G showing an opened dispensing package.

FIG. 7C is a perspective view of the embodiment of FIG. 4G as the dispensing package is being flexed to an open position. As shown in FIG. 7B, plastic backing 600 has been flexed so that score 602 causes plastic backing 600 to break along the length of score 602. Metered slits 644, 646, 648 are aligned with score 602 and dispense contents 642 when plastic backing 600 is broken along score 602. A continuous piece of for example, absorbent material 640 is positioned over score 602 and metered slits 644, 646, 648 and as can be seen absorbs contents 642 as it is expressed from pouch 606. Barrier layer 610, which includes metered slit 604, has a much higher elastic limit than plastic backing 600, the sides of which remain intact when plastic backing 600 is broken along score 602, i.e. with the exception of metered slit 604. In this manner, contents 642 contained in pouch 606 are only dispensed through metered slits 644, 646, 648 on the bottom side of plastic backing 600. Contents 642 are then dispensed directly into absorbent material 640 in order to provide controlled dispensing and application. Hence, score 602 can be formed across the entire width of the dispensing package, or partially depending on the application.

The embodiments of FIGS. 7-7C all depict barrier layer 610 under plastic backing 600, where barrier layer 610 has a higher elastic limit than plastic backing 600. Both barrier layer 610 and plastic backing 600 are selected depending on the contents of the dispensing package in order to minimize MVT while providing easy and controlled dispensing and application of the contents. In one embodiment, plastic backing 600 is constructed of a base material selected from the group including rigid styrene, foil, Barex® (BP Chemicals, Inc., Naperville, Ill., USA), polyethylene, nylon and other co-extruded materials. The base material can then be covered with film, such as printable polystyrene film, polypropylene, polyester, and the like. The film can also be covered with an over laminate, such as polystyrene film, polypropylene, polyester, and the like.

Figure 8:
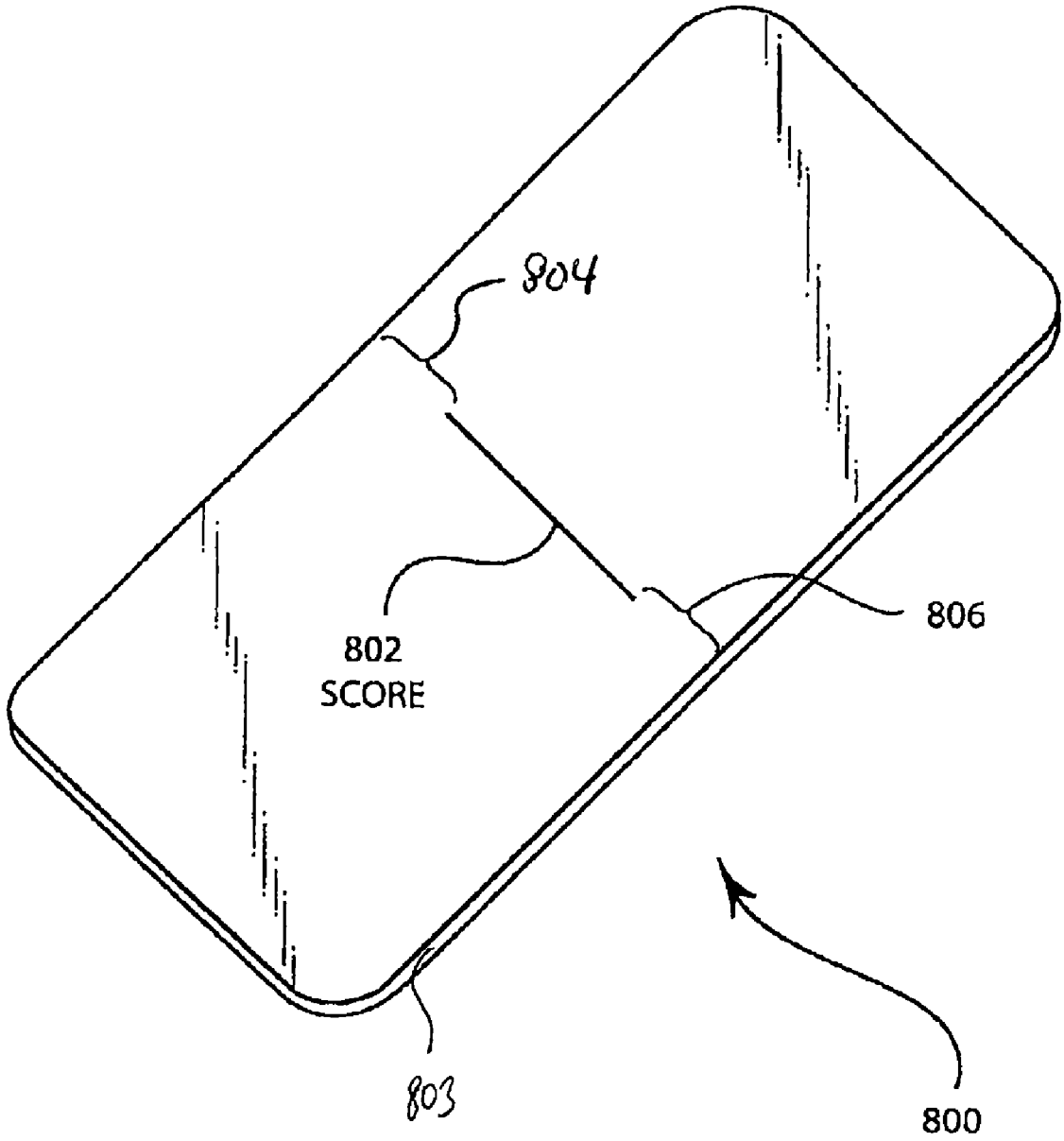
FIG. 8 is a top perspective view of an alternate embodiment of the invention.

FIG. 8 illustrates another embodiment of a dispensing package 800. As shown in FIG. 8, score 802 on the top of dispensing package 800 does not extend across the entire width, but only extends across a middle portion of plastic backing 803 of dispensing package 800. Shoulder portions 804, 806 extend from the end of score 802 to the side of dispensing package 800. Shoulder portions 804, 806 provide additional strength to the overall package and provide stress when plastic backing 803 is flexed. The embodiment shown in FIG. 8 differs from the embodiments shown in FIGS. 6 and 7 in that the dispensing package 800 is not opened as easily in response to a flexing action as the dispensing package 100 illustrated in FIGS. 1 through 3, 6 and 7. As such, the dispensing package 800, illustrated in FIG. 8, is more robust and provides additional control for the dispensing of the material contained therewithin.

Figure 9:
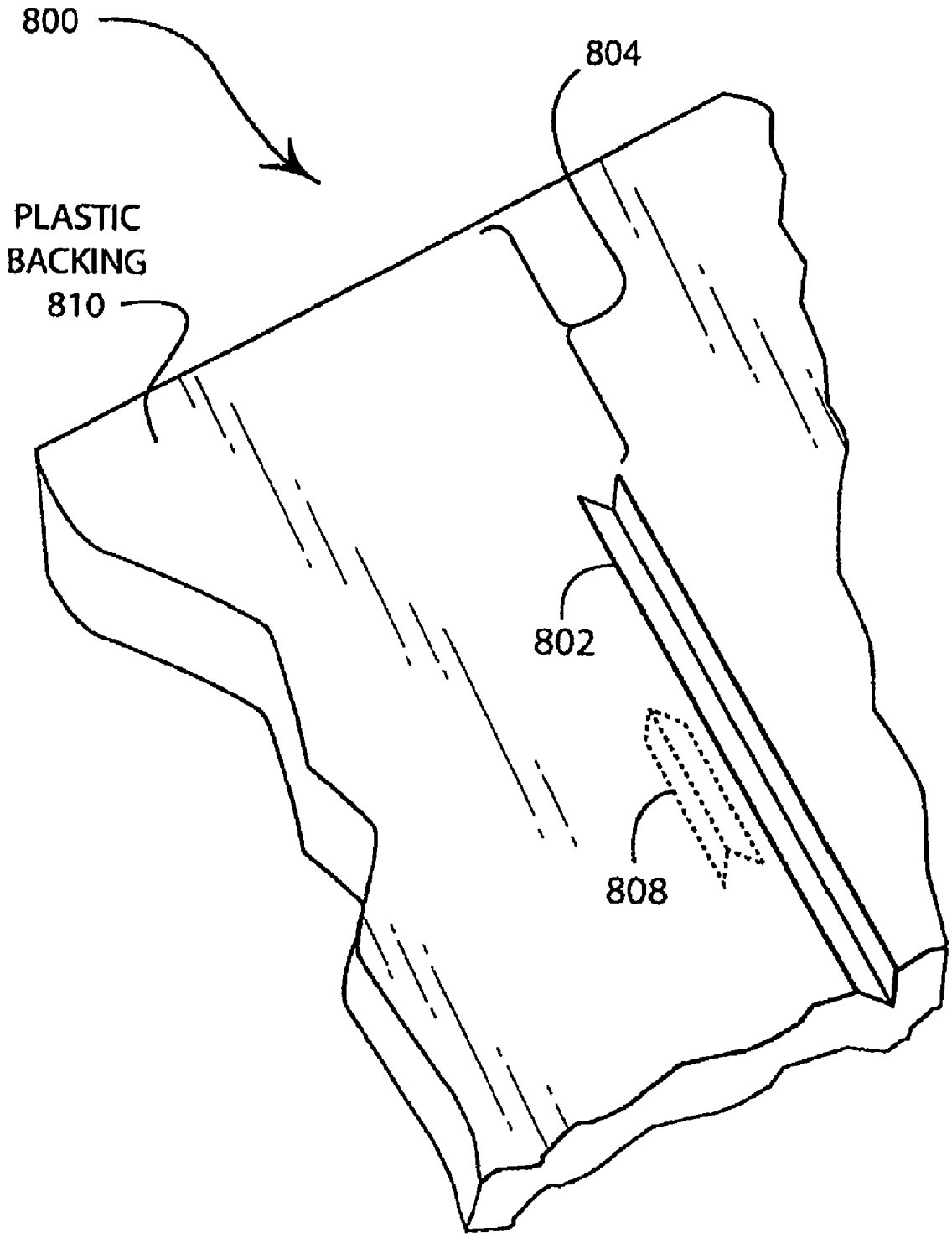

FIG. 9 is a close-up perspective view of dispensing package 800 illustrated in FIG. 8. As shown in FIG. 9, score 802 is disposed in the top of plastic backing 810. Metered slit 808 is disposed in the bottom side (underside) of plastic backing 810 and is vertically aligned with score 802. Score 802 does not extend for the entire width of dispensing package 800, but provides a shoulder portion 804 in which plastic backing 810 is not scored.

Figure 10:
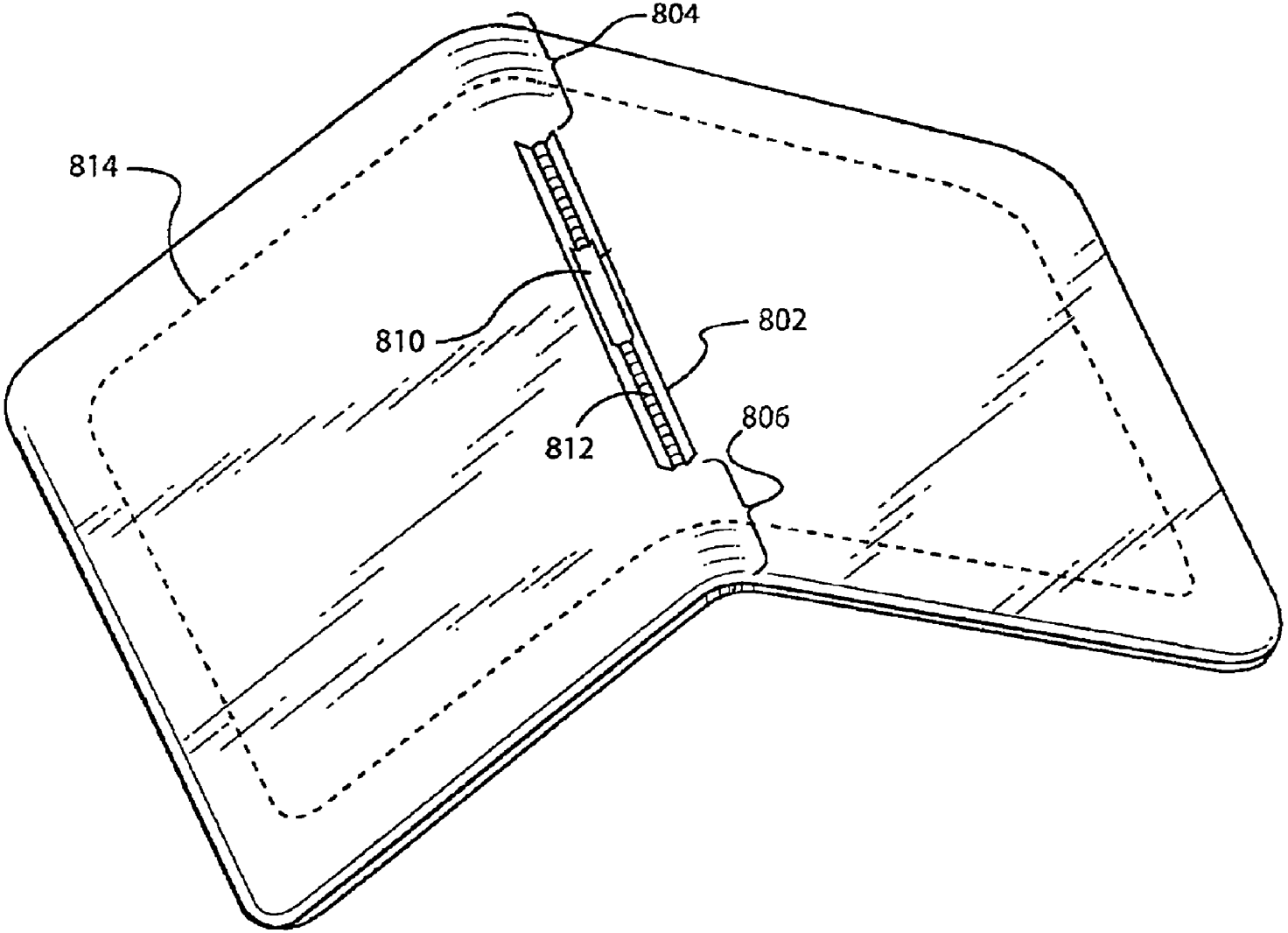
FIG. 10 is a perspective view of the embodiment of FIG. 8 showing an opened dispensing package.

FIG. 10 is a perspective view of dispensing package 800 in a flexed position. As shown in FIG. 10, dispensing package 800 is flexed which causes plastic backing 810 to break along the score 802. Flexure of dispensing package 800 also causes metered slit 810 to open. Barrier layer 812 prevents dispensing package 800 from opening across the entire length of score 802. Shoulder portions 804 and 806 in plastic backing 810 provide an elastic spring-like force that provides additional stress to the deformation of the flexure of dispensing package 800. Shoulder portions 804, 806, in this fashion, provide a structure that allows the user to control the flexure of dispensing package 800, rather than having dispensing package 800 immediately open. Dispensing package 800, in this fashion, provides more control over dispensing of the contents in pouch 814 of dispensing package 800.

Figure 11:
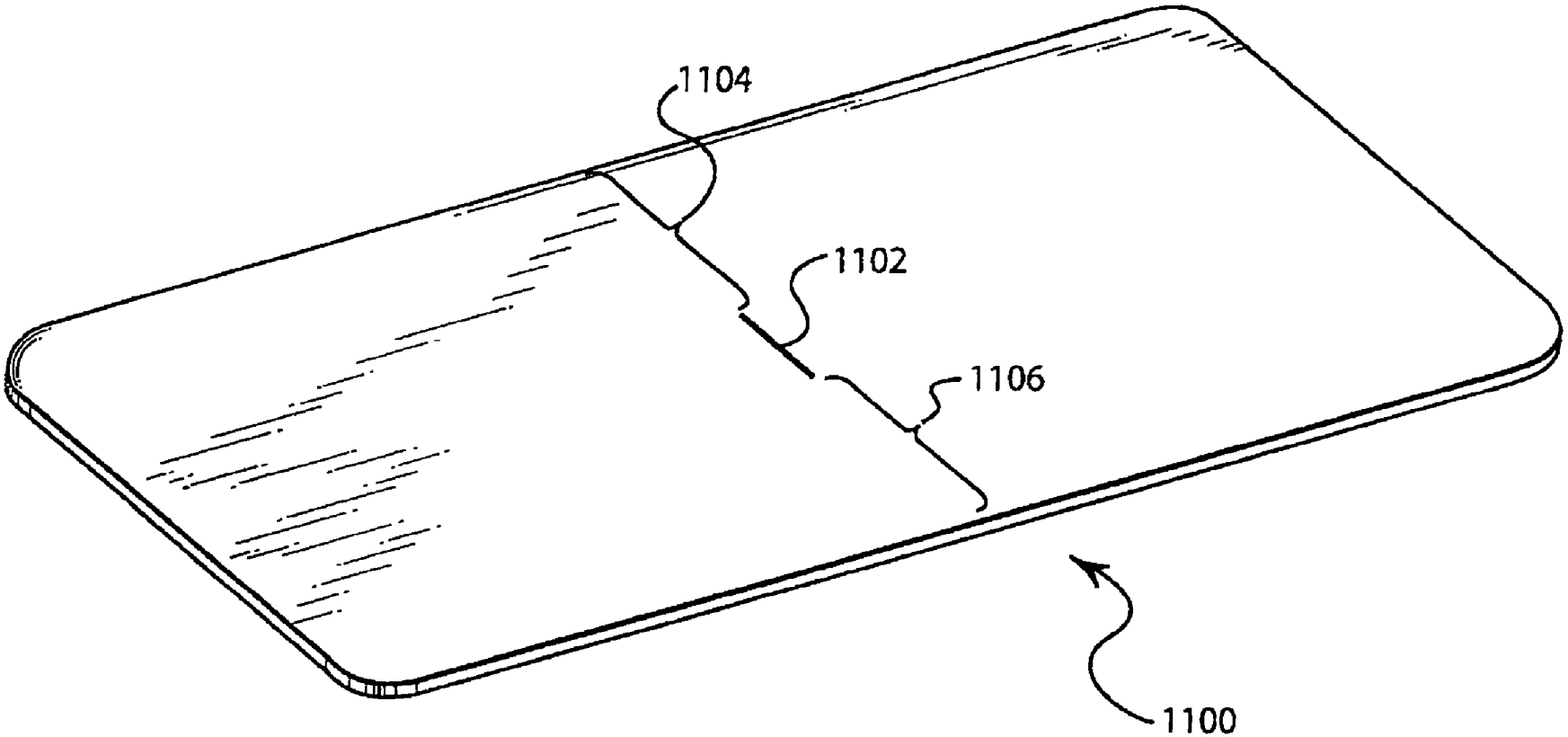
FIG. 11 is an alternate embodiment in accordance with the present invention.

FIG. 11 shows an alternate embodiment of a dispensing package 1100. As shown in FIG. 11, score 1102 has even a shorter length than score 802 of dispensing package 800 (as depicted in FIG. 10). Hence, shoulder portions 1104, 1106 are much larger and provide an even greater feedback force to the flexure of dispensing package 1100.

Figure 12:
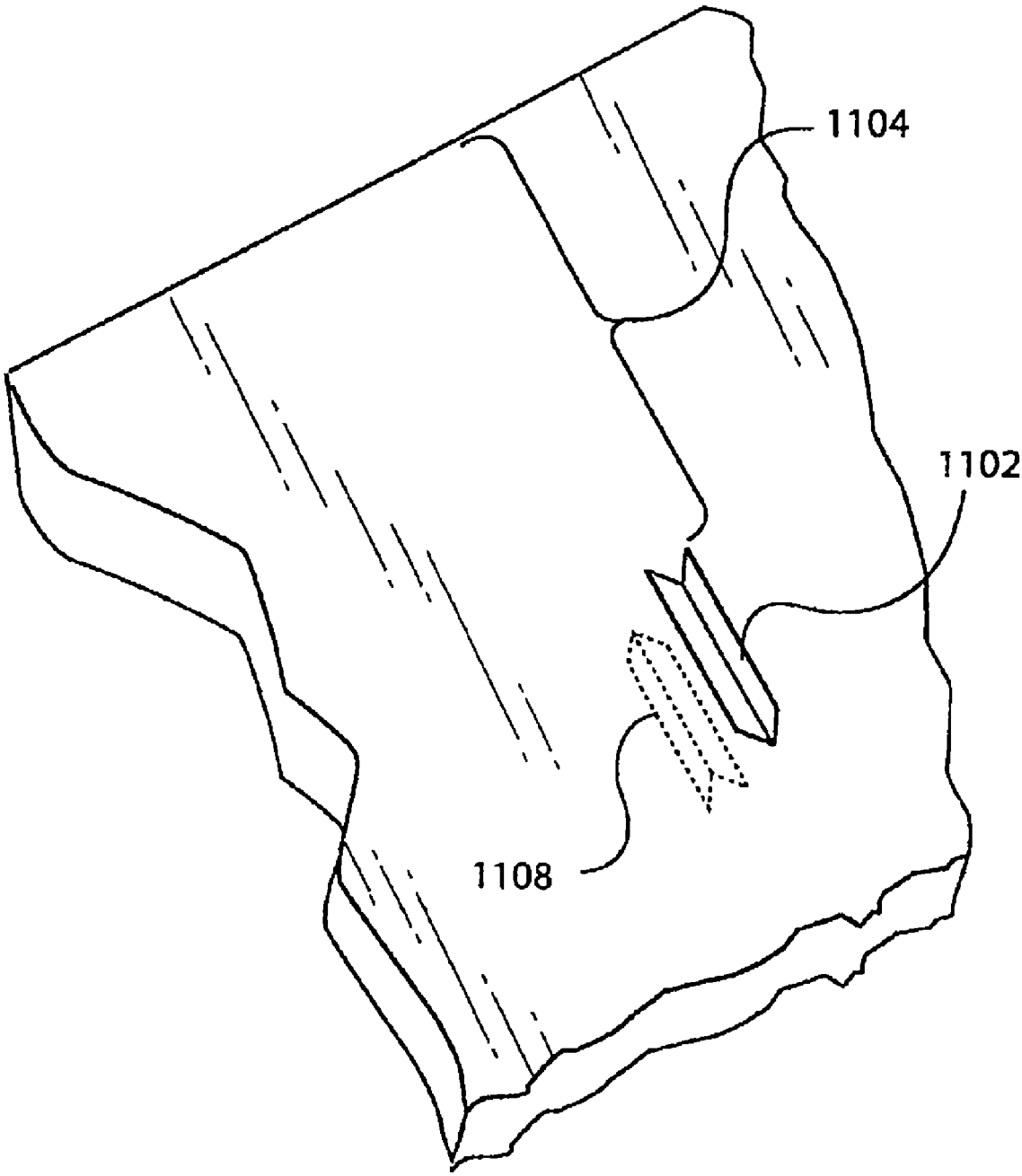
FIG. 12 is a close-up perspective view of the embodiment of FIG. 11.

FIG. 12 is a close-up perspective view of dispensing package 1100 of FIG. 11. As shown in FIG. 12, score 1102 is formed in the upper surface of the plastic backing and is vertically aligned with a similar metered slit 1108 in the opposite surface of the plastic backing. Shoulder 1104 extends a substantial distance across the width of dispensing package 1100 and provides a substantial feedback force to the flexure of dispensing package 1100.

Figure 13:
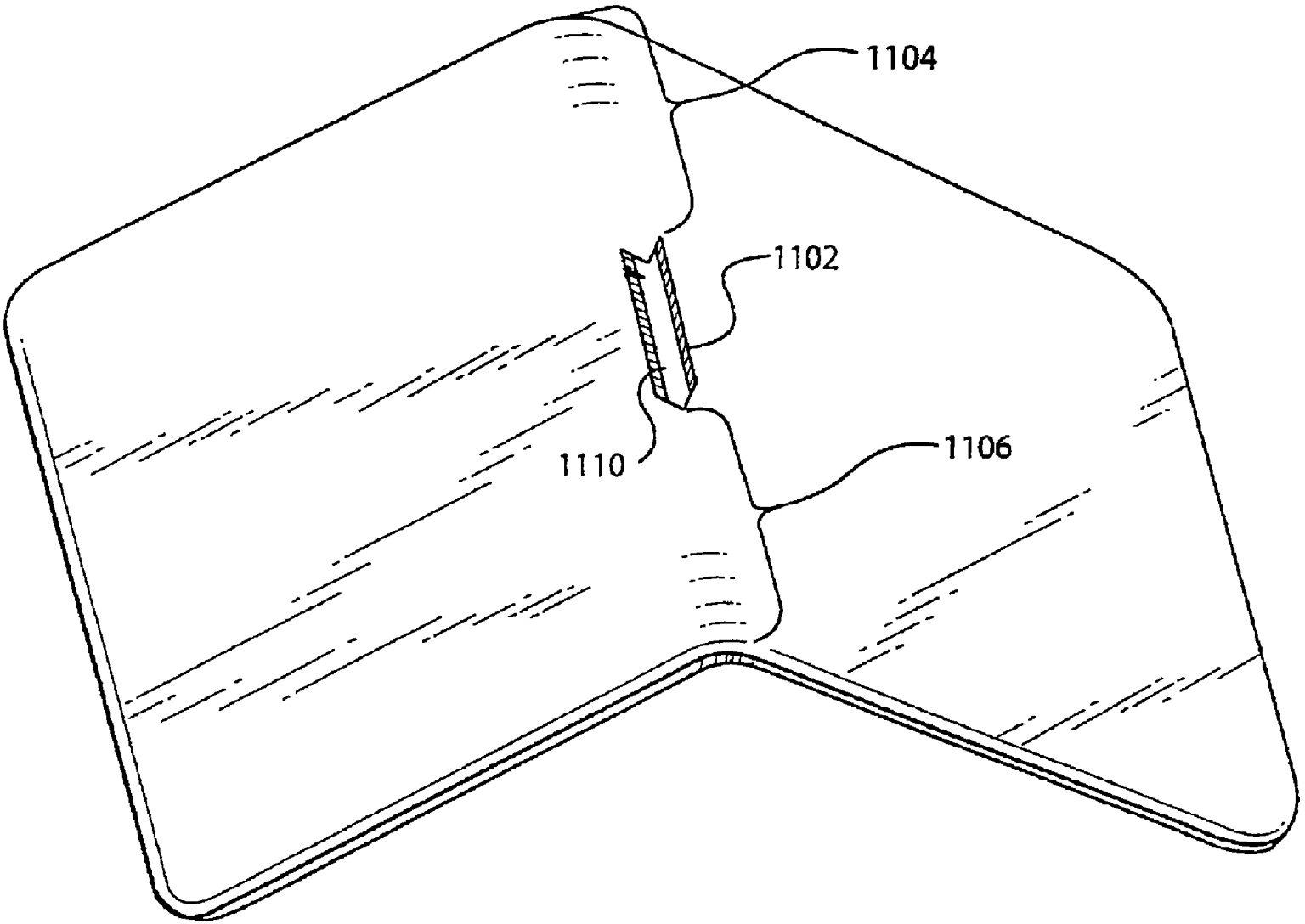
FIG. 13 is a perspective view of the embodiment of FIG. 11 showing an opened dispensing package.

FIG. 13 is a perspective view of dispensing package 1100 shown in a flexed position. As shown in FIG. 13, score 1102 is broken open to expose metered slit 1110. Shoulders 1104, 1106 do not break as a result of the flexure of dispensing package 1100 and provide an elastic feedback force that opposes the flexure of dispensing package 1100, which allows the user to accurately control the amount of flexure and, hence, the amount and flow rate of the contents dispensed from dispensing package 1100.

Figure 14:
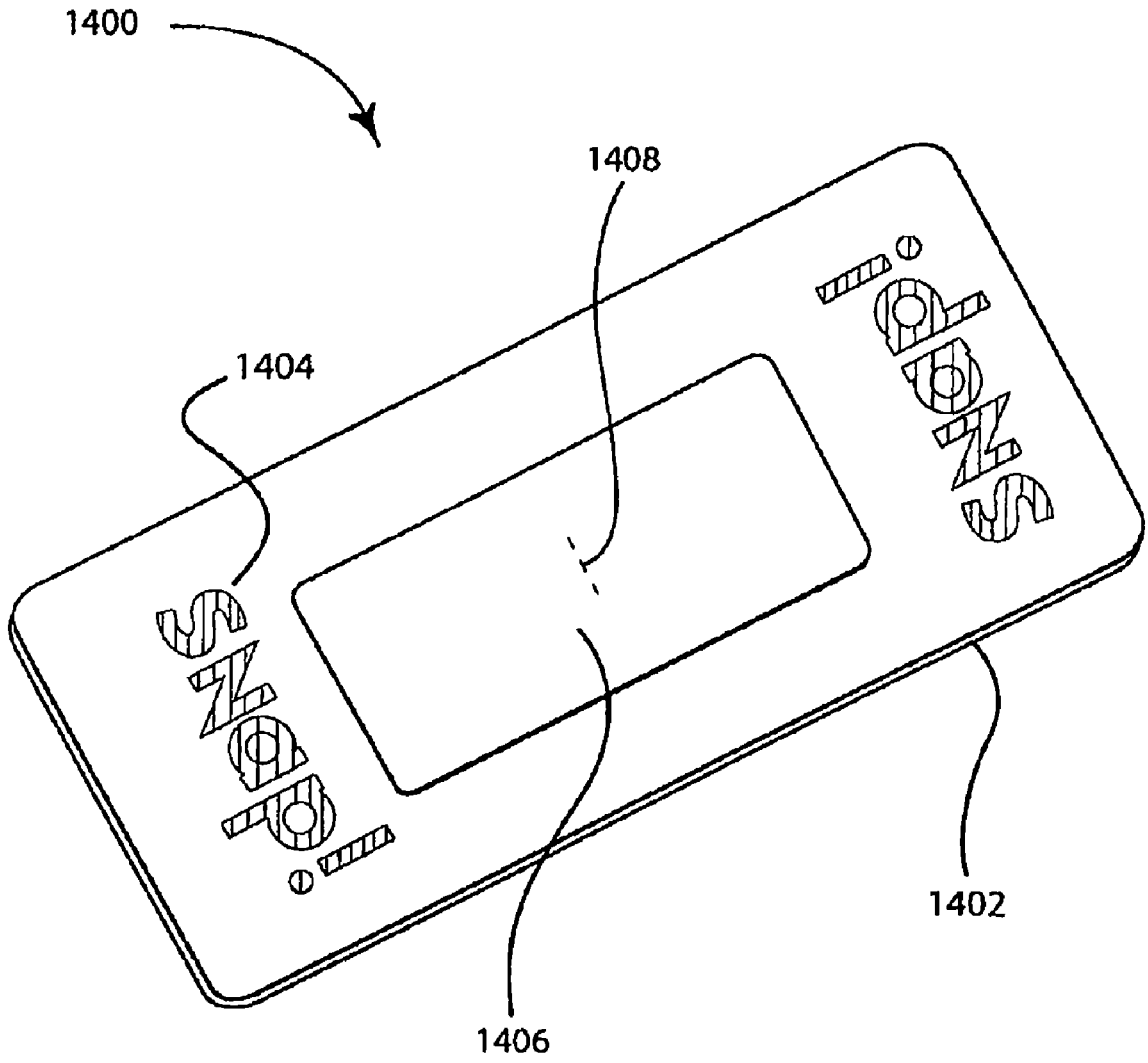
FIG. 14 is a perspective view of an alternate embodiment in accordance with the present invention.

FIG. 14 shows an alternate embodiment of a dispensing package 1400. As shown in FIG. 14, dispensing package 1400 has a plastic backing 1402 similar to the other embodiments and a label 1404. In addition, dispensing package 1400 has a promotional item or resealable layer 1406 that is placed on the top surface of dispensing package 1400. Promotional item or resealable label 1406 covers a score 1408 on the top surface of dispensing package 1400. In this fashion, dispensing package 1400 is protected from accidental breakage causing the contents of the package to dispense unintentionally while promotional item or resealable label 1406 is disposed on dispensing package 1400. Item 1406, as indicated, can be a resealable label so that once part of the contents of dispensing package 1400 are dispensed, dispensing package 1400 may be resealed to prevent further dispensing of the contents. As such, a user may wish to only dispense a portion of the contents and later dispense another portion of the contents. Further, item 1406 can be a promotional item or game piece, such as a lottery card, booklet, coupon or any other type of desired promotional item. In that regard, U.S. patent application Ser. No. 10/162,722, entitled "Machine for Placement of Multiple Labels," filed Jun. 3, 2002 by Richard Schaupp, et al., is specifically incorporated herein by reference for all that it discloses and teaches. Promotional item or resealable label 1406 can be peeled from the top of dispensing package 1400 and may be replaced on dispensing package 1400 after usage. Those skilled in the art will appreciate that label 1404 can be scored on not scored depending on the use and customer preference.

Figure 15:
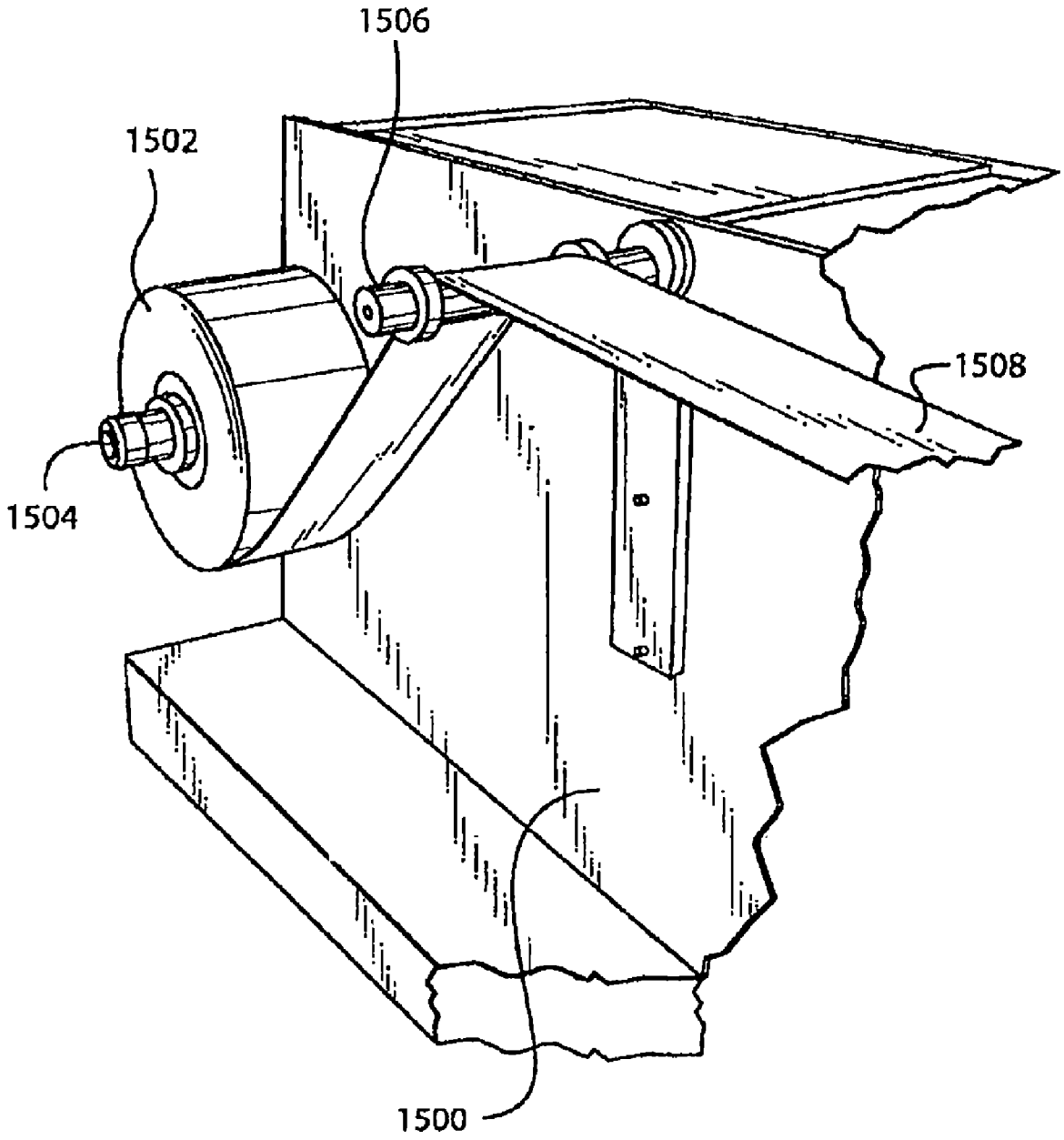
FIGS. 15-29 illustrate a press that can be used to make various embodiments of the dispensing package in accordance with the present invention.

FIGS. 15 through 29 illustrate a press 1500 that can be used to make various embodiments of the dispensing package disclosed herein. As shown in FIG. 15, a web roll 1502 of the plastic backing is mounted on a backing unwind mandrel 1504. The plastic backing web is unwound from roll 1502 as it is pulled across idler 1506. Plastic backing web 1508, that is unwound from roll 1502, then proceeds to other parts of press 1500 as described below. While FIGS. 15-29 depict only one lane for producing dispensing packages in accordance with the present invention, those skilled in the art can appreciate that more than one lane can be run simultaneously to produce various shapes, sizes and configurations of dispensing packages according to the various embodiments previously recited.

Figure 16:
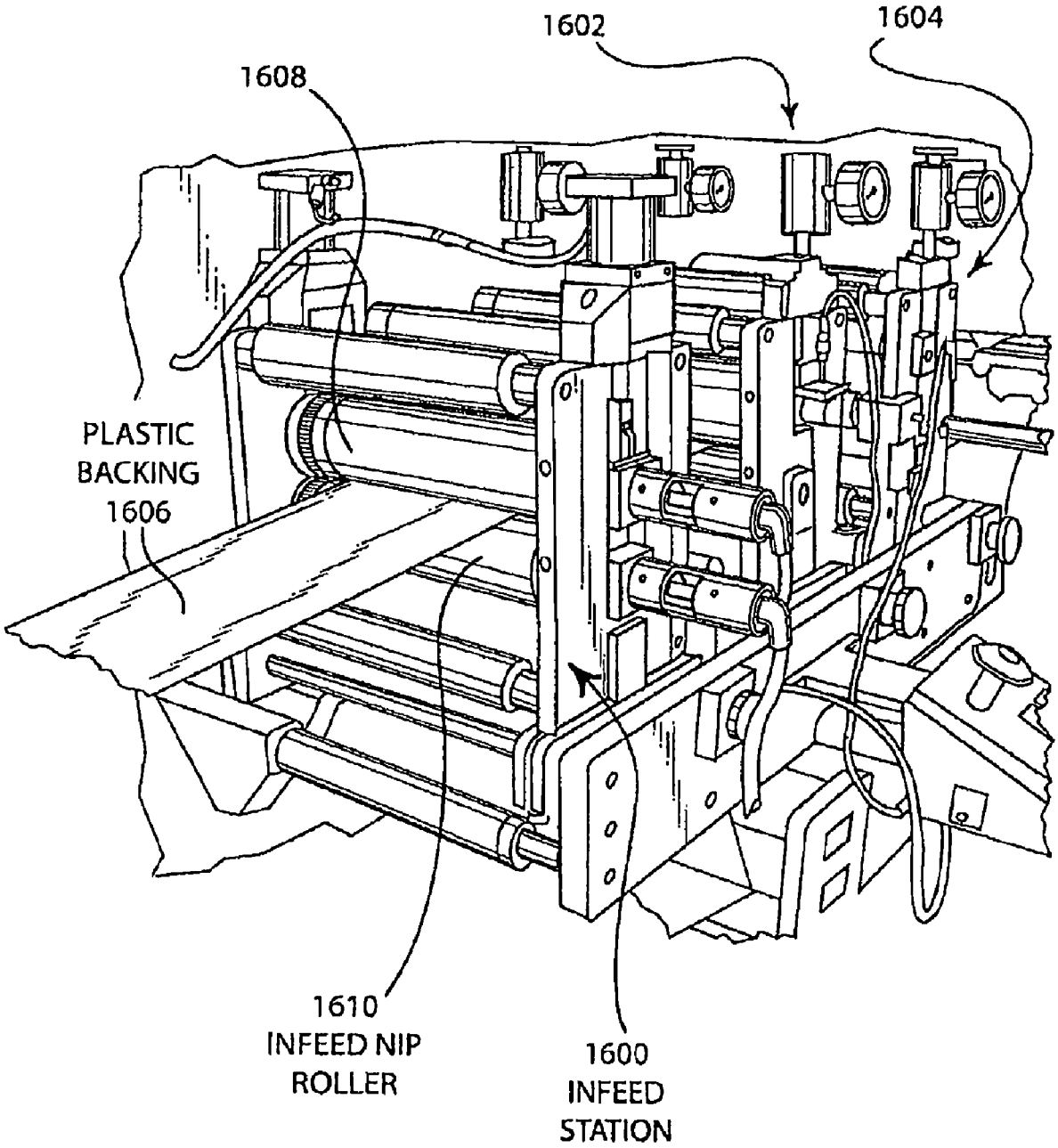

As illustrated in FIG. 16, the press further includes an in-feed station 1600, a first die cutting station 1602 and a second die cutting station and label laminator 1604. Plastic backing 1508 moves through and between a pull roller 1608 and in-feed nip roller 1610, located in in-feed station 1600.

Figure 17:
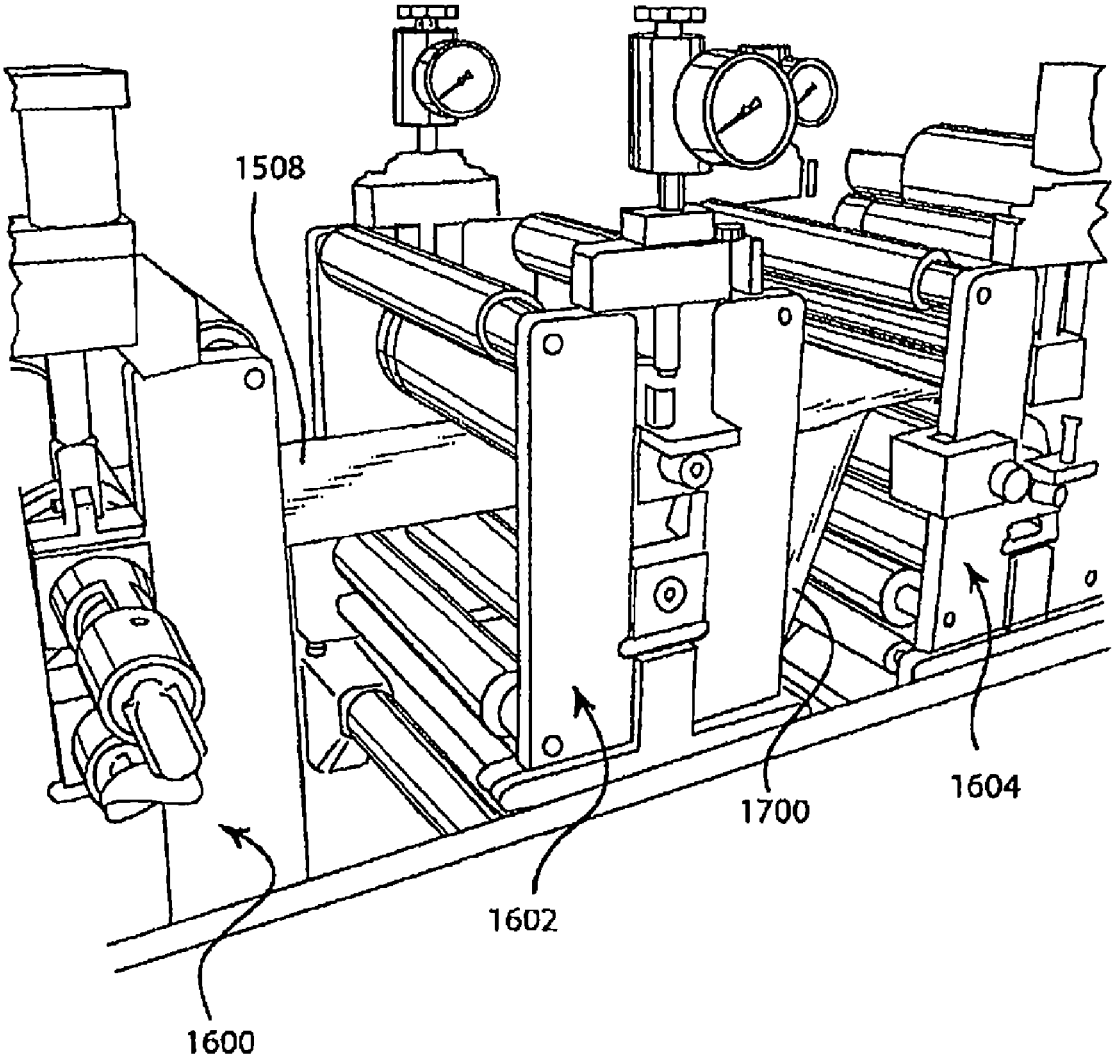

As illustrated in FIG. 17, plastic backing 1508 exits in-feed station 1600 and proceeds through first die cutting station 1602 which places the first cuts in the backside of plastic backing 1508. Plastic backing 1508 then proceeds to second die cutting station and label laminator 1604. Printed label webs 1700 are also fed into second die cutting station and label laminator 1604 where plastic backing 1508 and printed label web 1700 are laminated.

Figure 18:
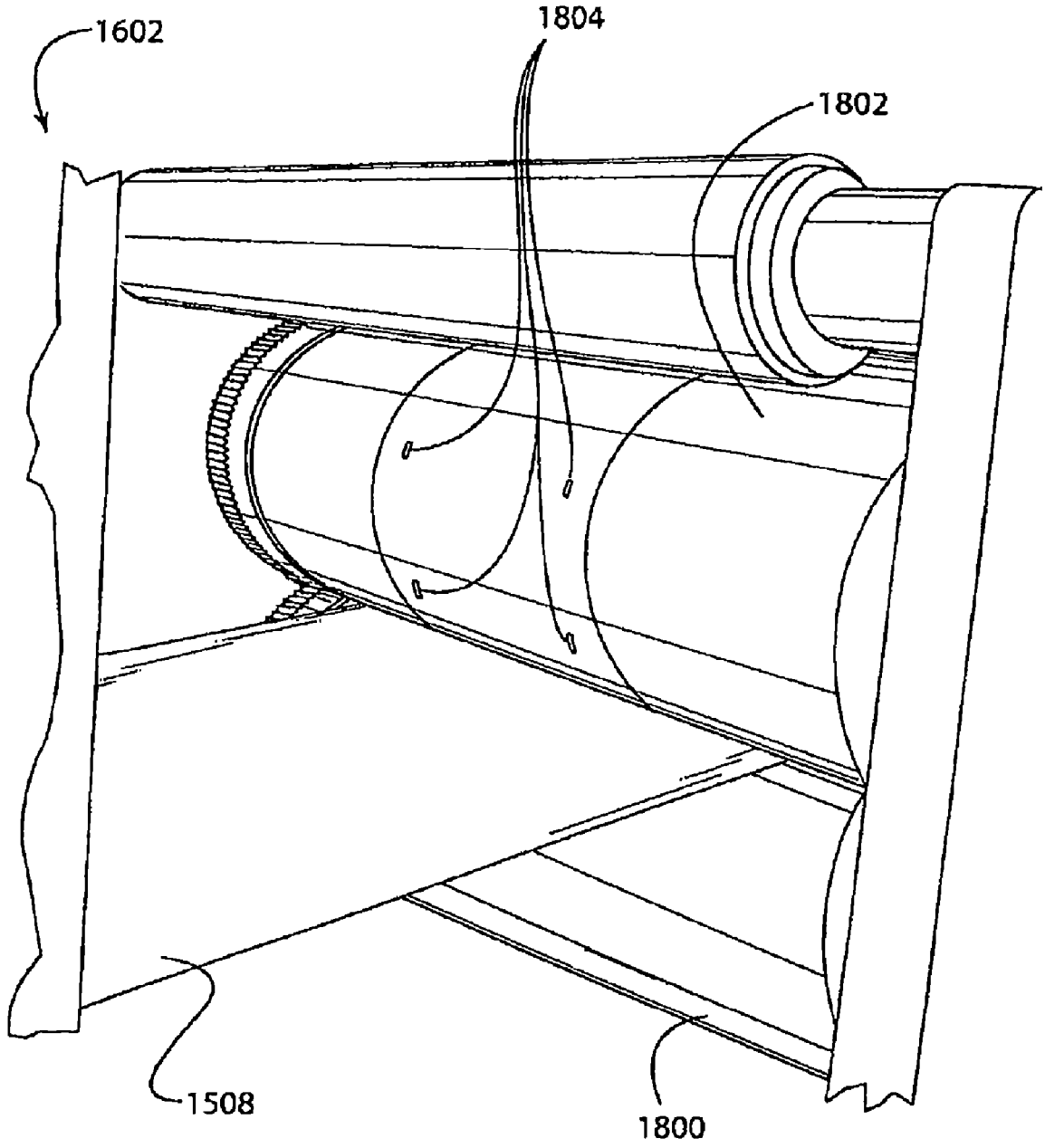

FIG. 18 is a close-up view of first die cutting station 1602. As shown in FIG. 18, plastic backing 1508 is sandwiched between a cylindrical anvil 1800 and a cylindrical die 1802. Those skilled in the art will appreciate that flat bed, rotary or laser die cutting may also be used. Cylindrical die 1802 includes a series of cutting blades 1804 that cut the backside of plastic backing 1508, which is shown as the top surface of plastic backing 1508 in FIG. 18. Cutting blades 1804 make smaller score 1102 as shown in FIGS. 11-13 on the underside or backside of plastic backing 1508. Cylindrical anvil 1804 is adjustable with respect to cylindrical die 1802 to provide precise control over the depth at which cutting blades 1804 score plastic backing 1508. Cylindrical die 1802 is configured such that it cooperates with the cylindrical anvil 1804 to provide precise control over the depth at which cutting blades 1804 score plastic backing 1508. The amount of force necessary to snap the plastic backing 1508 open before dispensing the contents is changed based on the depth of the score. Accordingly, altering the score depth depending on the contents being dispensed provides additional control over dispensing.

Figure 19:
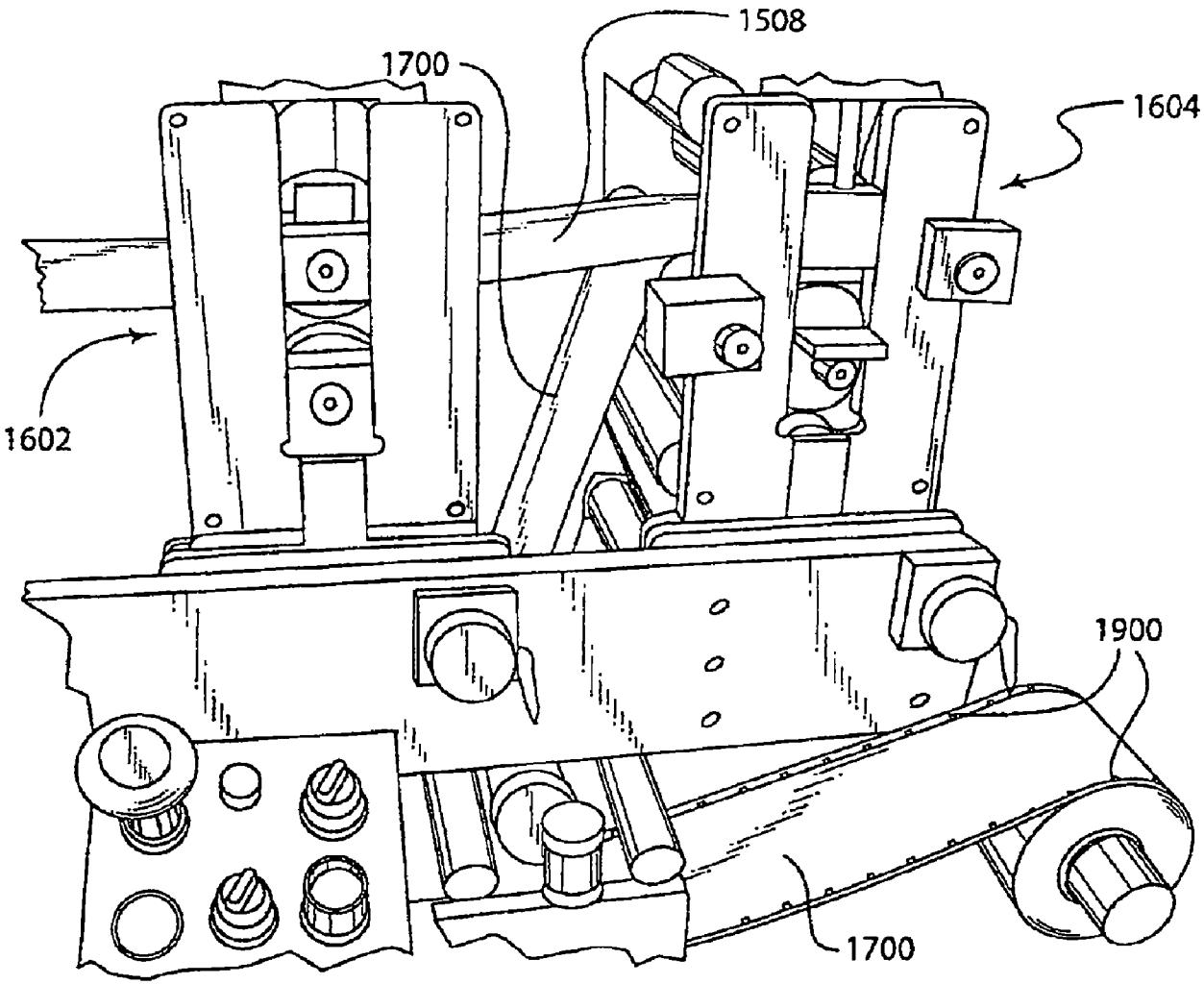

FIG. 19 is an additional side perspective view illustrating first die cutting station 1602 and second die cutting station and label laminator 1604. As shown in FIG. 19, printed label web 1700 is unwound from a mandrel and has a plurality of registration marks 1900. Registration marks 1900 indicate the location of the label information on printed label web 1700. Printed label web 1700 proceeds from the bottom of the press and upwardly to be mated with plastic backing 1508 in second die cutting station and label laminator 1604, as shown in FIG. 19. First die cutting station 1602 is synchronized with registration marks 1900 to ensure that the scores made by first die cutting station 1602 are placed in the proper location on plastic backing 1508.

Figure 20:
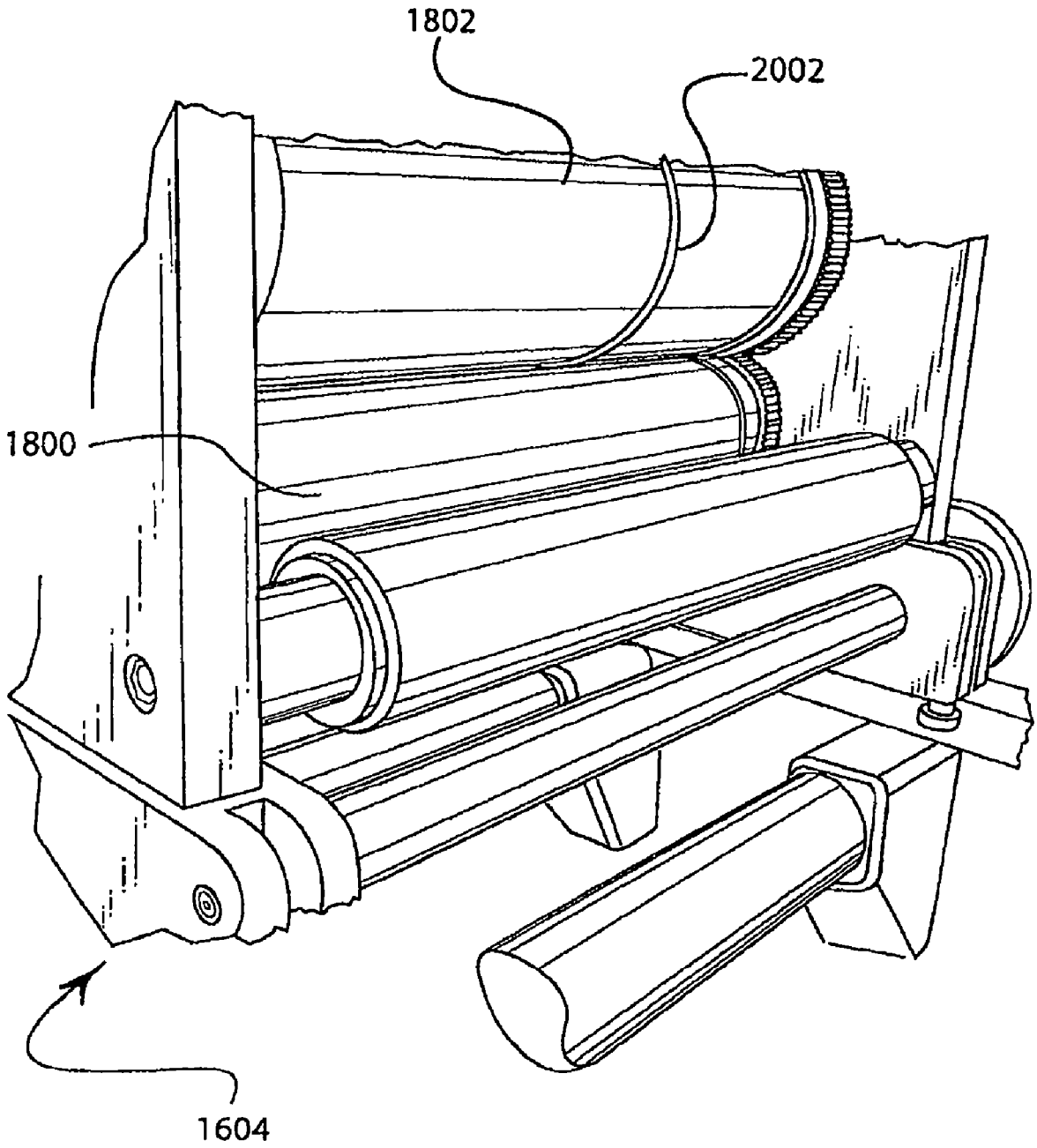

FIG. 20 is an additional view of the backside of second die cutting station and label laminator 1604. As shown in FIG. 20, cylindrical die 1802 has a cutting blade 2002 which cuts along the length of the cylindrical web. Cutting blade 2002 mates with cylindrical anvil 1800 to form the score in the plastic backing. Cylindrical anvil 1800 is adjustable with respect to cutting blade 2002 to provide precise control over the depth at which cutting blade 2002 scores the plastic backing. Cylindrical die 1802 is configured such that it cooperates with the cylindrical anvil 1804 is order to provide precise control over the depth at which cutting blades 2002 scores plastic backing 1508. The amount of force necessary to snap the plastic backing 1508 open before dispensing the contents is changed based on the depth of the score. Accordingly, altering the score depth depending on the contents being dispensed provides additional control over dispensing.

Figure 21:
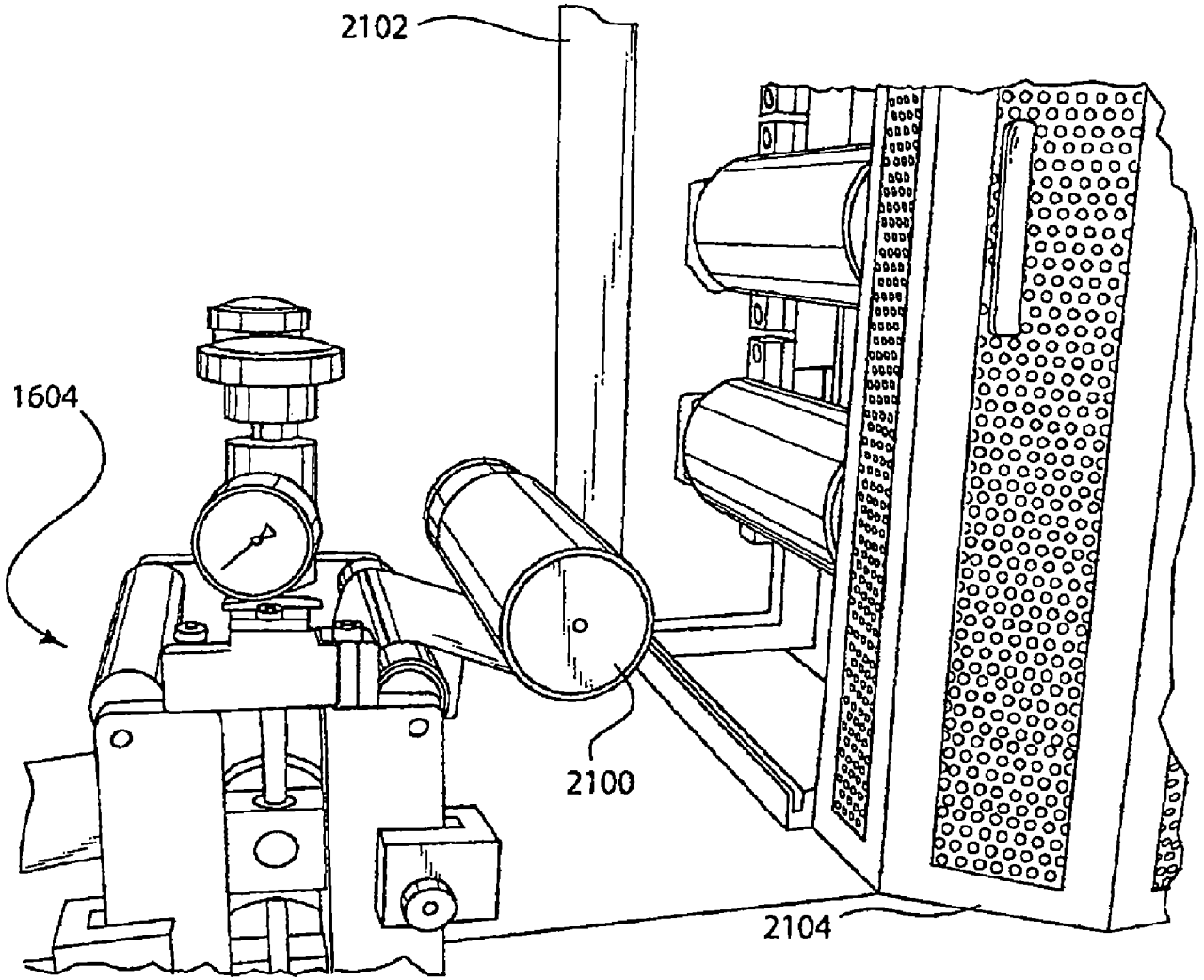

FIG. 21 is a side view illustrating second die cutting station and label laminator 1604 and filler/sealer station 2104. As shown in FIG. 21, the plastic backing proceeds through second die cutting station and label laminator 1604, where the plastic backing and label web are scored and laminated. Plastic backing with laminated label 2102 proceeds around idler 2100 in an upward direction to be fed into filler/sealer station 2104.

Figure 22:
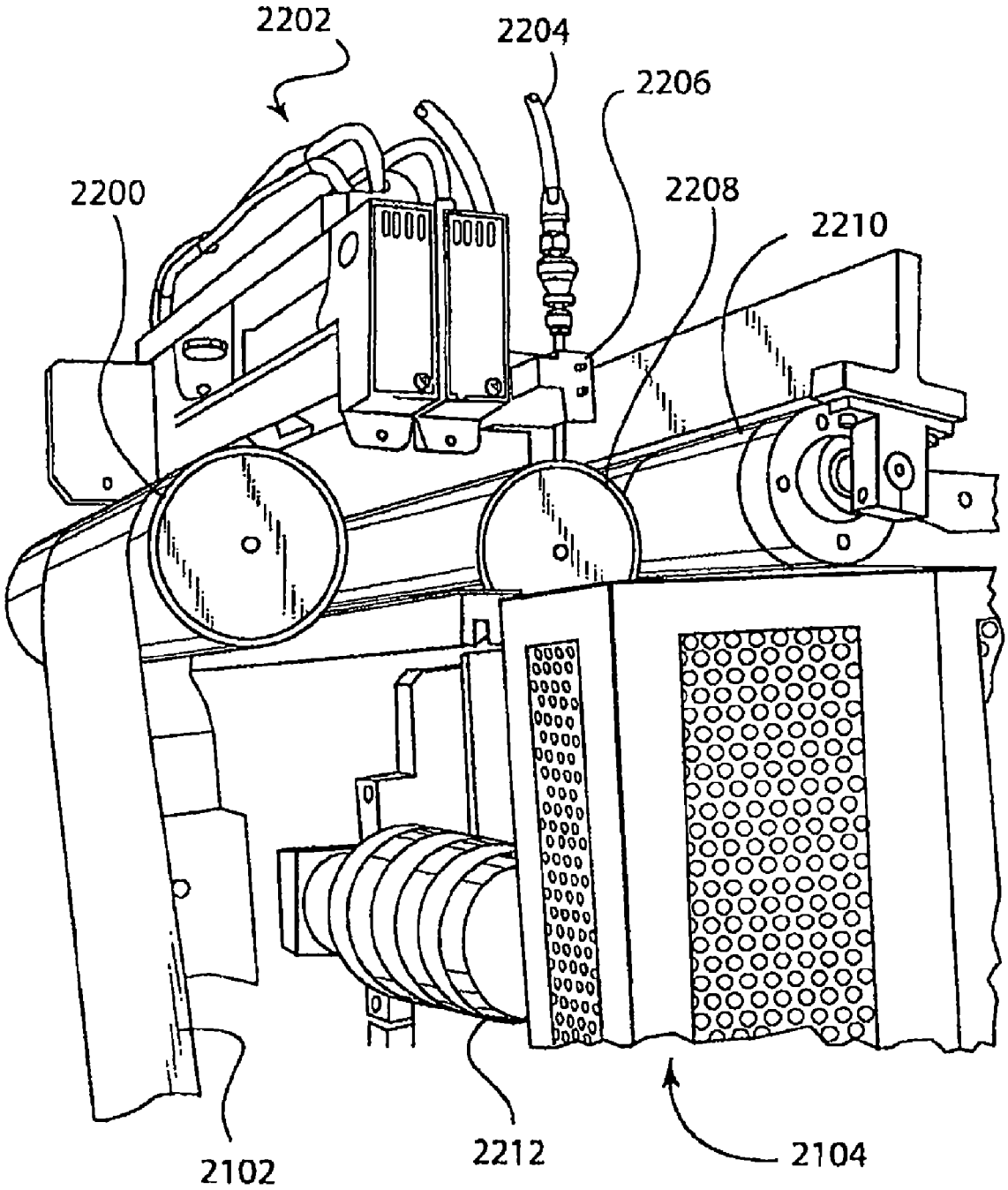

FIG. 22 is a side view illustrating filler/sealer station 2104. Plastic backing with the laminated label 2102 proceeds around an idler 2200 past a pre-heater assembly 2202. Pre-heater assembly 2202 heats plastic backing with the laminated label 2102 prior to filling and sealing the assembly. The plastic backing with the laminated label 2102 proceeds around idler 2200 under pre-heater assembly 2202 and around idler 2208 and then downwardly into filler/sealer station 2104, as described below. A filler conduit 2204 is connected to a supply of contents that is to be placed in the dispensing package. The contents may be supplied in drums, such as 55-gallon drums. The contents can comprise any desired contents including liquids, lotions, creams, gels and pastes or other contents that can be pumped to the filler conduit 2204. Pumps used to deliver contents to the filler conduit can be any suitable pump, including centrifugal pumps, positive displacement pumps, diaphragm pumps, and the like selected based on the contents being dispensed. The pump is servo-driven in order to provide precise dispensing timing to reduce or eliminate cross seal contamination and provide enhanced seal integrity. In addition, the type and size of pump can be easily changed depending on the contents being dispensed allowing the system to fill a wide variety of contents with varying viscosities. Once the filler conduit 2204 is connected on one end to the pump, it is then connected on a second end to a valve 2206 that controls the flow of contents to a filler tube (described below). A pouch web (described below) wraps around idler 2210 and also moves downwardly to be mated with plastic backing and laminated label 2102. Sealing wheel assembly 2212 seals the pouch web to plastic backing with the laminated label 2102, as described below.

Figure 23:
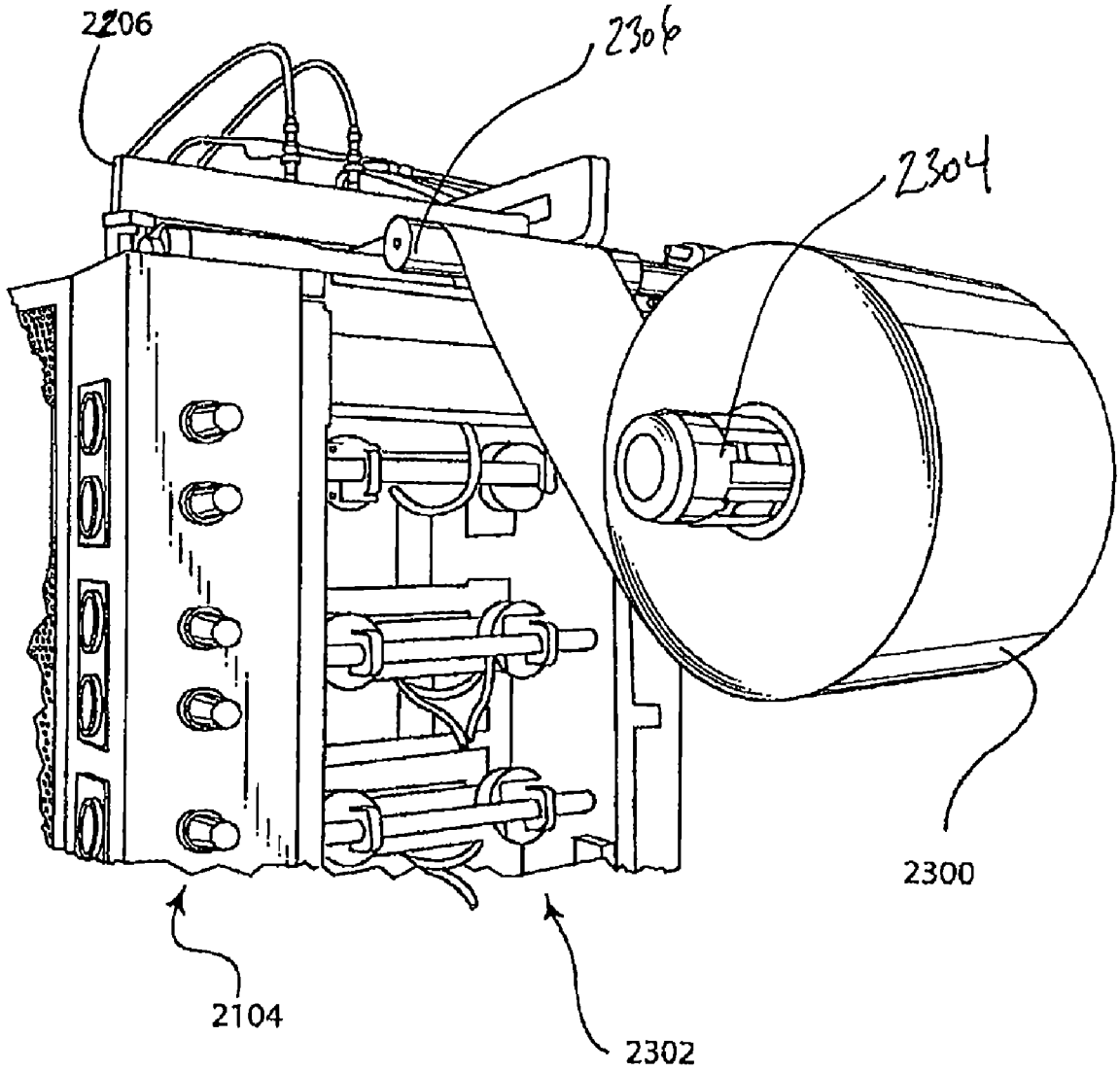

FIG. 23 is an additional view of filler/sealer station 2104. As shown in FIG. 23, pouch web 2300 is fed from a roller 2304 across an idler 2306 and down into filler/sealer station 2104. Pouch web 2300 is on the close side (right side) of valve 2206 and the associated filler tubes. Pouch web 2300 proceeds downwardly across the sealers 2302.

Figure 24:
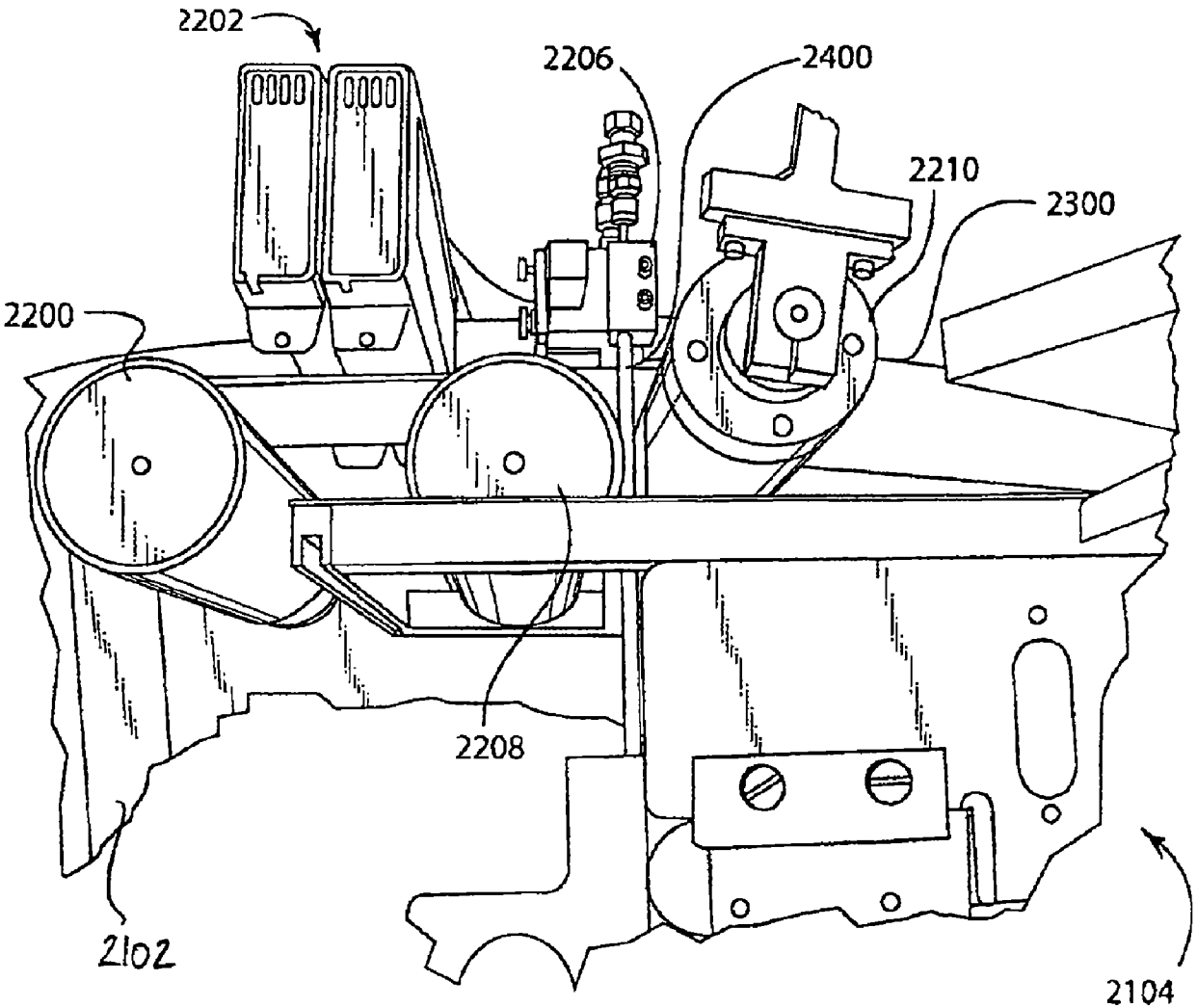

FIG. 24 is a side view of filler/sealer station 2104. As shown in FIG. 24, pouch web 2300 proceeds across idler 2110 and downwardly on the right side of filler tube 2400. At the same time, laminated plastic backing and laminated label 2102 are fed across idler 2200 and under pre-heater assembly 2202. Pre-heater assembly 2202 pre-heats the plastic backing prior to entry into filler/sealer station 2104. This assists in the sealing of pouch web 2300 to the plastic backing. Plastic backing and laminated label 2102 are then fed across idler 2208 and proceed downwardly on the left side of filler tube 2400.

Figure 25:
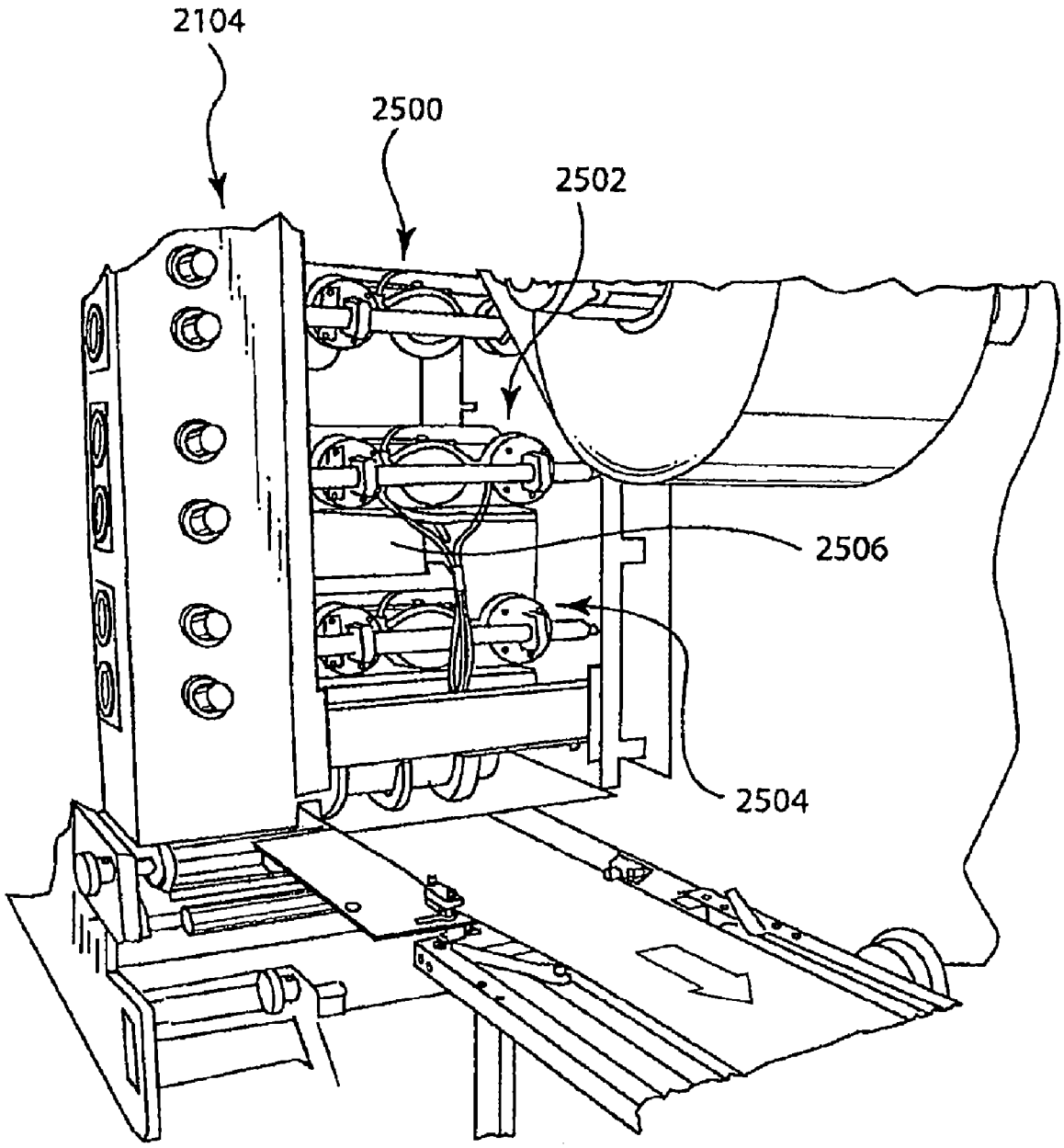

FIG. 25 is a back side perspective view of filler/sealer station 2104. As shown in FIG. 25, three sealer assemblies 2500, 2502 and 2504 are located on filler/sealer station 2104. Plastic backing with label and pouch applied 2506 is fed downwardly across the sealers 2500, 2502, 2504 and is filled and sealed in filler/sealer station 2104.

Figure 26:
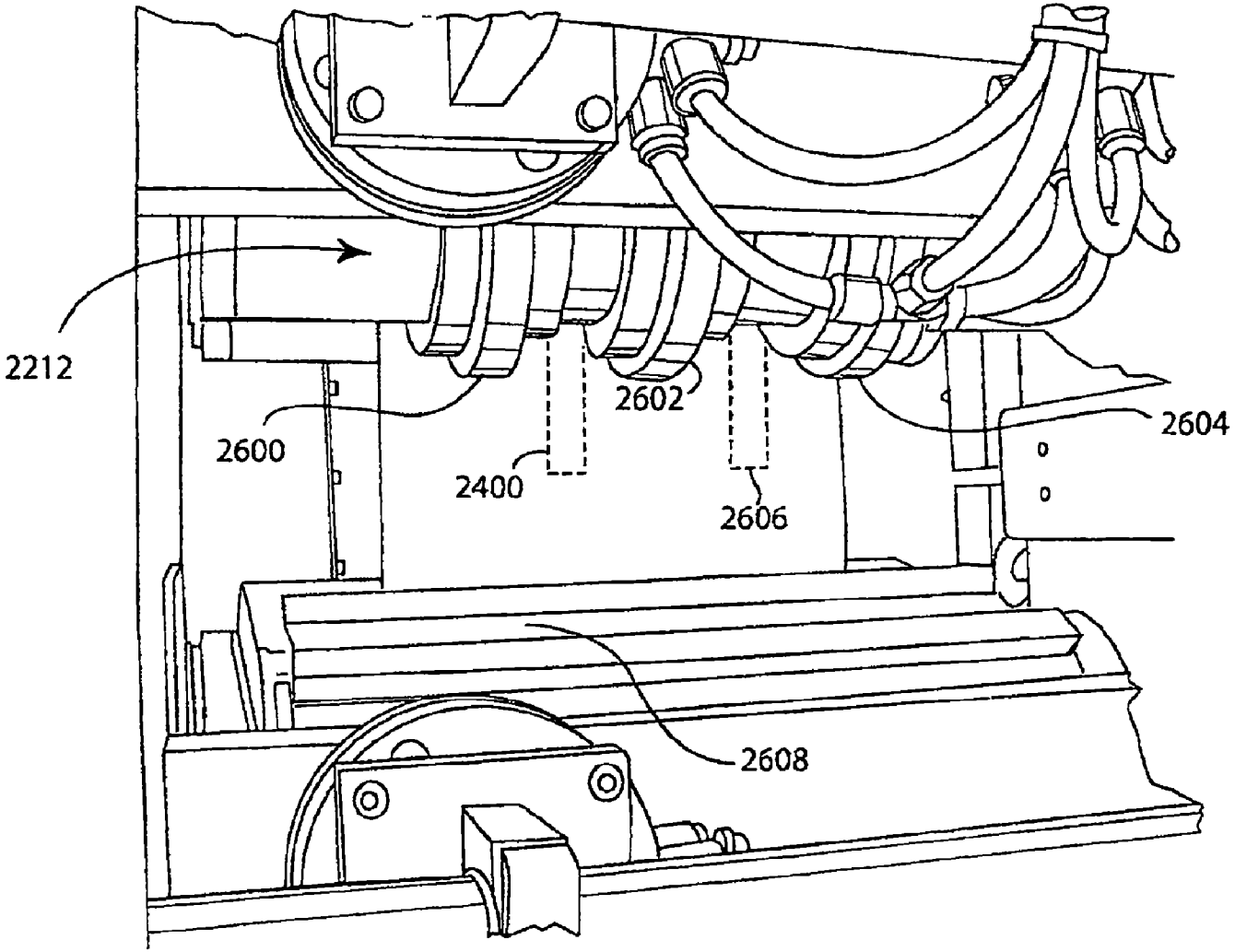

FIG. 26 is a close-up view of one of sealing assemblies (2500, 2502, 2504) illustrated in FIG. 25. As shown in FIG. 26, sealing wheel assembly 2212 includes a series of sealing wheels 2600, 2602 and 2604 that heat and apply pressure to the pouch to seal the pouch to the plastic backing. Cross sealer 2608 provides a cross seal to the web as the web is moving downwardly. Hence, sealing wheel assembly 2212 and cross sealer 2608 provide a U-shaped pouch that is open at the top. Filler tubes 2400 and 2606 are located in-between the sealing wheels. Filler tubes 2400, 2606 insert a predetermined amount of contents into the U-shaped pouch that is formed. Filler tubes 2400, 2606 are custom sized based on the contents being sealed in the packages. The web then proceeds downwardly so that cross sealer 2608 seals across the top of the U-shaped pouch to provide a completely sealed pouch on the web. Back barrier over drive is used during filling and sealing to provide varying over drives that can be matched to the pouch size in order to avoid channeling in the cross seal area.

Figure 27:
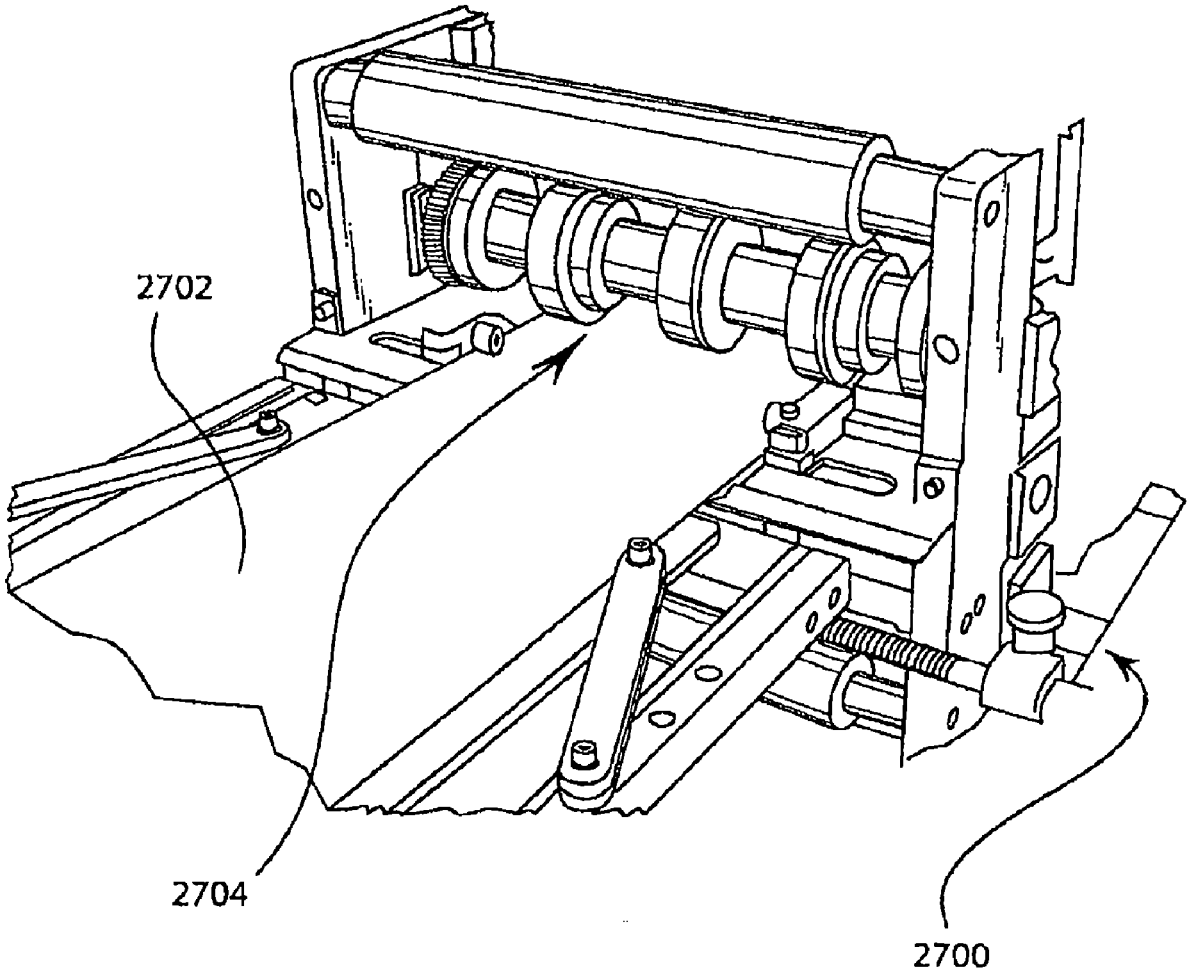

FIG. 27 is a perspective view of a portion of die cutting assembly 2700. As shown in FIG. 27, a filled and sealed assembly web 2702 proceeds into a die cutting assembly 2700. A patterned nip assembly 2704 is then used to cut the assemblies 2702 into individual packages.

Figure 28:
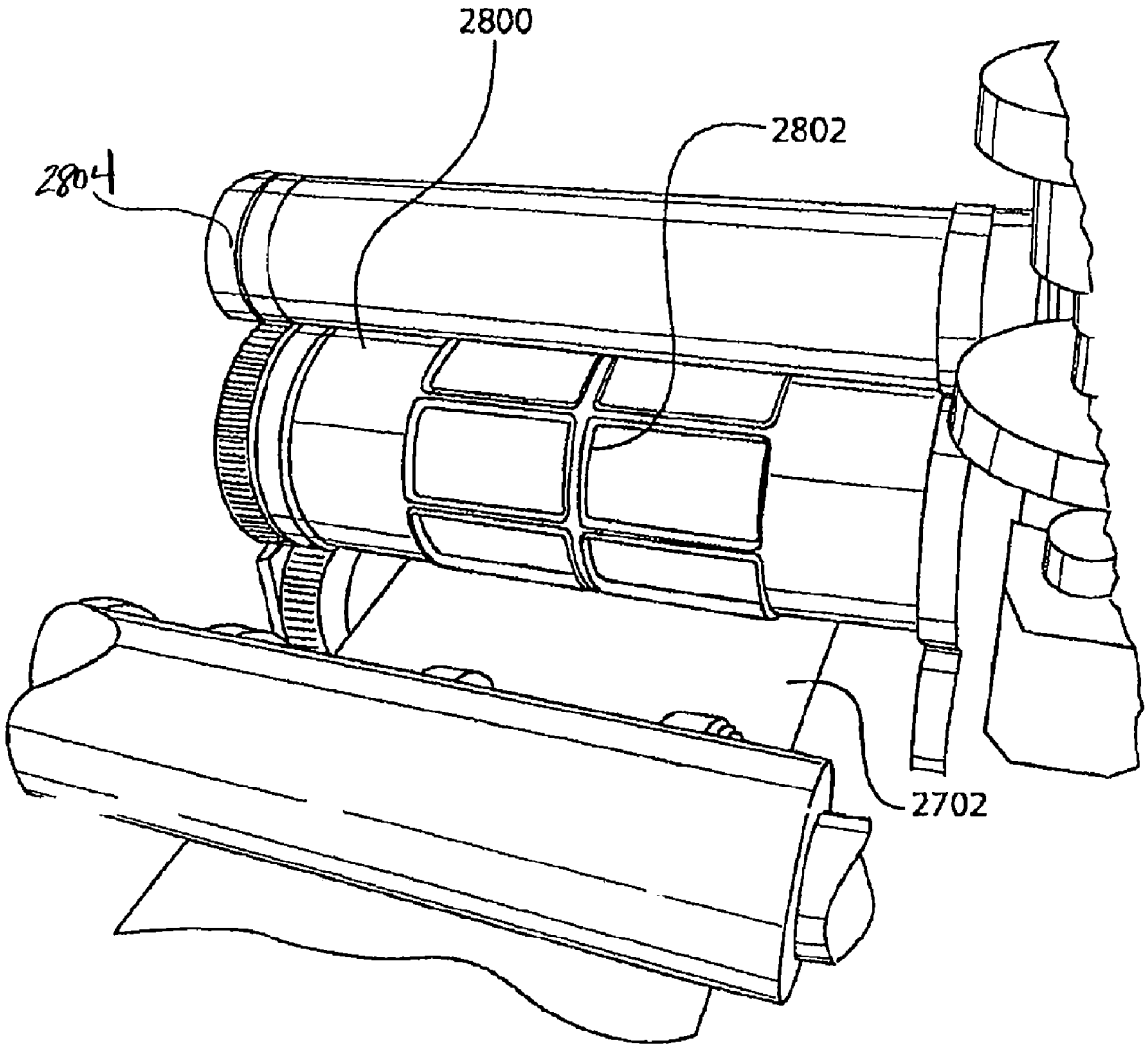

FIG. 28 is another view of die cutting assembly 2700. As shown in FIG. 28, filled and sealed assembly web 2702 is fed between anvil 2804 and cutting die 2800. Cutting blades 2802 cut filled and sealed assembly web 2702 into individual pouches as filled and sealed assembly web 2702 pass between anvil 2804 and cutting blades 2802.

Figure 29:
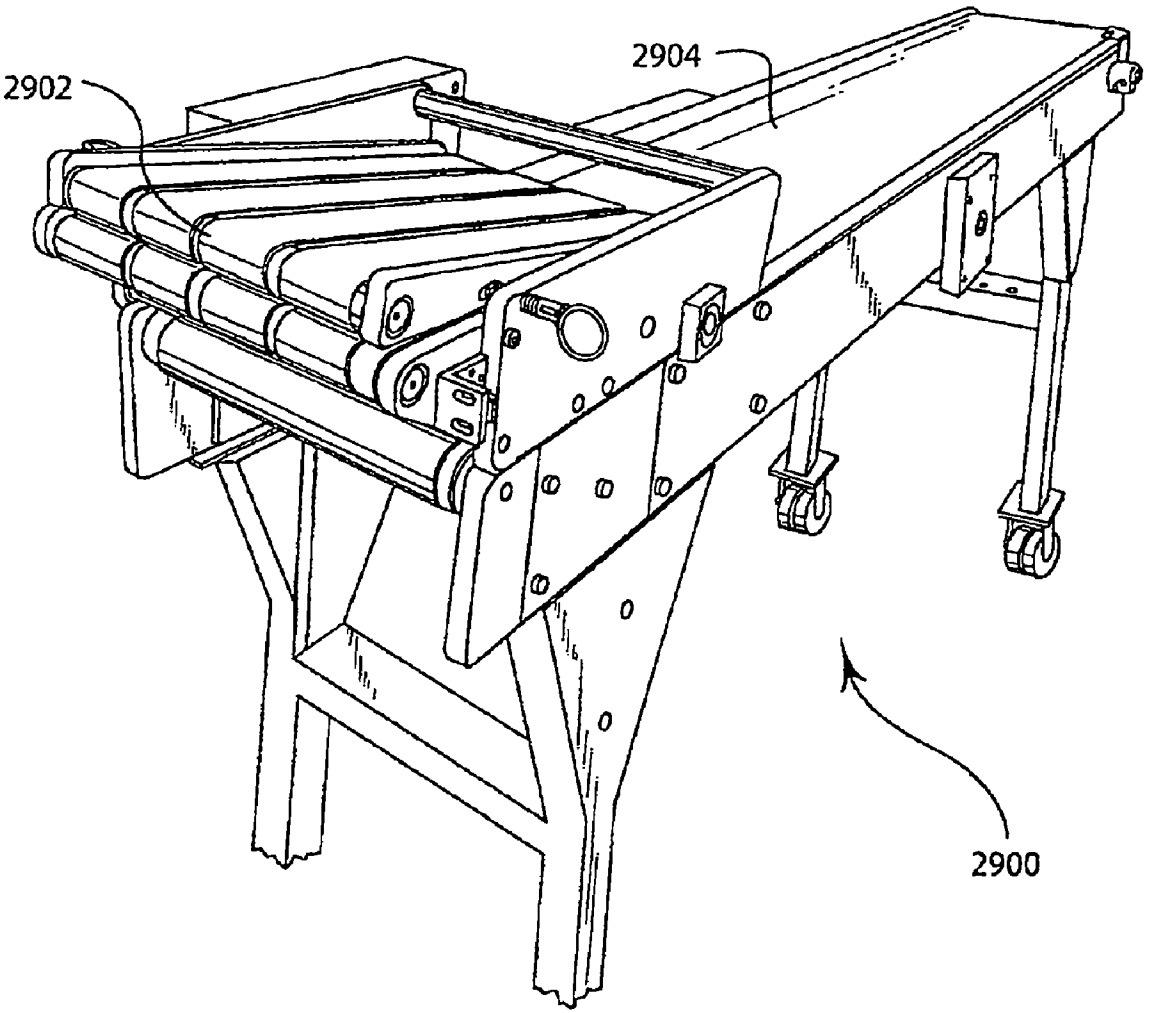

FIG. 29 is a perspective view of conveyor/stacker assembly 2900. After the individually cut packages leave die cutting assembly 2700, they are received by receiving conveyor 2902. They are then transported by transporting conveyor 2904 for stacking and packaging for shipment. Of course, any desired type of conveyor/stacker assembly can be used for packaging and shipping the individual packages.

Figure 30:
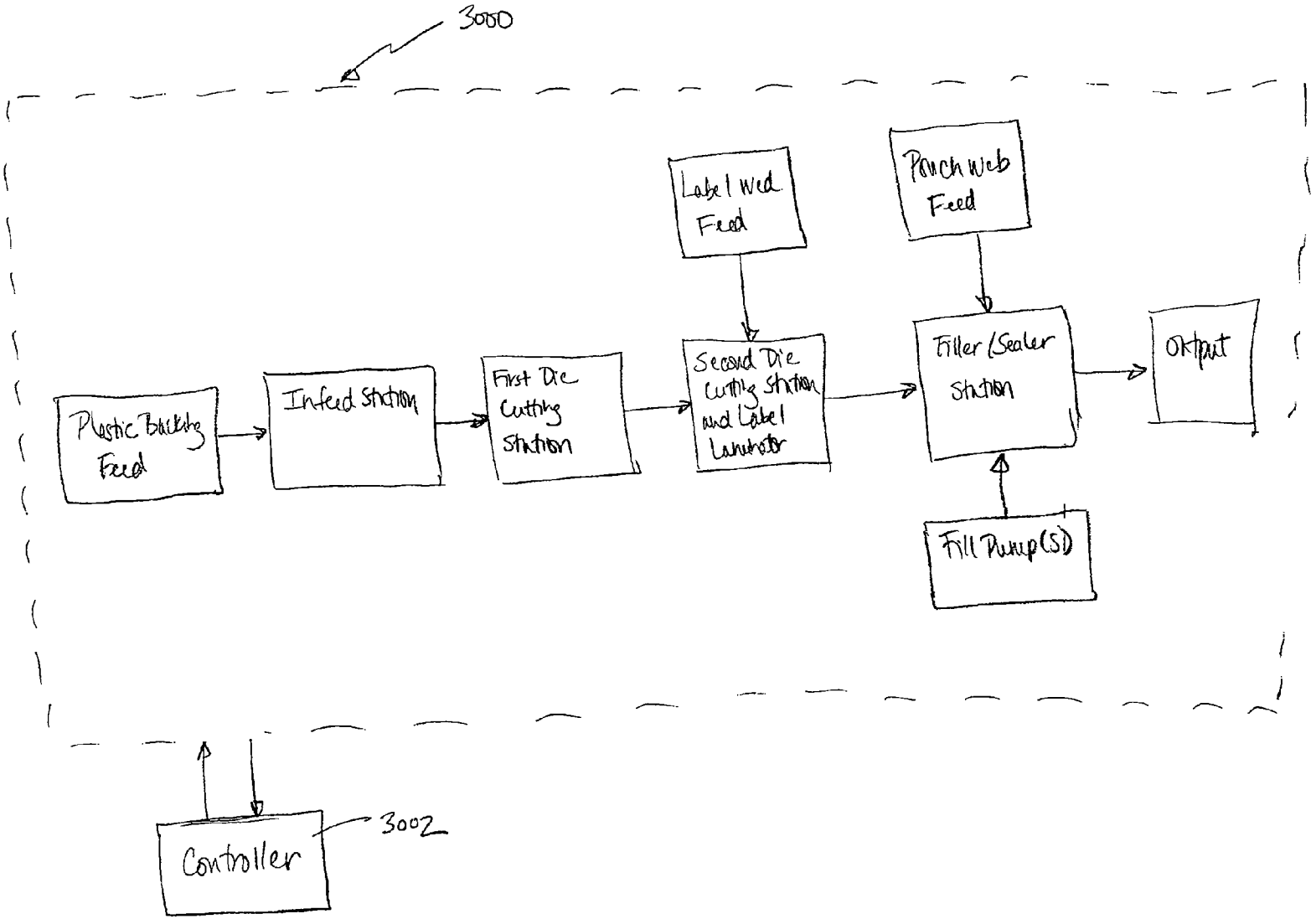
FIG. 30 is a block diagram illustrating exemplary components of the press of the present invention in communication with a controller.

FIG. 30 is an illustration of one embodiment of press 3000 connected to a controller 3002 in order to produce dispensing packages in accordance with the present invention. Operating values for control parameters such as rotational speed of idlers, position of anvils, temperatures of heat sealers, fill pump speeds, data pertaining to label registration, and the like can be programmed into controller 3002 before operating press 3000. Data files can be saved for particular contents being packaged, where the operating values unique to individual contents can be inputted and saved according to a naming system. In this manner, operators can load data according to the contents for which they are operating press 3000. Controller 3002 continuously monitors the status of all operating parameters to provide optimal control over press 3000. Controller 3002 can be set to provide operators with audible, visible and production halting alarms depending on the deviation of actual operating parameters from inputted operating parameters. As those skilled in the art will appreciate, various changes can be made to the methods, systems and control parameters used to operate and control press 3002 without departing from the scope of the present invention. Alternately, the operating parameters can be manually set rather than using a computer embodied control system. Thus, the examples present herein are not intended to limit, in any way, the scope of the present invention.

Figure 31:
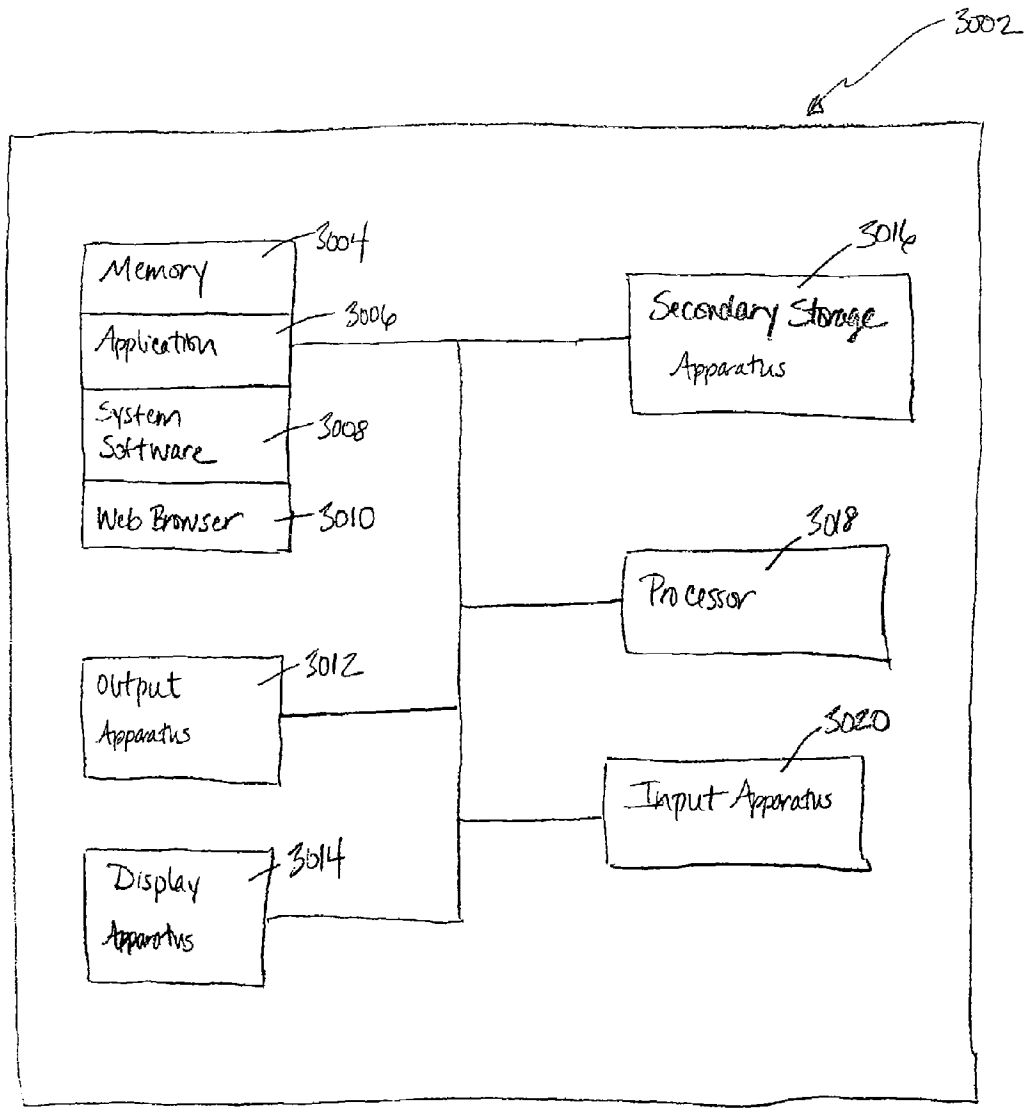
FIG. 31 is a block diagram of the exemplary components of the controller used in accordance with the present invention.

Referring now to FIG. 31, controller 3002 illustrates typical components of a controller. By way of example, controller 3002 can include a memory 3004, a secondary storage apparatus 3016, a processor 3018, an input apparatus 3020, a display apparatus 3014, and an output apparatus 3012. Those skilled in the art can appreciate that controller 3002 can be any computer means used to operate and control press 3000 to produce dispensing packages in accordance with the present invention. Memory 3004 may include random access memory (RAM) or similar types of memory, and it may store one or more applications 3006, including system software 3008, and a web browser 3010, for execution by processor 3018. Secondary storage apparatus 3016 may include a hard disk drive, floppy disk drive, CD-ROM drive, or other types of non-volatile data storage. The local cache that includes data related to particular setups for press 3000 may be stored on secondary storage apparatus 3016. Processor 3018 may execute system software 3008 and other applications 3006 stored in memory 3004 or secondary storage 3016, or received from the Internet or an intranet. Processor 3018 may execute system software 3008 in order to provide the functions described in this specification including controlling the various stages of press 3000 in order to produce dispensing packages in accordance with the present invention.

Input apparatus 3020 may include any device for entering information into controller 3002, such as a keyboard, mouse, cursor-control device, touch-screen, infrared, microphone, digital camera, video recorder, control instrumentation inputs or any other instrument or device necessary to operate and control press 3000 in order to produce dispensing packages in accordance with the present invention.

Display apparatus 3014 may include any type of device for presenting visual information such as, for example, a computer monitor or flat-screen display so that an operator can observe alarms, inputs, outputs, operating parameters and other information related to the operation of press 3000. Output apparatus 3012 may include any type of device for presenting a hard copy of information, such as a printer, and other types of output devices including speakers or any device for providing information in audio form.

Web browser 3010 is used to access patient data stored in memory 3004 and on secondary storage apparatus 3016 and display the data, through which operators can operate and control press 3000 for producing dispensing packages in accordance with the present invention. Web browser 3010 can also be used to access the Internet and/or intranet. Any web browser, co-browser, or other application capable of retrieving content from a network and displaying pages or screens may be used.

Examples of controllers 3002 for operating and controlling press 3000 in accordance with the present invention include personal computers, laptop computers, notebook computers, palm top computers, network computers, Internet appliances, or any processor-controlled device capable of executing a web browser 3010, system software 3008 and any other type of application 3006 stored in memory 3004 or accessible via secondary storage apparatus 3016.

Advantages of the present invention include, but not by way of limitation as to interpretation of the claims, the ability of a user to open a package with one hand and control the dispensing of the contents of the package in accordance with the flexure of the package. A plastic backing is provided which can maintain the structural integrity of the package and provide a surface on which a label can be applied. The plastic backing material can be easily flexed with force applied by a thumb and a single finger of one hand. Flexure of the plastic backing causes the plastic backing to exceed its elastic limit along a score on the convex side of the package, which causes the package to open. A second score on the interior of the package provides a metering hole through a structural layer that regulates the dispensing of fluid. The depth of both scores on the plastic backing and/or the number of metering holes can be altered depending on the contents being dispensed such that varying degrees of force are necessary to open the dispensing package. The score on the outside of the package can be selected to have various lengths, which results in shoulder portions of various selected sizes. Since the plastic backing only breaks along the length of the score on the outside of the package, the shoulder portions provide a stress that is dependent upon the elastic modulus of the plastic backing which allows the user to easily control the dispensing of the contents of the package. Since the size of the shoulders is related to the stress generated by the shoulders, the required force to dispense the contents of the package and the degree of control as to how quickly the contents of the package are dispensed are parameters that can be advantageously included in the package design. In addition, absorbent material can be placed adjacent to or covering the score in order to provide controlled dispensing and application of the contents of the dispensing package. Alternately, film or labels can be placed over the score in order to allow users to reseal the dispensing package. The ends of the dispensing package can be particularly shaped such that it can be used as an applicator and/or handle for the contents being dispensed.

The present invention therefore provides a novel and unique dispensing package that is capable of dispensing any desired type of contents in a desired fashion and a method for producing the same. The packages are inexpensive and simple to manufacture and provide a desirable manner of carrying various contents. The package can be easily carried by a user and dispensed in an easy and simple fashion using one hand. In addition, promotional items can be carried on the package including sequentially numbered game items and other types of game items, booklets or any other type of desired material. These materials can also be used for resealing the package if the entire content of the package is not dispensed.

The foregoing description of the invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. A dispensing package for carrying and dispensing contents through an opening comprising:

(a) a top layer having an outer surface and an inner surface, the top layer including (i) a plastic backing layer defining said outer surface of said top layer and including first and second sides, the plastic backing layer having a first elastic limit and a shear modulus sufficient to maintain said dispensing package in a substantially flat configuration, wherein a first score is formed at least partially through said first side of said plastic backing layer;

(ii) a coating layer defining said inner surface of said top layer and formed on said second side of said plastic backing layer, said coating layer having a second elastic limit that is greater than said first elastic limit, wherein a second score substantially aligned with said first score is formed through said coating layer;

(b) a pouch layer coupled to said inner surface of said top layer such that a pouch is formed therebetween, said pouch being adapted to carry said contents of said package, said contents being in fluid communication with said second score; and wherein said first elastic limit of said plastic backing layer and said second elastic limit of said coating layer are selected such that flexure of said top layer by a first amount is insufficient to cause said coating layer to exceed said second elastic limit, while flexure of said top layer by said first amount is sufficient to cause said plastic backing layer to exceed said first elastic limit and break along said first score to expose a metered opening defined by the overlap of said first score and said second score.

2. The package of claim 1 further comprising a label carried on the outer surface of said top layer.

3. The package of claim 2 further comprising a film removably attached to a top side of said label.

4. The package of claim 1 wherein said coating layer further comprises a barrier layer and a sealant layer.

5. The package of claim 1 wherein said second score comprises a plurality of individual scores.

6. The package of claim 1 further comprising material adjacent one side of said first score.

7. The package of claim 6 wherein said material is configured to apply said contents.

8. The package of claim 1 further comprising a piece of material positioned over said first score.

9. The package of claim 8 wherein said material is configured to apply said contents.

10. The package of claim 1 further comprising an end of said plastic backing layer configured to be an applicator for said contents when said contents are dispensed.

11. The package of claim 10 further comprising a second end of said plastic backing layer configured to be a handle for applying contents when said contents are dispensed.

12. The dispensing package of claim 2 wherein said label is adhered to said top layer of said plastic backing layer by adhesive means.

13. The dispensing package of claim 12 wherein said adhesive means is selected from the group consisting of pressure sensitive adhesive and heat curing adhesive.

14. The dispensing package of claim 1 further comprising a label printed on said first side of said plastic backing layer.

15. The dispensing package of claim 3 wherein said film is adhered to said top side of said label by adhesive means.

16. The dispensing package of claim 15 wherein said adhesive means is selected from the group consisting of pressure sensitive adhesive and heat curing adhesive.

17. The dispensing package of claim 15 wherein said adhesive means is omitted from one corner of said film such that non-adhered portion of said film forms a peel tab.

18. The dispensing package of claim 8 wherein said material comprises an absorbent material.

19. The dispensing package of claim 18 wherein said absorbent material is selected from the group consisting of sponge, cloth, flock and foam.

20. The dispensing package of claim 8 wherein said material comprises a non-absorbent material.

21. The dispensing package of claim 20 wherein said non-absorbent material is selected from the group consisting of sand paper and hard plastic.

22. The dispensing package of claim 18 wherein said absorbent material comprises at least one opening configured to provide controlled application of said contents.

23. The dispensing package of claim 1 further comprising two pieces of material laterally positioned along opposing sides of said first score.

24. The dispensing package of claim 1 wherein said pouch layer further comprises an outer pouch layer disposed over an inner sealant layer, said outer pouch layer and said inner sealant layer having a barrier layer therebetween, each of said layers having a perimeter.

25. The dispensing package of claim 24 wherein said perimeters of said outer pouch layer, said inner sealant layer and said barrier layer are sealingly engaged to a perimeter of said coating layer.

26. The dispensing package of claim 25 wherein said perimeters of said outer pouch layer, said inner sealant layer and said barrier layer are sealingly engaged to said perimeter of said coating layer with a sealing means.

27. The dispensing package of claim 26 wherein said sealing means is selected from the group consisting of heat sealing, adhesives and ultrasonic sealing.

28. The dispensing package of claim 25 wherein said outer pouch layer, said inner sealant layer and said barrier layer are non-permanently sealingly engaged to said coating layer along a portion thereof.

29. The dispensing package of claim 28 wherein said second score comprises a plurality of individual scores.

30. The dispensing package of claim 1 wherein said first score extends through a middle portion of said plastic backing layer with continuous portions of said plastic backing layer extending from opposing longitudinal ends of said first score to an outer edge of said plastic backing layer.

31. The dispensing package of claim 1 further comprising a resealable layer disposed on said outer surface of said top layer and configured to cover said first score in order to prevent undesired or further dispensing of said contents.

32. The dispensing package of claim 31 wherein said resealable layer further comprises a promotional item selected from the group consisting of labels, game pieces, lottery cards, booklets and coupons.

33. A method of making a dispensing package for dispensing contents through at least one metered opening comprising:

providing a plastic backing layer including first and second sides, said plastic backing layer having a first sheer modulus sufficient to maintain said package in a substantially flat configuration and a first elastic limit;

providing a coating layer formed on said second side of said plastic backing layer, said coating layer having a second elastic limit that is greater than said first elastic limit;

placing a label on said first side of said plastic backing layer;

forming a first score at least partially through said label and said first side of said plastic backing layer;

forming a second score substantially aligned with said first score in said coating layer;

coupling a pouch layer to said coating layer to form a pouch defined therebetween, said pouch adapted to carry said contents;

filling said pouch with said contents; and selecting said first elastic limit of said plastic backing layer and said second elastic limit of said coating layer such that flexure of said coating layer by a first amount is insufficient to cause said coating layer to exceed said second elastic limit, while flexure of said plastic backing layer by said first amount is sufficient to cause said plastic backing layer to exceed said first elastic limit and break along said first score to expose a metered opening defined by the overlap of said first score and said second score.

34. The method of claim 33 further comprising removably placing a film on a top side of said label before forming said first score.

35. The method of claim 33 further comprising placing two pieces of absorbent material adjacent opposing sides of said first score before forming said first score.

36. The method of claim 33 further comprising placing one piece of absorbent material over said first score before coupling said pouch layer to said coating layer.

37. The method of claim 33, further comprising forming additional scores substantially aligned with said first score in said coating layer.

38. The method of claim 33 wherein one end of said plastic backing layer is configured to be an applicator to apply said contents.

39. The method of claim 18 wherein a second end of said plastic backing layer is configured to be a handle to apply said contents. 0

40. The method of claim 33 wherein said label is removably placed on said first side of said plastic backing layer by adhesive means.

41. The method of claim 40 wherein said adhesive means is selected from the group consisting of pressure sensitive adhesive and heat curing adhesive.

42. The method of claim 34 wherein said film is adhered to said top side of said label by adhesive means.

43. The method of claim 42 wherein said adhesive means is selected from the group consisting of pressure sensitive adhesive and heat curing adhesive.

44. The method of claim 42 wherein said adhesive means is omitted from at least one corner of said film such that non-adhered portion of said film forms a peel tab.

45. The method of claim 35 or 36 wherein said material comprises an absorbent material.

46. The method of claim 45 wherein said absorbent material is selected from the group consisting of sponge, cloth, flock and foam.

47. The method of claim 35 or 36 wherein said material comprises a non-absorbent material.

48. The method of claim 47 wherein said non-absorbent material is selected from the group consisting of sand paper and hard plastic.

49. The method of claim 45 wherein said absorbent material comprises at least one opening configured to provide controlled application of said contents.

50. The method of claim 33 wherein said pouch layer further comprises an outer pouch layer disposed over an inner sealant layer, said outer pouch layer and said inner sealant layer having a barrier layer therebetween, each of said layers having a perimeter.

51. The method of claim 50 wherein said perimeters of said outer pouch layer, said inner sealant layer and said barrier layer are sealingly engaged to a perimeter of said coating layer.

52. The method of claim 51 wherein said perimeters of said outer pouch layer, said inner sealant layer and said barrier layer are sealingly engaged to said perimeter of said coating layer with a sealing means.

53. The method of claim 52 wherein said sealing means is selected from the group consisting of heat sealing, adhesive and ultrasonic sealing.

54. The method of claim 33 wherein said first score is a partial score for preventing accidental dispensing when said dispensing package is stored in luggage, purses or wallets, said partial score extending through a middle portion of said plastic backing layer with continuous portions of said plastic backing layer extending from opposing longitudinal ends of said first score to an outer edge of said plastic backing layer.

55. The method of claim 33 further comprising a resealable layer disposed on said first side of said plastic backing layer and configured to cover said first score in order to prevent undesired or further dispensing of said contents.

56. The method of claim 55 wherein said resealable layer further comprises a promotional item selected from the group consisting of labels, game pieces, lottery cards, booklets and coupons.

57. The method of claim 33 further comprising a means for providing control over formation of depth of said first score in said plastic backing layer.

58. The method of claim 57 wherein said means and said depth are selected based on said contents being dispensed.

59. The method of claim 58 wherein said means is a mechanical means.

60. The method of claim 59 wherein said mechanical means includes a flat bed die.

61. The method of claim 59 wherein said mechanical means includes a cylindrical die.

62. The method of claim 57 wherein said means is a laser means.

63. The method of claim 61 wherein said cylindrical die cooperates with a mating means for providing control of cutting blades used to form said first score in said plastic backing layer.

64. The method of claim 63 wherein said mating means is a cylindrical anvil.

65. The method of claim 63 wherein said first score is formed at a depth selected based on said contents being dispensed.

66. The method of claim 33 wherein said filling said pouch with said contents further comprises providing a pump for pumping said contents into said pouch.

67. The method of claim 66 wherein said pump provides a dispensing time selected to reduce cross seal contamination and provide enhanced seal integrity of said dispensing package.

68. The method of claim 33 wherein said filling said pouch with said contents further comprises providing filler tubes sized according to said contents being dispensed.

69. The method of claim 67 wherein a back pressure is used with said pump during filling and sealing to provide metered dispensing according to sizes of said pouches for avoiding channeling a cross seal area of said dispensing package.

70. A dispensing package for carrying and dispensing contents comprising:

a plastic backing layer including first and second sides, said plastic backing layer having a first elastic limit and a shear modulus sufficient to maintain said dispensing package in a substantially flat configuration, wherein a first score is formed at least partially through said first side of said plastic backing layer;

a coating layer formed on said second side of said plastic backing layer and having a second elastic limit that is greater than said first elastic limit, wherein a second score substantially aligned with said first score is formed through said coating layer; and a pouch layer coupled to said coating layer and forming a pouch therebetween that is adapted to carry said contents of said package, said contents being in fluid communication with said second score;

wherein said first elastic limit of said plastic backing layer and said second elastic limit of said coating layer are selected such that flexure of said coating layer by a first amount is insufficient to cause said coating layer to exceed said second elastic limit, while flexure of said plastic backing layer by said first amount is sufficient to cause said plastic backing layer to exceed said first elastic limit and break along said first score to expose a metered opening defined by the overlap of said first score and said second score.

71. A dispensing package for carrying and dispensing contents comprising:

an upper layer including first and second sides, said upper layer having a first elastic limit and a shear modulus sufficient to maintain said dispensing package in a substantially flat configuration, wherein a first score is formed in said first side of said upper layer;

a middle layer disposed on said second side of said upper layer and having a second elastic limit that is greater than said first elastic limit, wherein a second score substantially aligned with said first score is formed through said middle layer; and a lower layer coupled to said middle layer so as to define a pouch therebetween, said pouch structured to carry said contents of said package such that said contents are in fluid communication with said second score;

wherein said first elastic limit of said upper layer and said second elastic limit of said middle layer are selected such that flexure of said middle layer by a first amount is insufficient to cause said middle layer to exceed said second elastic limit, while flexure of said upper layer by said first amount is sufficient to cause said upper layer to exceed said first elastic limit and break along said first score to expose a metered opening defined by the overlap of said first score and said second score.

72. A method of making a dispensing package comprising:

providing a plastic backing layer including first and second sides, said plastic backing layer having a first elastic limit;

providing a coating layer formed on said second side of said plastic backing layer, said coating layer having a second elastic limit that is greater than said first elastic limit;

forming a first score at least partially through said first side of said plastic backing layer;

forming a second score substantially aligned with said first score in said coating layer;

coupling a pouch layer to said coating layer to form a pouch defined therebetween, said pouch adapted to carry said contents;

filling said pouch with said contents; and selecting said first elastic limit of said plastic backing layer and said second elastic limit of said coating layer such that flexure of said coating layer by a first amount is insufficient to cause said coating layer to exceed said second elastic limit, while flexure of said plastic backing layer by said first amount is sufficient to cause said plastic backing layer to exceed said first elastic limit and break along said first score to expose a metered opening defined by the overlap of said first score and said second score.

* * * * *